US008989639B2

(12) United States Patent
Kobaru et al.

(10) Patent No.: US 8,989,639 B2
(45) Date of Patent: Mar. 24, 2015

(54) IMAGE FORMING APPARATUS HAVING TONER DENSITY CONTROL

(75) Inventors: Yasunari Kobaru, Susono (JP); Yasuo Yoda, Numazu (JP); Takahiro Uchiyama, Mishima (JP); Yoshiki Kudo, Mishima (JP); Takeshi Kawamura, Mishima (JP); Tatsuaki Orihara, Tokyo (JP); Naoto Tsuchihashi, Yokohama (JP); Hidetoshi Hanamoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/825,620

(22) PCT Filed: Nov. 18, 2011

(86) PCT No.: PCT/JP2011/077282

§ 371 (c)(1),
(2), (4) Date: Mar. 22, 2013

(87) PCT Pub. No.: WO2012/067275

PCT Pub. Date: May 24, 2012

(65) Prior Publication Data

US 2013/0343788 A1 Dec. 26, 2013

(30) Foreign Application Priority Data

Nov. 19, 2010 (JP) ..... 2010-258602
Sep. 2, 2011 (JP) ..... 2011-191749
Oct. 14, 2011 (JP) ..... 2011-227039

(51) Int. Cl.
*G03G 15/00* (2006.01)
*G03G 15/08* (2006.01)
(Continued)

(52) U.S. Cl.
CPC ..... *G03G 15/065* (2013.01); *G03G 15/325* (2013.01)
USPC ..... 399/285; 399/55; 399/159; 399/291

(58) Field of Classification Search
CPC .. G03G 15/344; G03G 15/348; G03G 15/065
USPC ..... 399/285, 291, 53, 55, 159; 347/55
See application file for complete search history.

(56) References Cited

U.S. PATENT DOCUMENTS 4,396,927 A 8/1983 Amaya et al.
(Continued)

FOREIGN PATENT DOCUMENTS

EP 0 717 327 A1 6/1996
JP 58-171976 A 10/1983
(Continued)

OTHER PUBLICATIONS

Mar. 16, 2012 International Search Report issued in PCT/JP2011/077282, Mar. 16, 2012 Written Opinion of International Searching Authority, and Notification of Transmittal of International Search Report and Written Opinion of International Searching Authority dated Mar. 16, 2012.
(Continued)

*Primary Examiner* — Sophia S Chen
(74) *Attorney, Agent, or Firm* — Fitzpatrick, Cella, Harper & Scinto

(57) ABSTRACT

An image forming apparatus includes a toner carrying roller for carrying a toner, an image carrying member, contacting the toner on the toner carrying roller, on which a toner image is to be formed with the toner, and an electrode portion provided at an opposing position in which the electrode portion opposes the toner carrying roller via the image carrying member interposed therebetween. The toner image is formed on the image carrying member by changing a value of a voltage, on the basis of image information, applied to the electrode portion, and the toner carried on the toner carrying roller and the image carrying member contact each other in a toner contact area. The toner is moved between the toner carrying roller and the image carrying member in a toner movement area by changing the value of the voltage applied to the electrode portion, and the toner movement area is present downstream of the toner contact area with respect to a movement direction of the image carrying member.

11 Claims, 47 Drawing Sheets

(51) Int. Cl.
*G03G 15/06* (2006.01)
*G03G 15/32* (2006.01)

(56) References Cited

U.S. PATENT DOCUMENTS

| | | | | |
|---|---|---|---|---|
| 5,124,729 | A * | 6/1992 | Nakazawa et al. | 347/55 |
| 6,250,742 | B1 * | 6/2001 | Kido | 347/55 |
| 6,987,939 | B2 | 1/2006 | Ishiyama et al. | |
| 7,031,629 | B2 | 4/2006 | Kawamura et al. | |
| 7,254,350 | B2 | 8/2007 | Kawamura et al. | |
| 7,415,230 | B2 | 8/2008 | Kawamura et al. | |
| 7,962,057 | B2 | 6/2011 | Yamamoto et al. | |
| 7,991,315 | B2 | 8/2011 | Kawamura et al. | |
| 8,175,476 | B2 | 5/2012 | Yamamoto et al. | |
| 8,285,166 | B2 | 10/2012 | Yamamoto et al. | |

FOREIGN PATENT DOCUMENTS

| | | | |
|---|---|---|---|
| JP | 60-199668 | A | 10/1985 |
| JP | 11-143149 | A | 5/1999 |

OTHER PUBLICATIONS

Chinese Office Action dated Dec. 26, 2014, in related Chinese Patent Application No. 201180054660.2 (with English translation).

* cited by examiner (a)

(b)

(a)

(b)

(a)

(b)

(a)

(b)

(a)

(b)

(a)

(b)

(a)

(b)

(c)

(a)

(b)

(a)

(b)

(a)

(b)

(a)

(b)

(a)

(b)

(a)

(b)

(a)

(b)

IMAGE FORMING APPARATUS HAVING TONER DENSITY CONTROL

TECHNICAL FIELD

The present invention relates to an image forming apparatus for forming an image by carrying a toner on a recording material (member).

BACKGROUND ART

As a conventional image forming apparatus, a multi-stylus printer using needle-like electrodes is used (U.S. Pat. No. 4,396,927).

In this multi-stylus printer, an image forming electrode provided with a large number of needle-like electrodes and a cylindrical opposite electrode are oppositely disposed with a predetermined spacing (gap) in which a recording material is interposed in contact with the image forming electrode. In this state, a voltage corresponding to an image signal is applied to the image forming electrode to cause gap electric discharge, so that a toner image is formed.

In the conventional multi-stylus printer using the needle-like electrodes as the image forming electrode, a density of an image portion cannot be sufficiently obtained. Further, there arose a problem such that a so-called fog by which the toner is deposited on a non-image portion cannot be sufficiently reduced.

FIG. 29 is a schematic illustration of a conventional image forming apparatus using a needle-like electrode, wherein an opposite (counter) electrode 302 carries a toner T and is disposed opposed to an image forming electrode 301 via a recording material 303. The toner T carried on the opposite electrode 302 has a toner contact area in which it contacts the recording material 303. In this state, a voltage corresponding to an electrical signal is applied to the image forming electrode 301, so that the toner T is deposited on the recording material 303. Simultaneously, the recording material is moved in an arrow a direction at a certain speed, so that the toner image is formed on the recording material.

However, in the case where an image forming electrode toner image is formed in the constitution as described above, such a phenomenon that the toner image formed by the image forming electrode 301 is disturbed in a toner contact area downstream of a contact position of the image forming electrode 301 with respect to a movement direction of the recording material 301 occurs. For that reason, there arose problems that a toner image density is lowered and fog is increased.

DISCLOSURE OF THE INVENTION

A principal object of the present invention is to provide an image forming apparatus capable of forming a toner image reduced in fog at a non-image portion while ensuring an image density at an image portion.

Accordingly, an aspect of the present invention is to provide an image forming apparatus comprising:

a toner carrying member for carrying a toner;

an image carrying member, contacting the toner on the toner carrying member, on which a toner image is to be formed with the toner; and an electrode portion provided at an opposing position in which the electrode portion opposes the toner carrying member via the image carrying member interposed therebetween;

wherein the toner image is formed on the image carrying member by changing a value of a voltage, on the basis of image information, applied to the electrode portion, wherein the toner carried on the toner carrying member and the image carrying member contact each other in a toner contact area, wherein the toner is moved between the toner carrying member and the image carrying member in a toner movement area by changing the value of the voltage applied to the electrode portion, and wherein the toner movement area is present downstream of the toner contact area with respect to a movement direction of the image carrying member.

These and other objects, features and advantages of the present invention will become more apparent upon a consideration of the following description of the preferred embodiments of the present invention taken in conjunction with the accompanying drawings.

Figure 2:
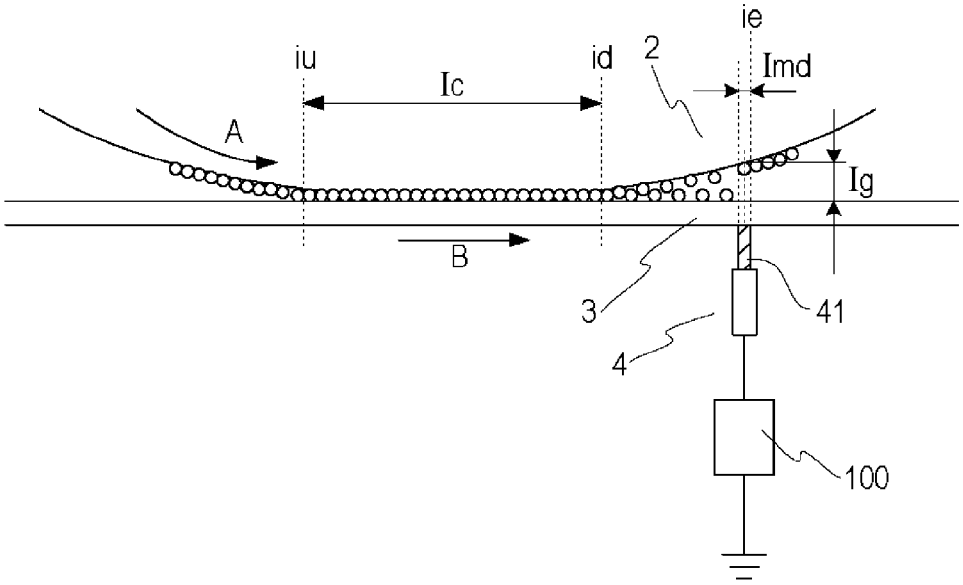
Figure 2:
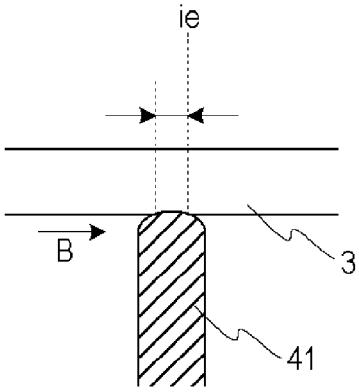

Parts (a) and (b) of FIG. 2 are enlarged schematic illustrations of an image forming portion provided with a needle-like electrode and an image forming electrode contact area in Embodiment 1.

Figure 3:
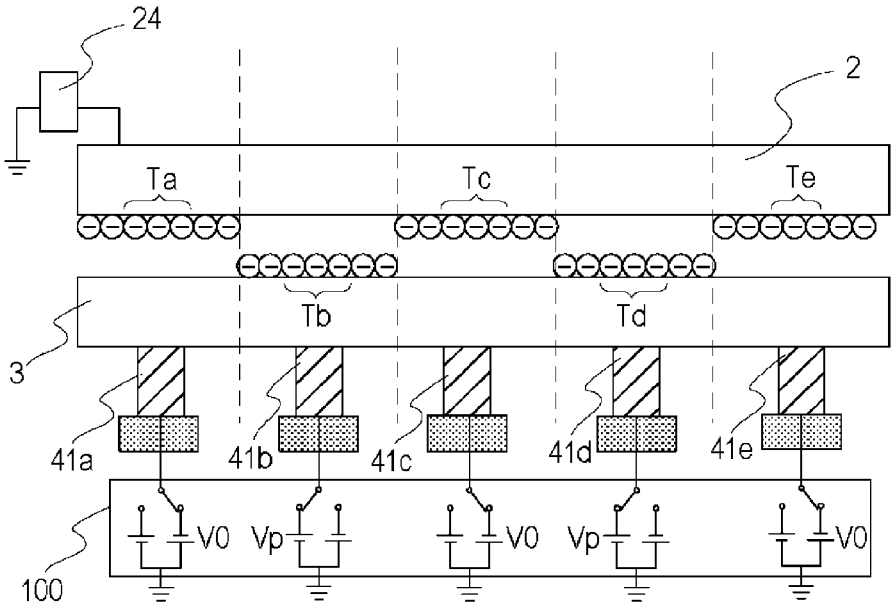
Figure 3:
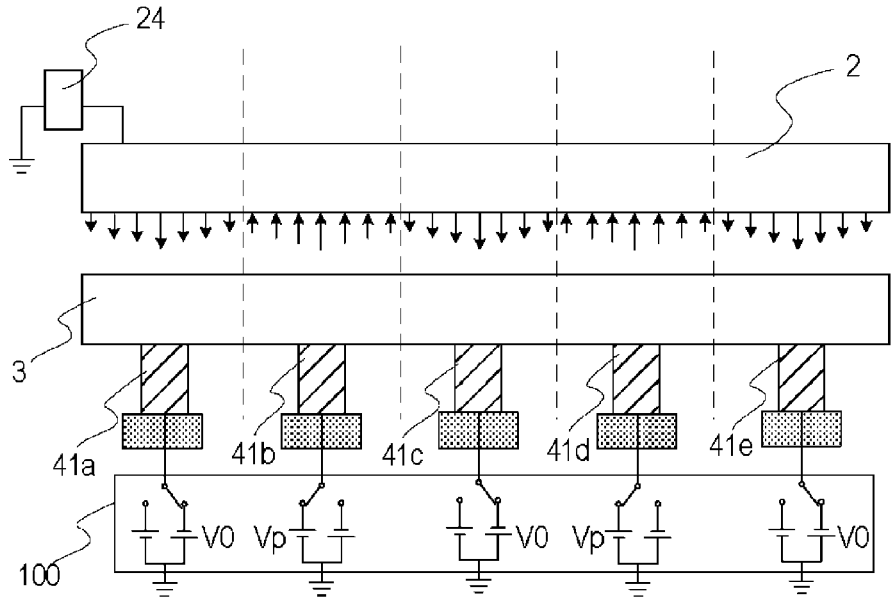

Parts (a) and (b) of FIG. 3 are enlarged schematic illustrations each showing a state of a toner between a toner carrying roller and an image carrying member in Embodiment 1.

Figure 4:
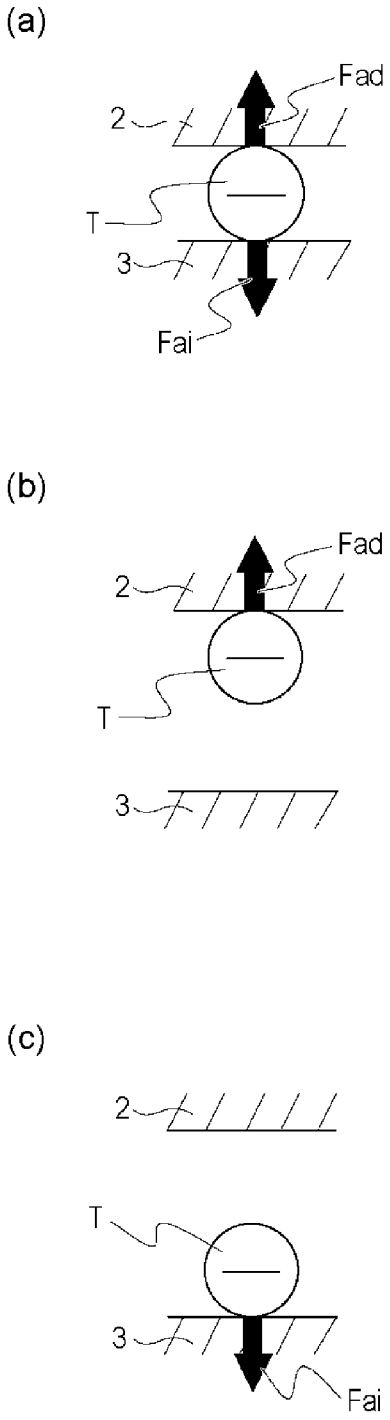
Figure 5:
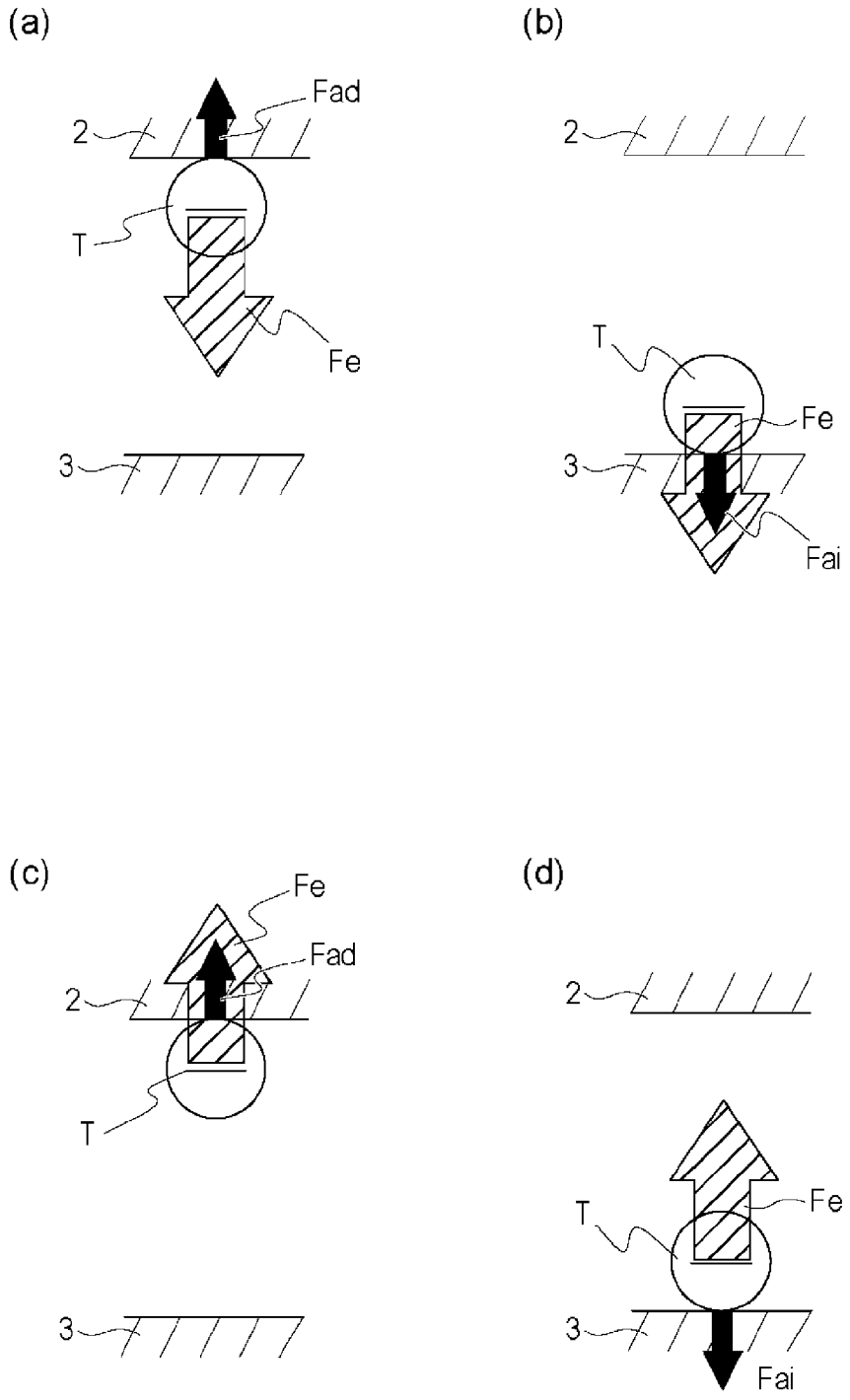

Parts (a) to (c) of FIG. 4 and parts (a) to (d) of FIG. 5 are schematic model views for illustrating a force acting on the toner.

Figure 6:
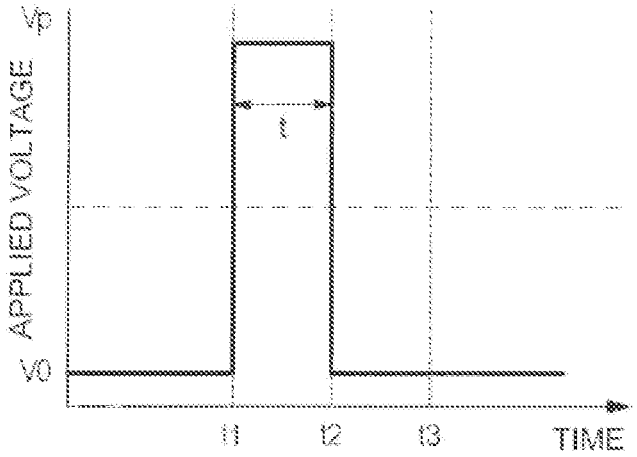

FIG. 6 is a timing chart of a voltage applied to an image forming electrode.

Figure 7:
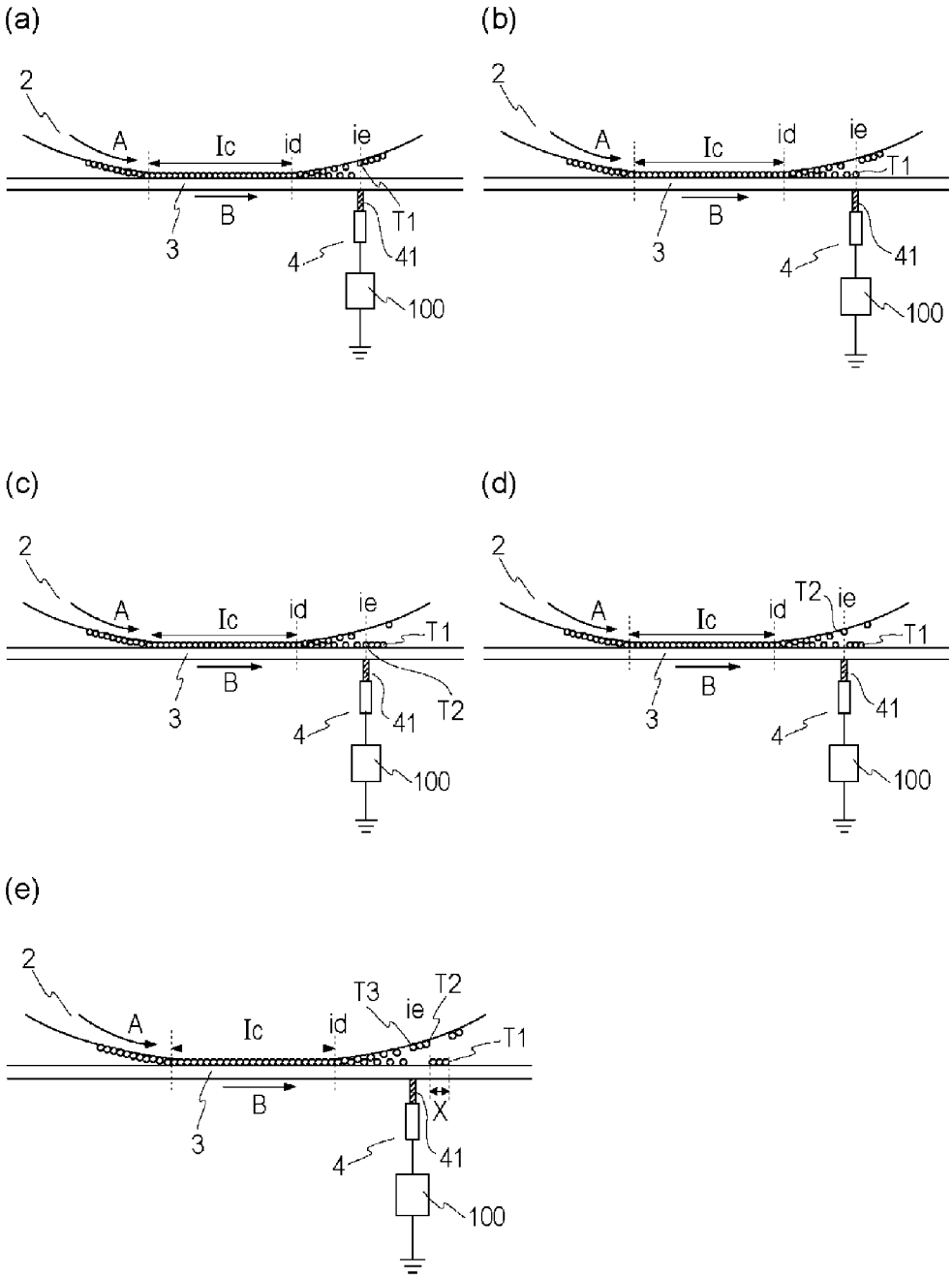

Parts (a) to (e) of FIG. 7 is a schematic illustration showing the toner state between the toner carrying roller and the image carrying member.

Figure 8:
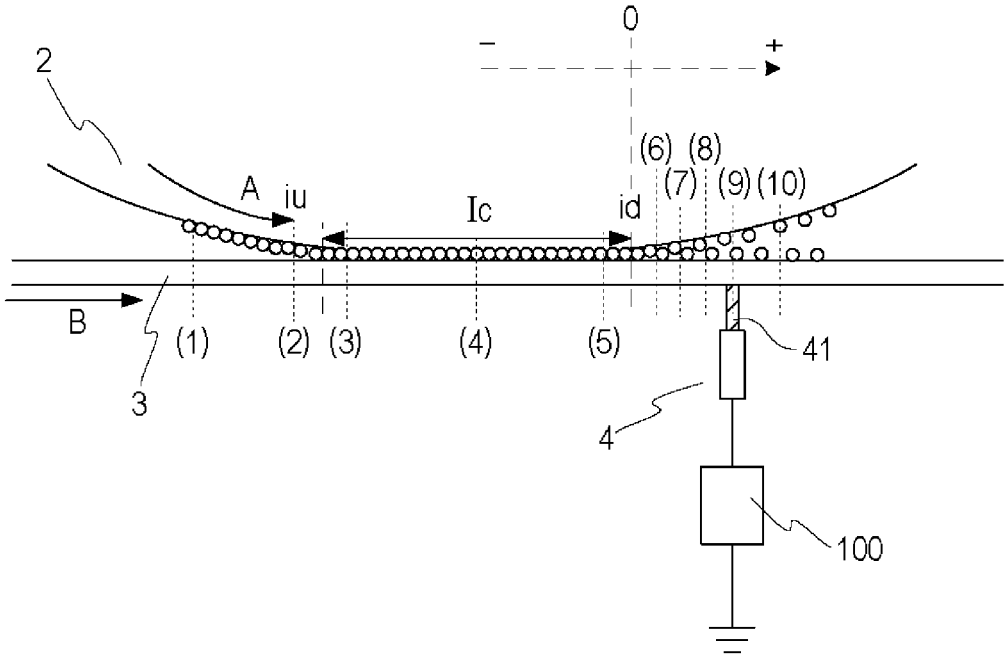

FIG. 8 is a schematic illustration showing needle-like electrode positions in image comparison in Embodiment 1.

Figure 9:
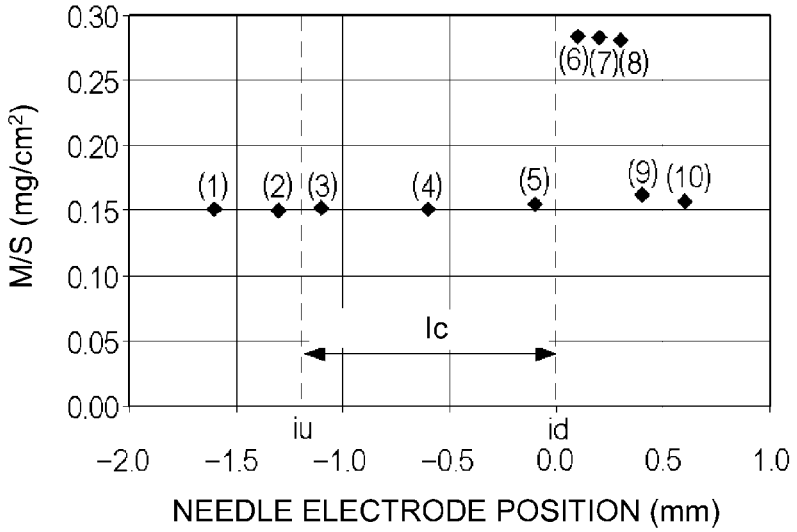
Figure 9:
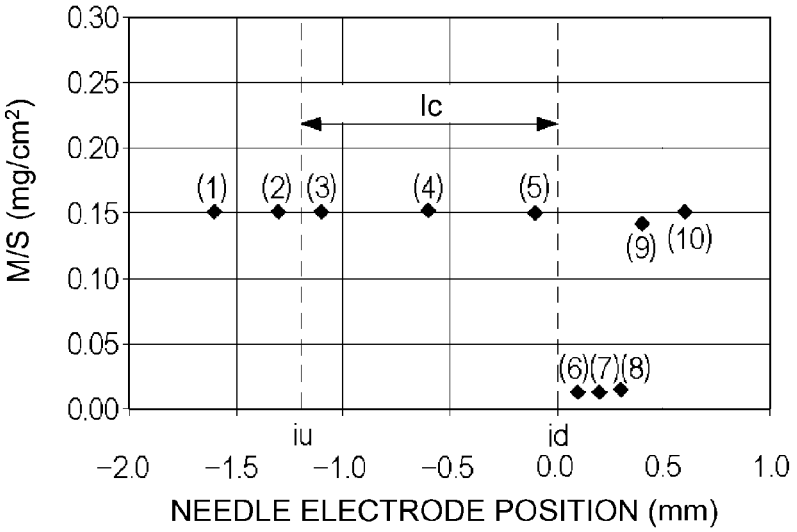

Parts (a) and (b) of FIG. 9 are graphs each showing a toner amount on the image carrying member in image comparison in Embodiment 1.

Figure 10:
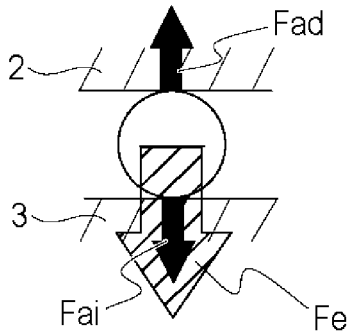
Figure 10:
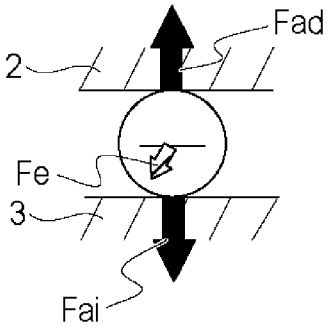

Parts (a) and (b) of FIG. 10 are model views for illustrating the force acting on the toner.

Figure 11:
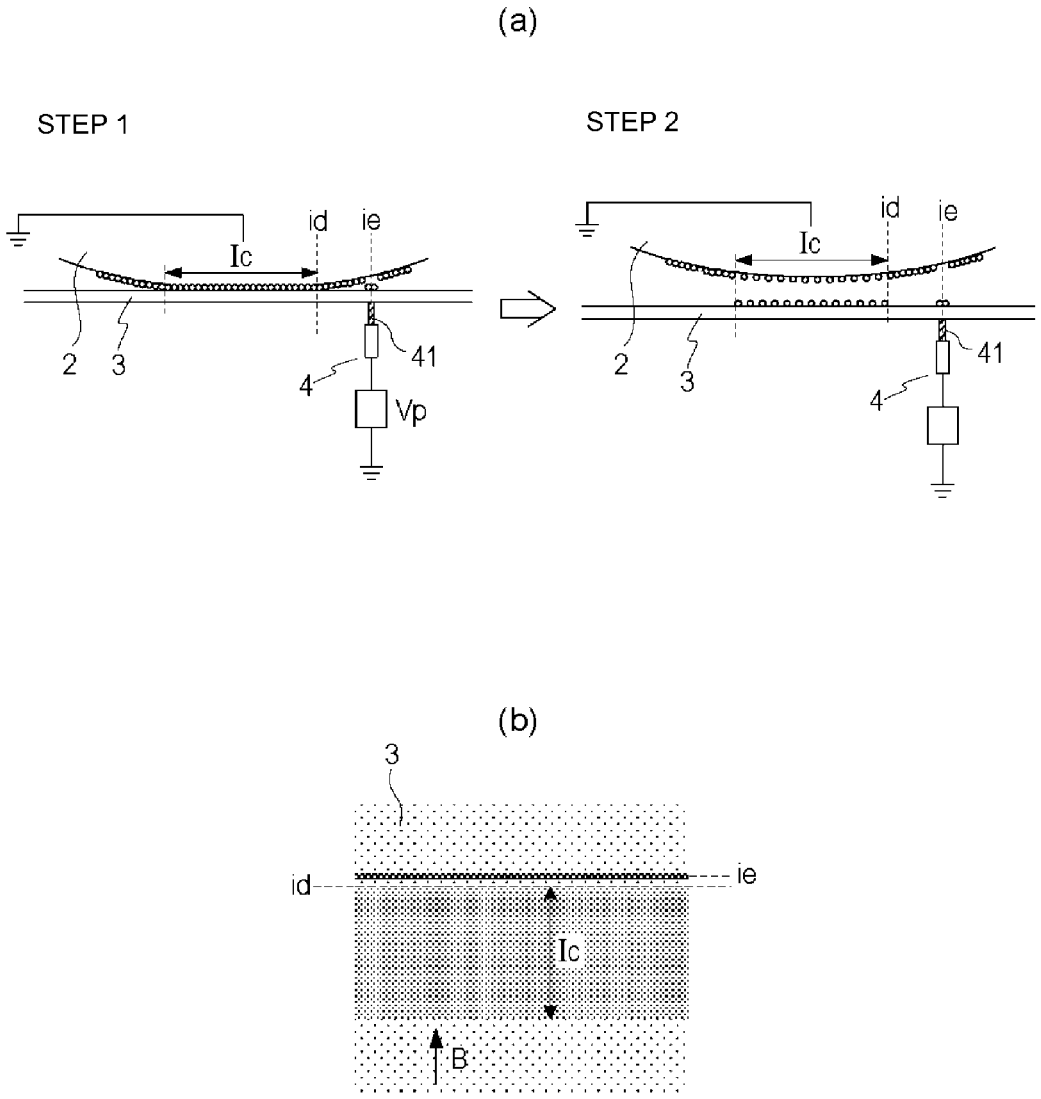

Parts (a) and (b) of FIG. 11 are schematic illustrations for illustrating a measuring method of a toner contact area and an image forming electrode position in Embodiment 1.

Figure 12:
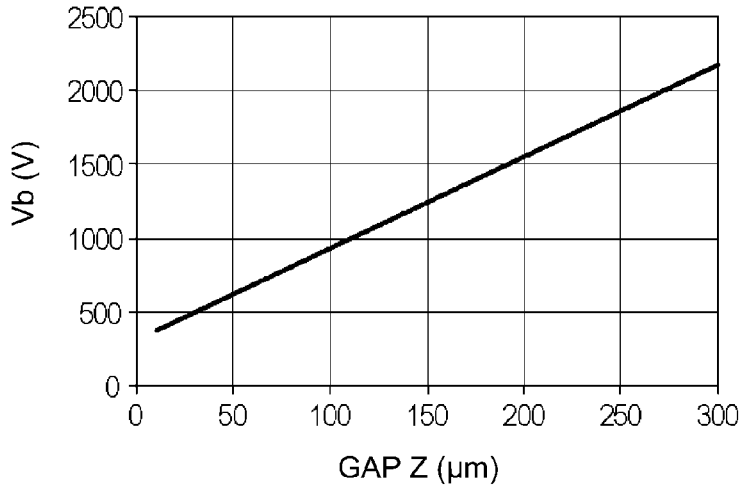
Figure 12:
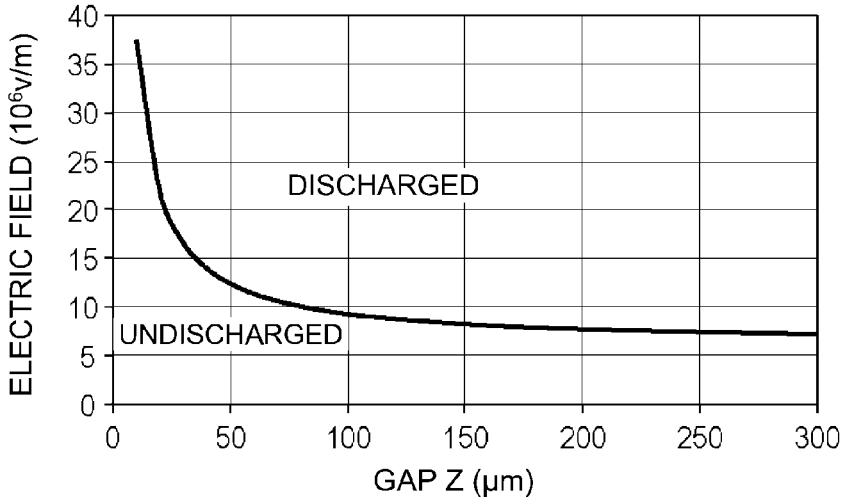

Parts (a) and (b) of FIG. 12 are graphs each showing a relationship between a spacing and an electric discharge start voltage Vb and between the spacing and an electric field, respectively.

Figure 13:
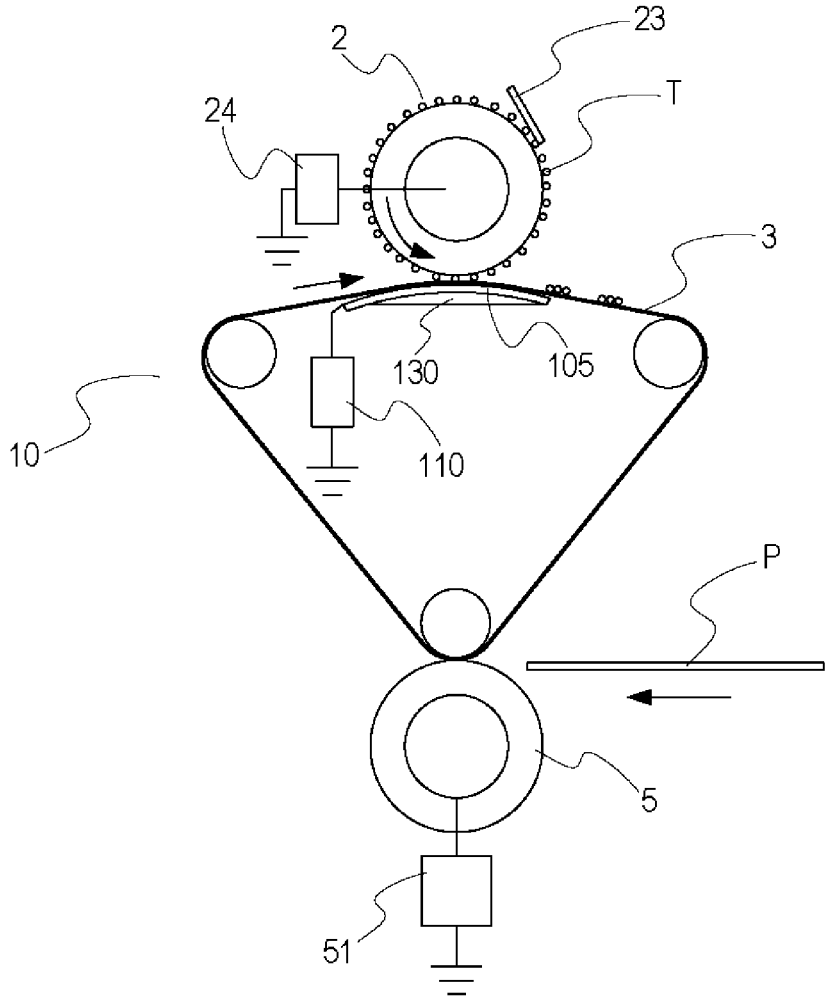

FIG. 13 is a schematic illustration of an image forming apparatus in Embodiment 2.

Figure 14:
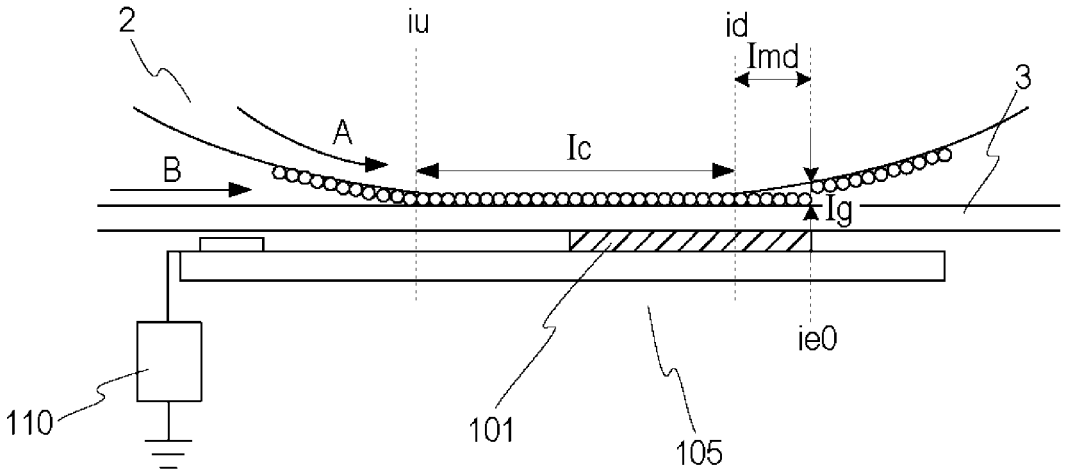

FIG. 14 is an enlarged schematic illustration of an image forming portion where an image forming electrode is disposed in Embodiment 2.

Figure 15A:
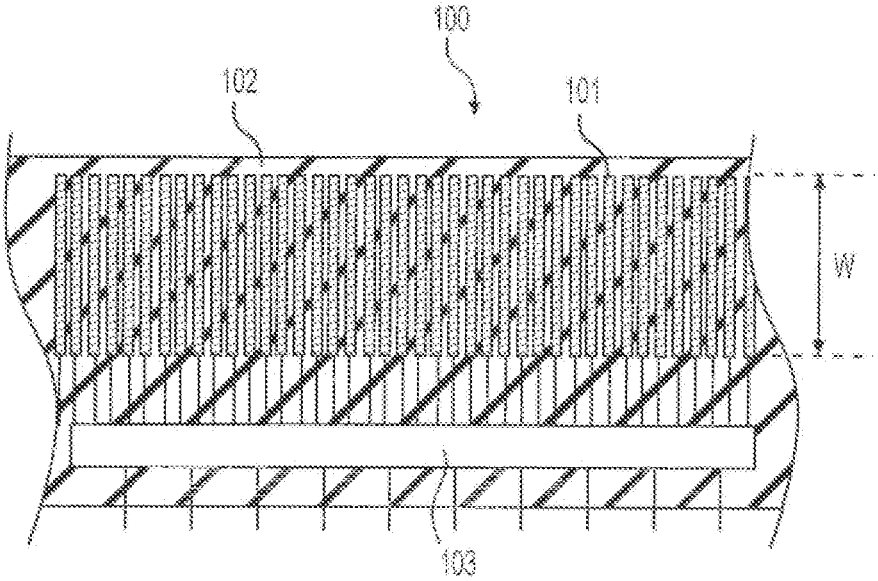
Figure 15B:
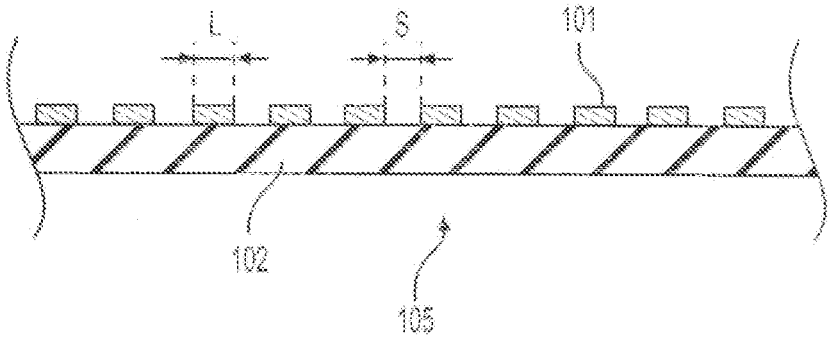
Figure 15C:
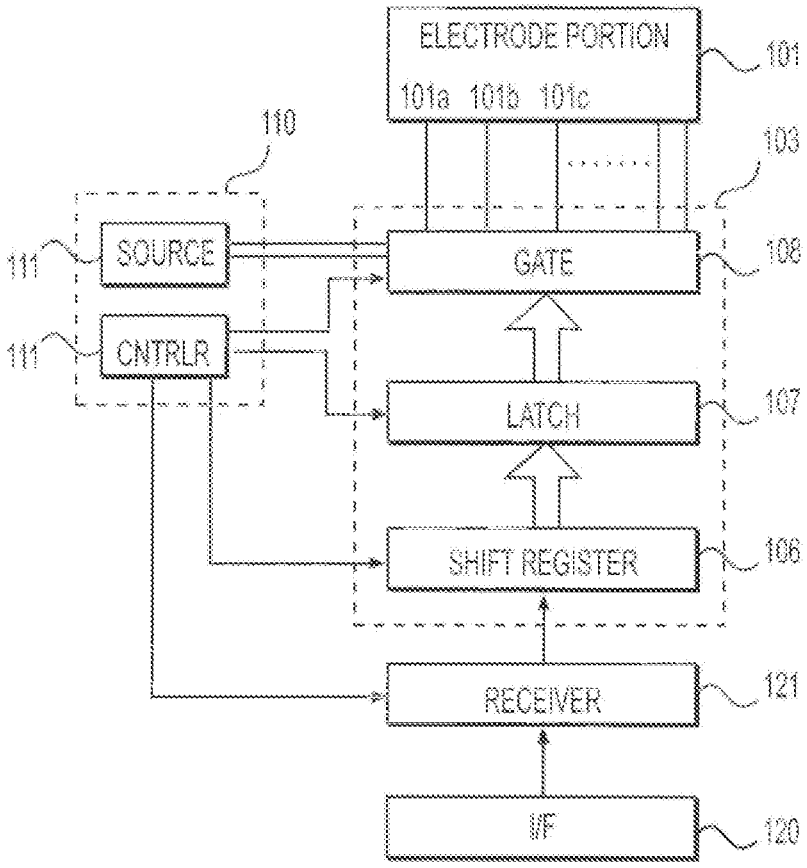

Parts (a) to (c) of FIG. 15 are schematic illustrations of the image forming electrode in Embodiment 2.

Figure 16A:
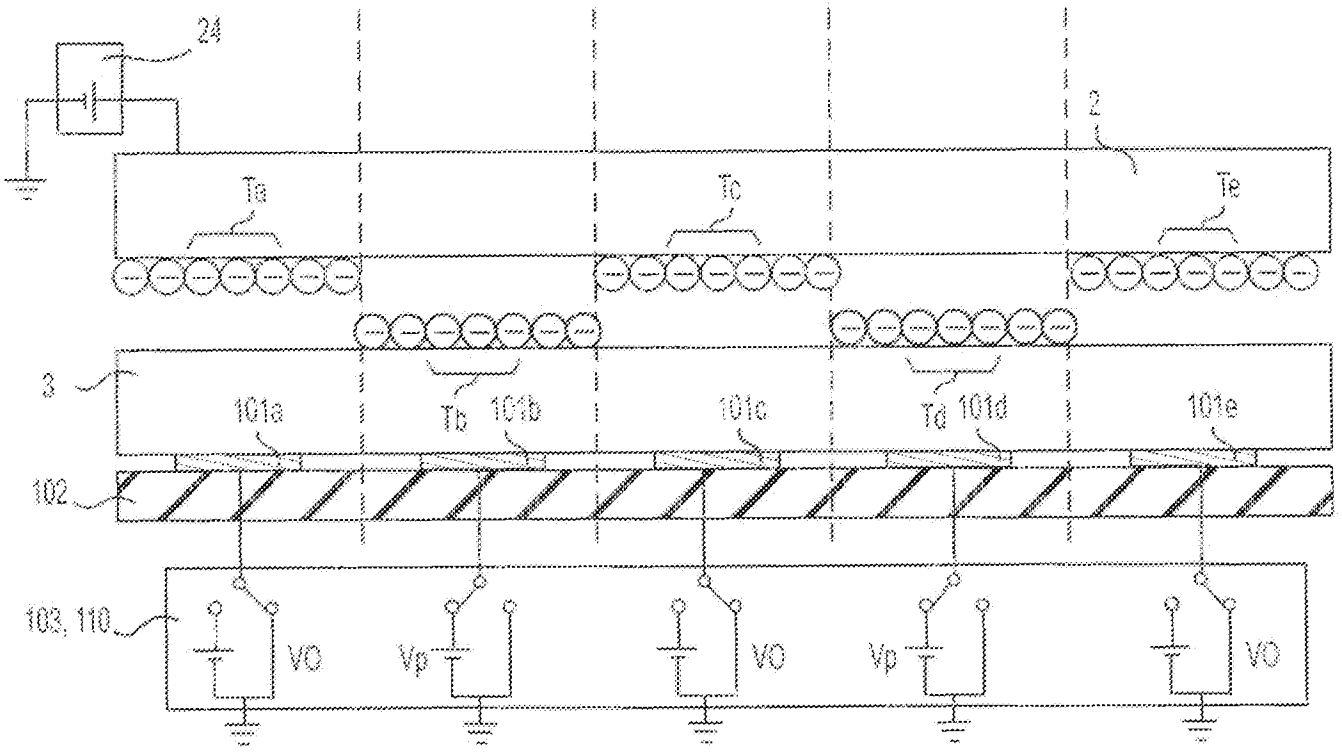
Figure 16B:
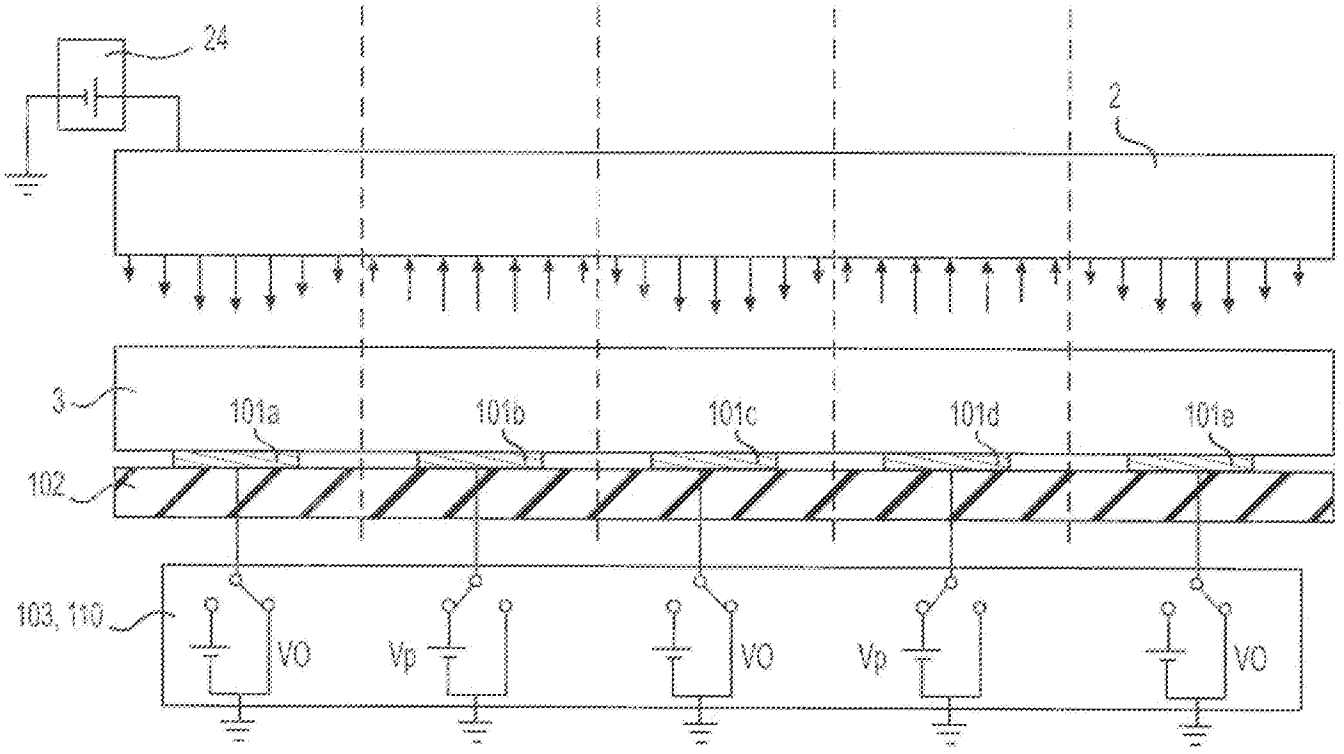

Parts (a) and (b) of FIG. 16 are enlarged schematic illustrations each showing a toner state between a toner carrying roller and an image carrying member in Embodiment 2.

Figure 17:
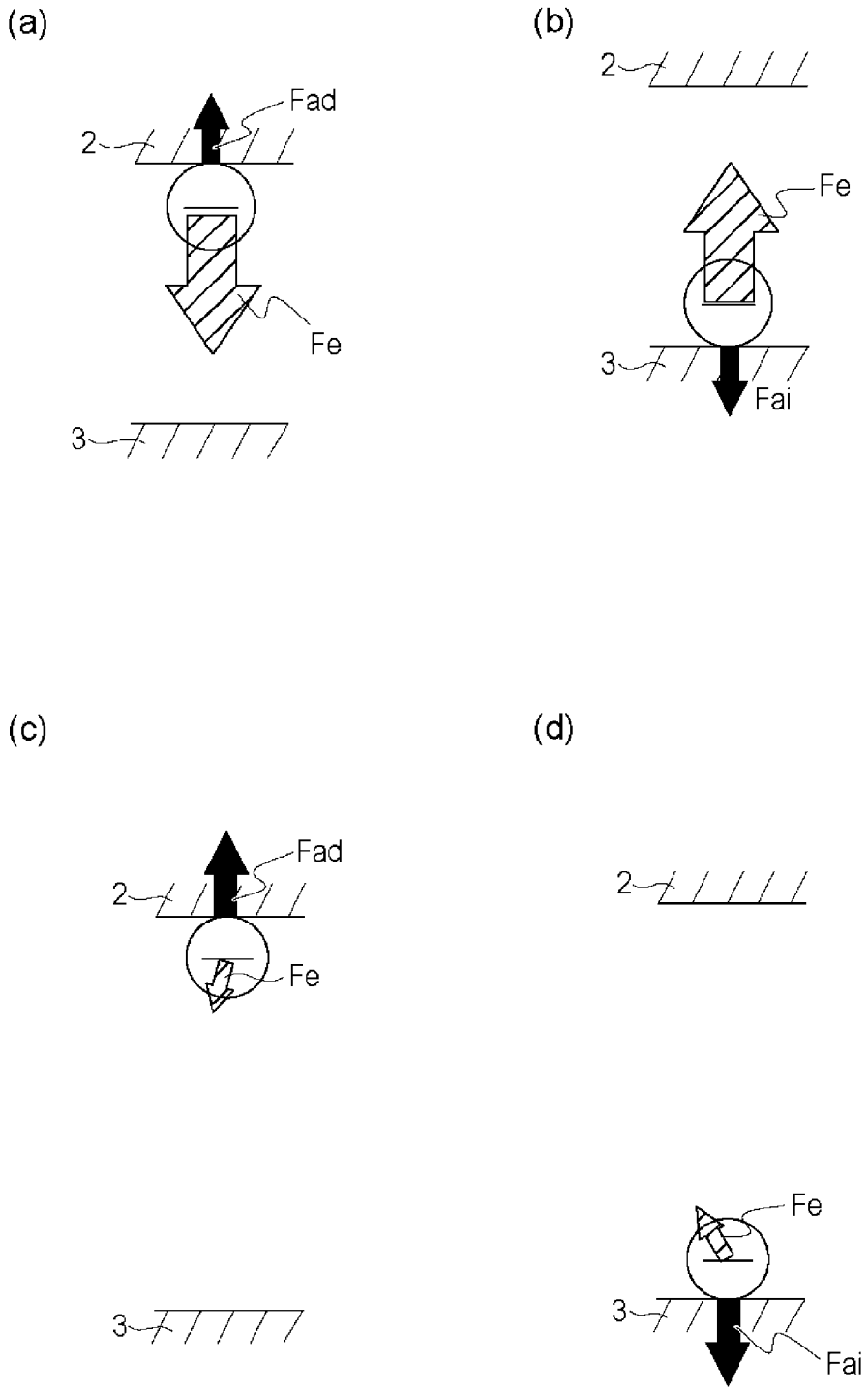

Parts (a) to (d) of FIG. 17 are schematic model views for illustrating a force acting on the toner.

Figure 18:
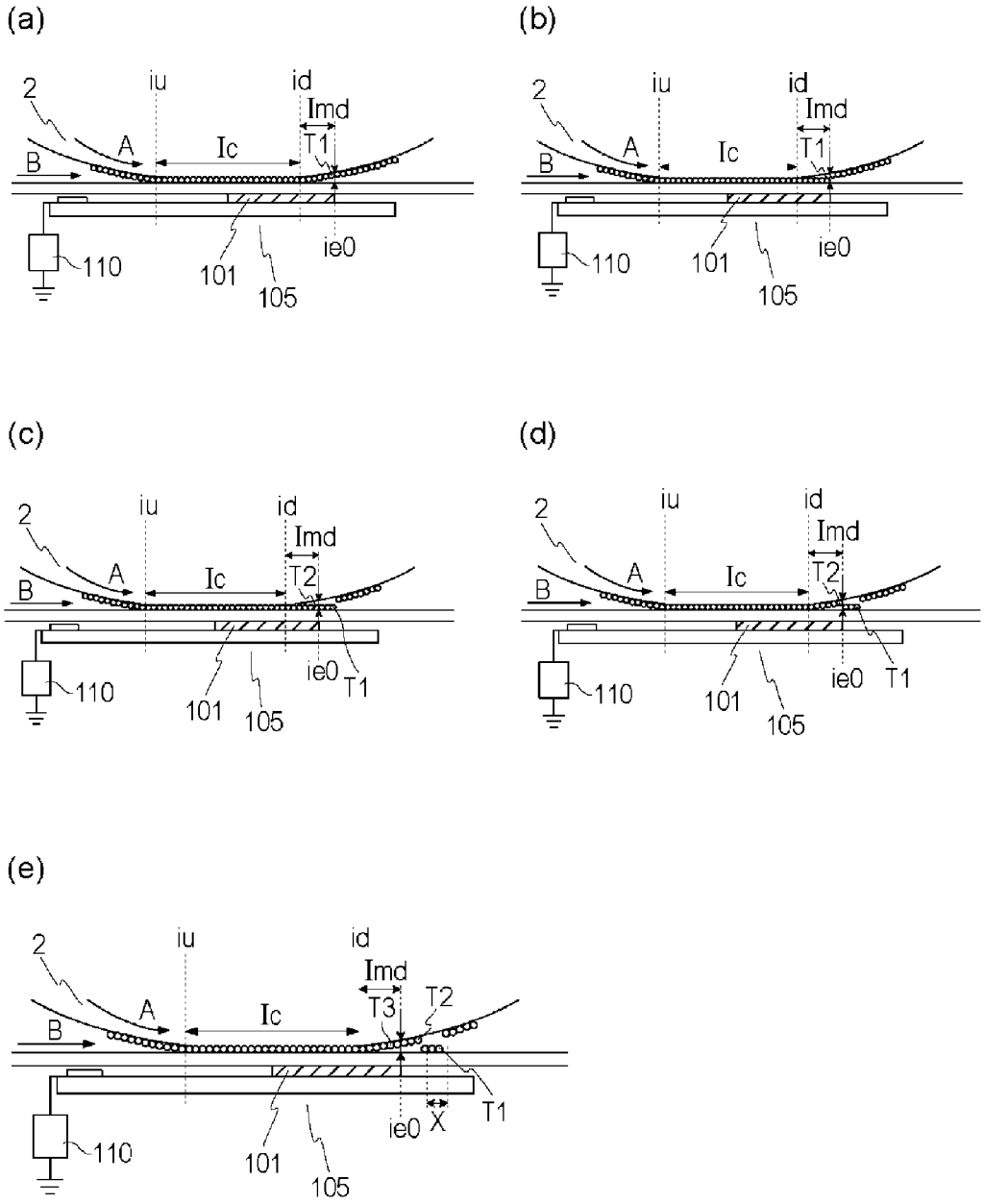

Parts (a) to (e) of FIG. 18 are schematic illustrations each showing the toner state between the toner carrying roller and the image carrying member in Embodiment 2.

Figure 19:
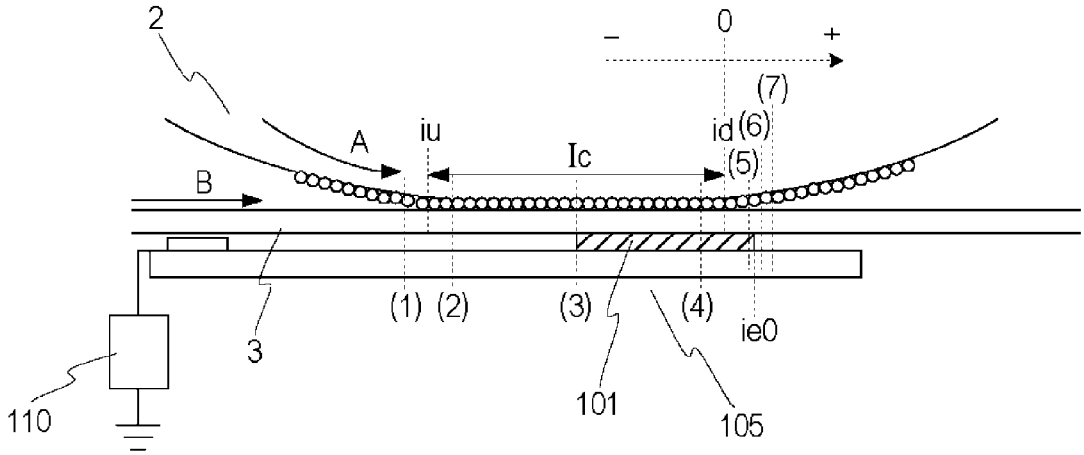

FIG. 19 is a schematic illustration showing image forming electrode positions in image comparison in Embodiment 2.

Figure 20:
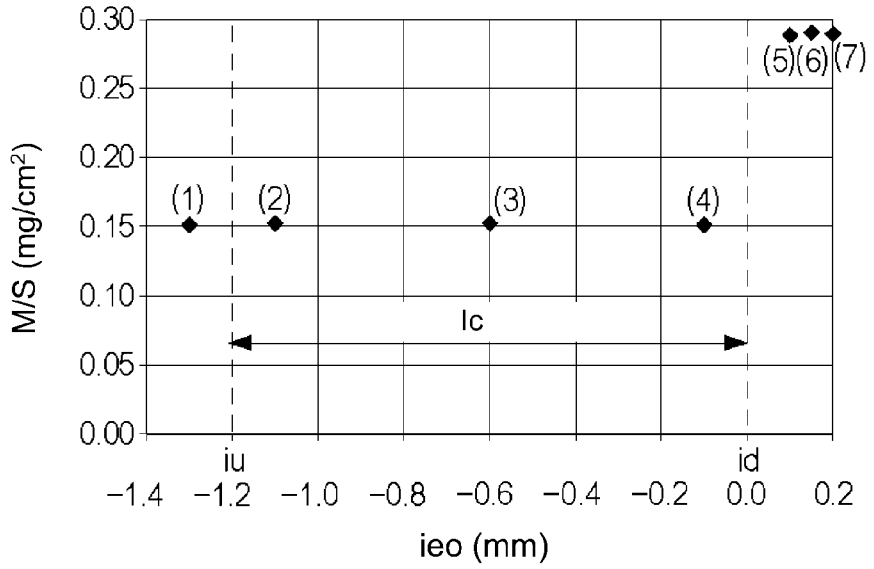
Figure 20:
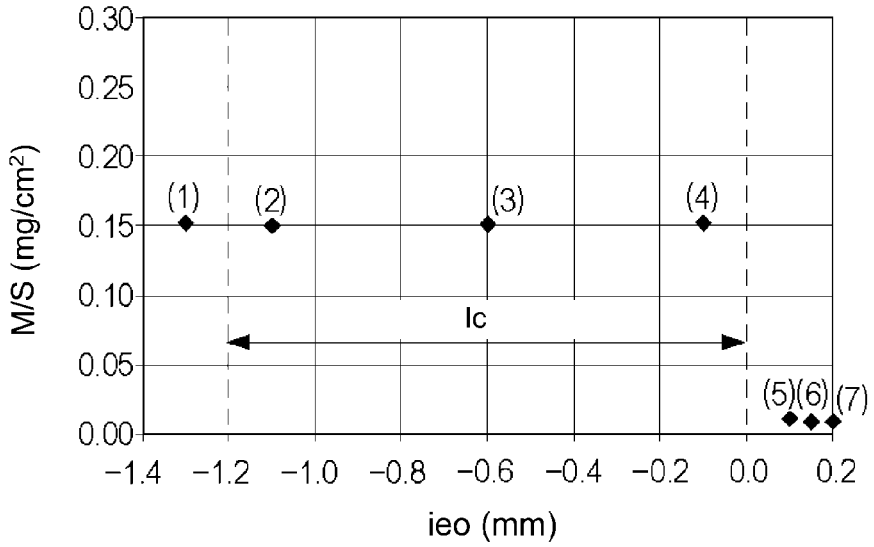

Parts (a) and (b) of FIG. 20 are graphs each showing a toner amount on the image carrying member in image comparison in Embodiment 2.

Figure 21:
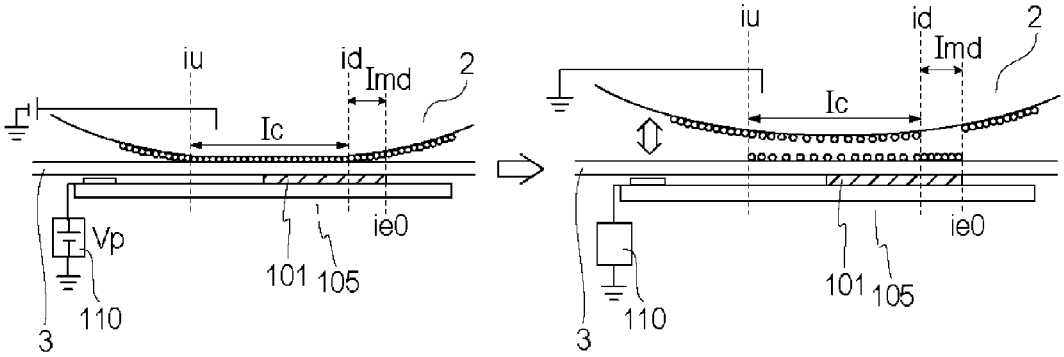
Figure 21:
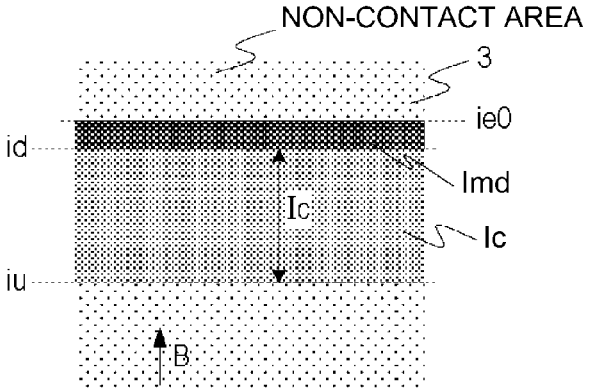
Figure 21:
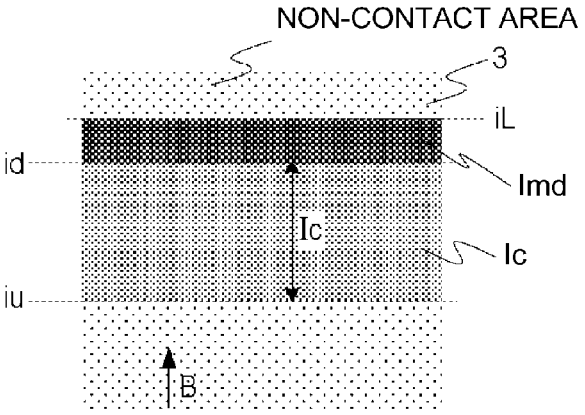

Parts (a) to (c) of FIG. 21 are schematic illustrations for illustrating a measuring method of a toner contact area and the image forming electrode position in Embodiment 2.

Figure 22:
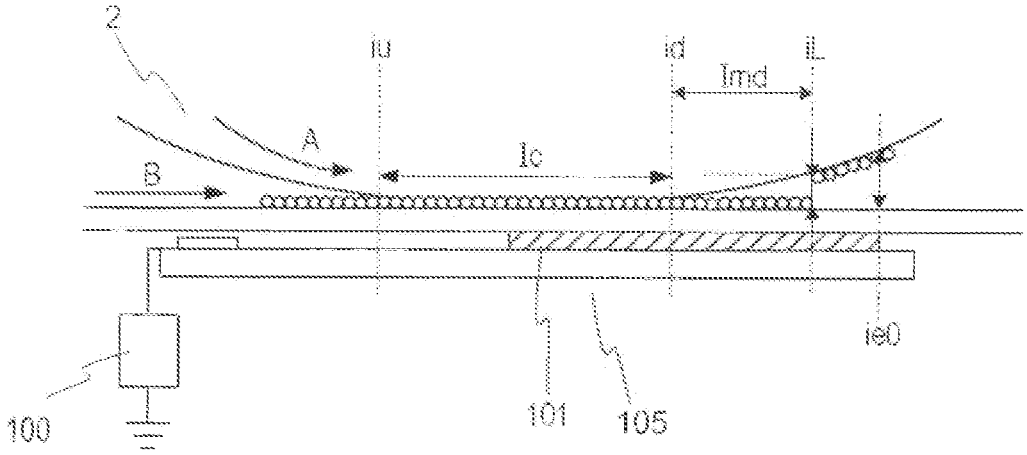

FIG. 22 is an enlarged schematic illustration of an image forming portion where an image forming electrode is disposed in Embodiment 3.

Figure 23:
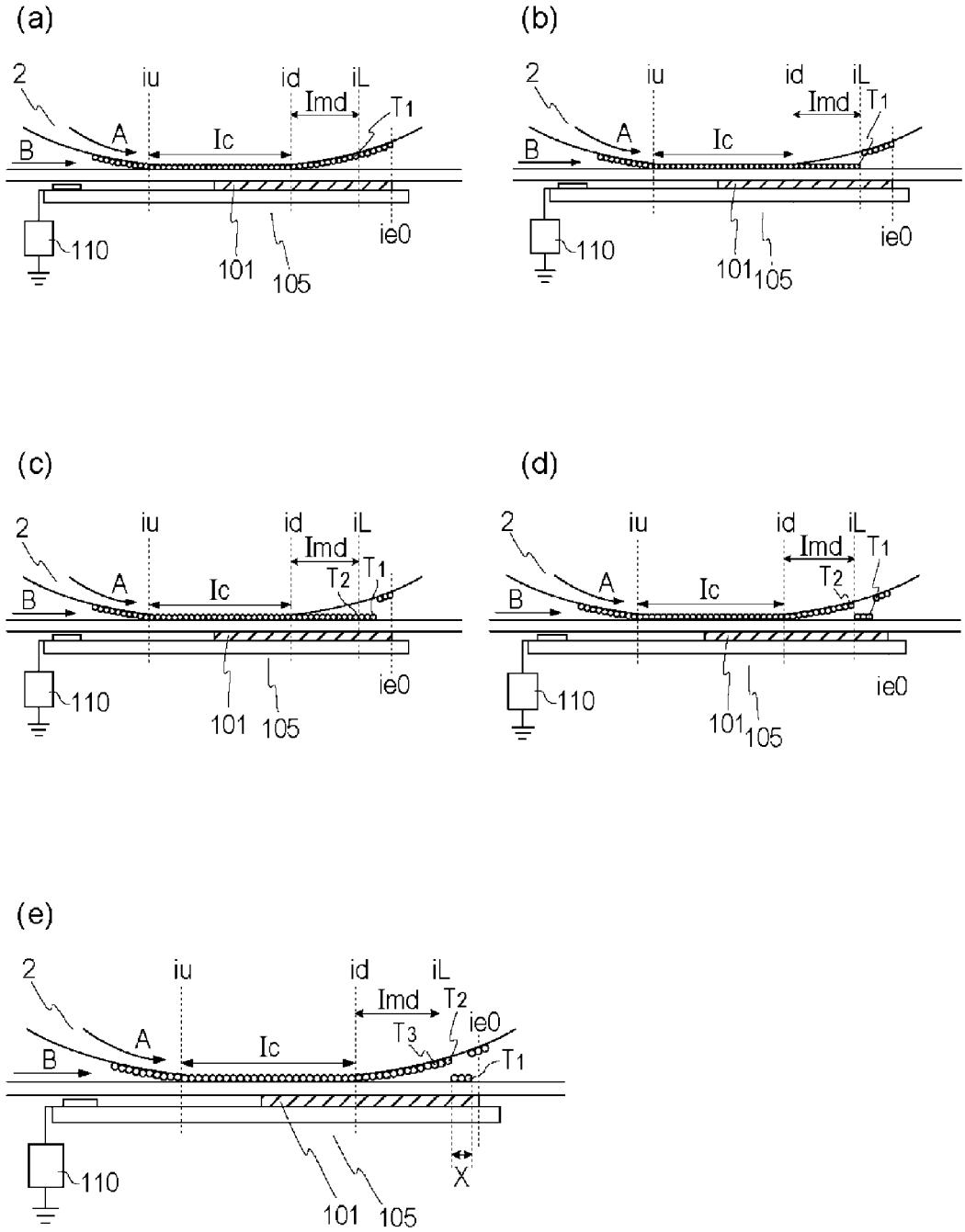

Parts (a) to (e) of FIG. 23 are schematic illustrations each showing a toner state between a toner carrying roller and an image carrying member in Embodiment 3.

Figure 24:
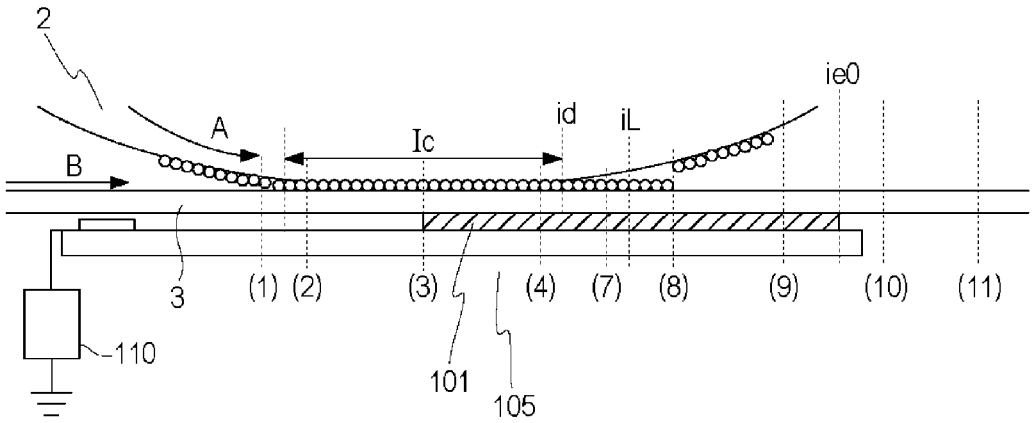

FIG. 24 is a schematic illustration showing image forming electrode positions in image comparison in Embodiment 3.

Figure 25:
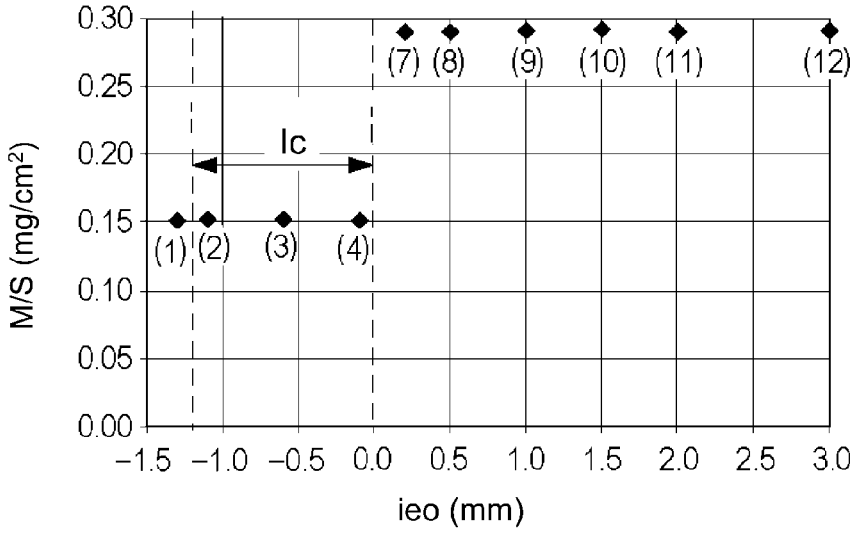
Figure 25:
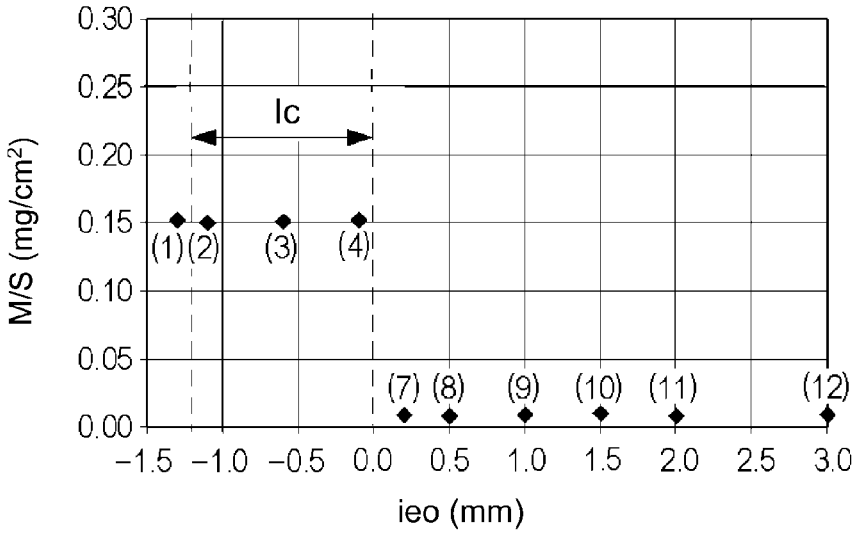

Parts (a) and (b) of FIG. 25 are graphs each showing a toner amount on the image carrying member in image comparison in Embodiment 3.

Figure 26:
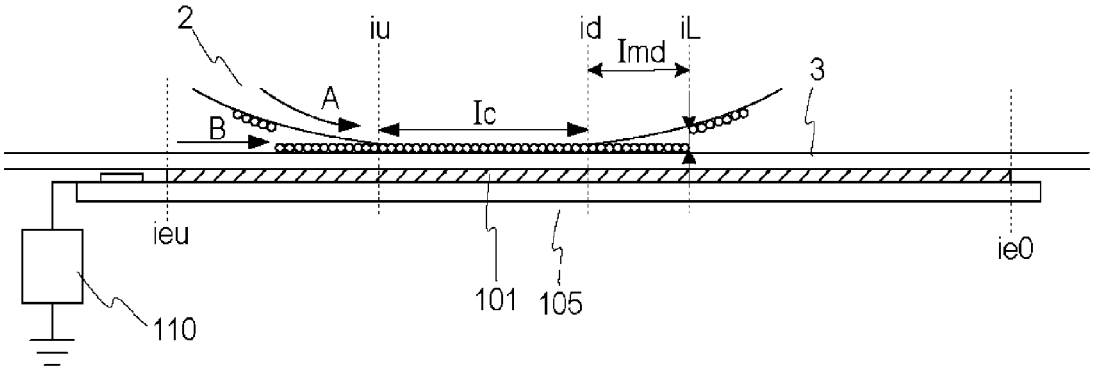

FIG. 26 is a schematic illustration of an image forming portion where an image forming electrode is disposed in Embodiment 4.

Figure 27:
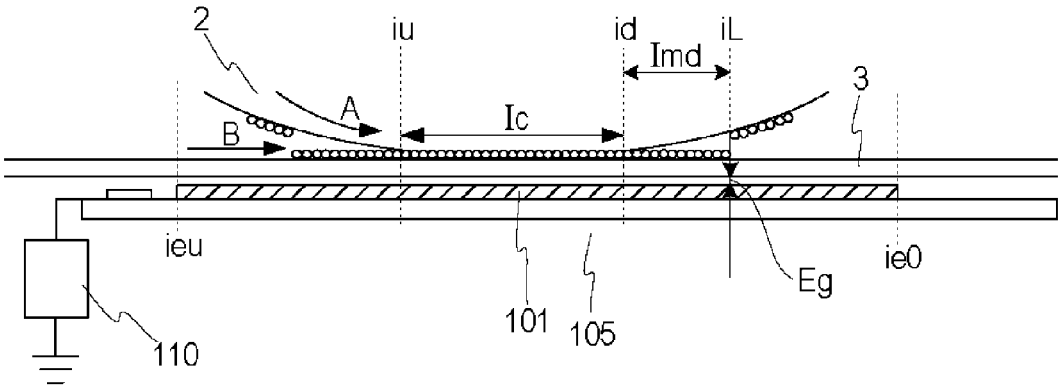

FIG. 27 is a schematic illustration of an image forming portion where an image forming electrode is disposed in Embodiment 5.

Figure 28:
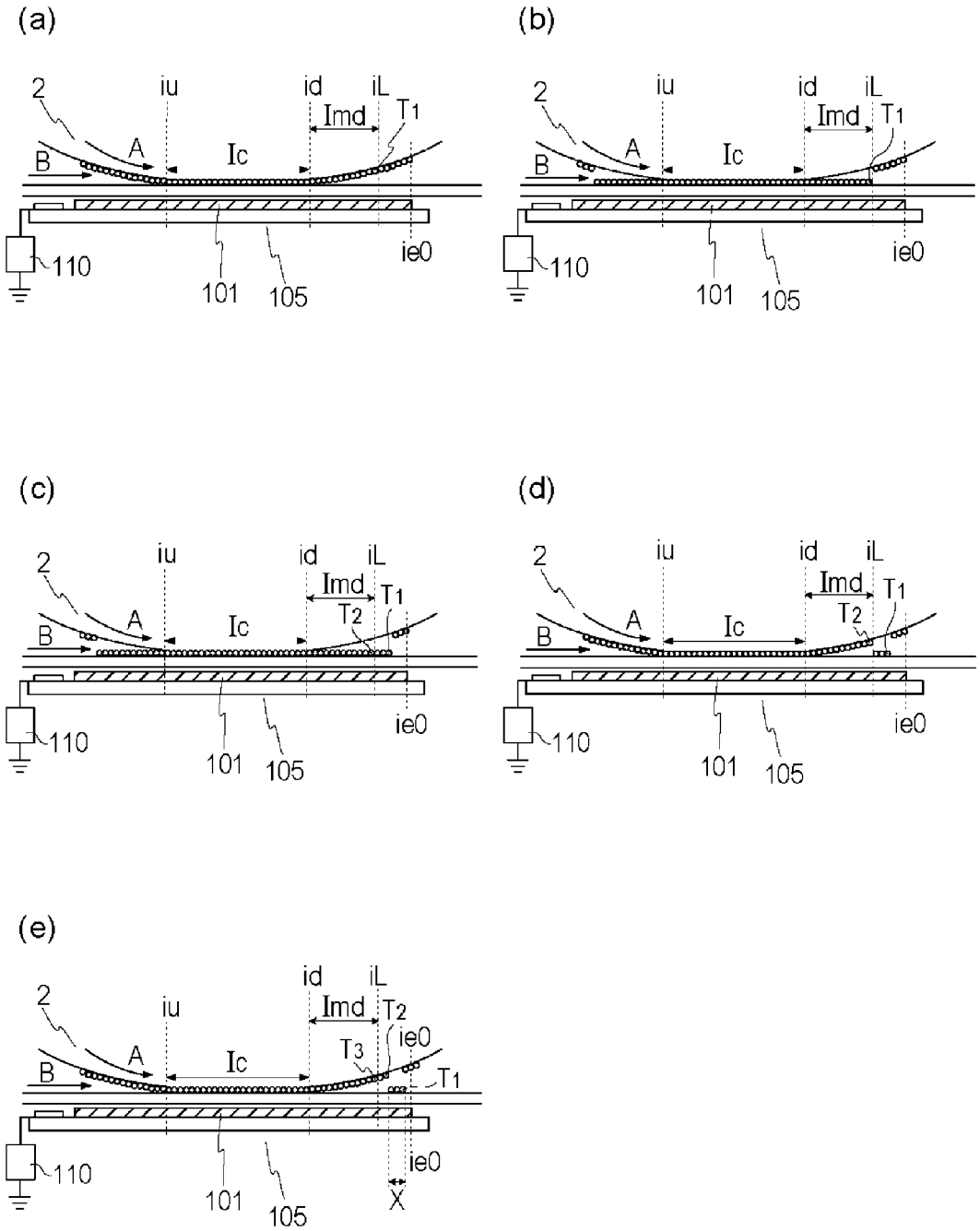

Parts (a) to (e) of FIG. 28 are schematic illustrations each showing a toner state between a toner carrying roller and an image carrying member in Embodiment 5.

Figure 29:
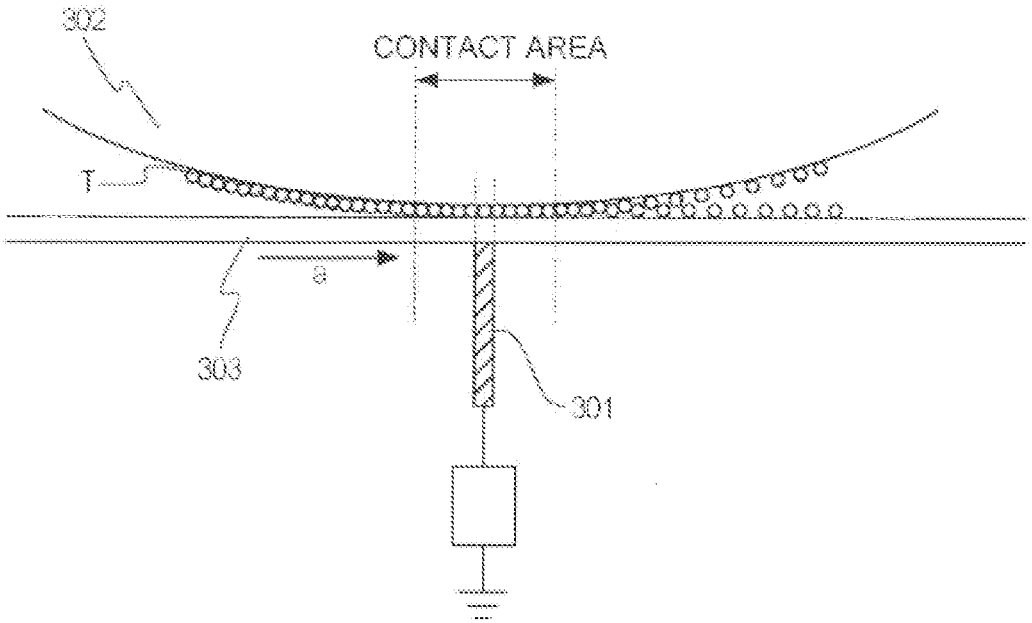
Fig. 29 (PRIOR ART)

FIG. 29 is a schematic illustration of a conventional image forming apparatus using needle-like electrodes.

Figure 30:
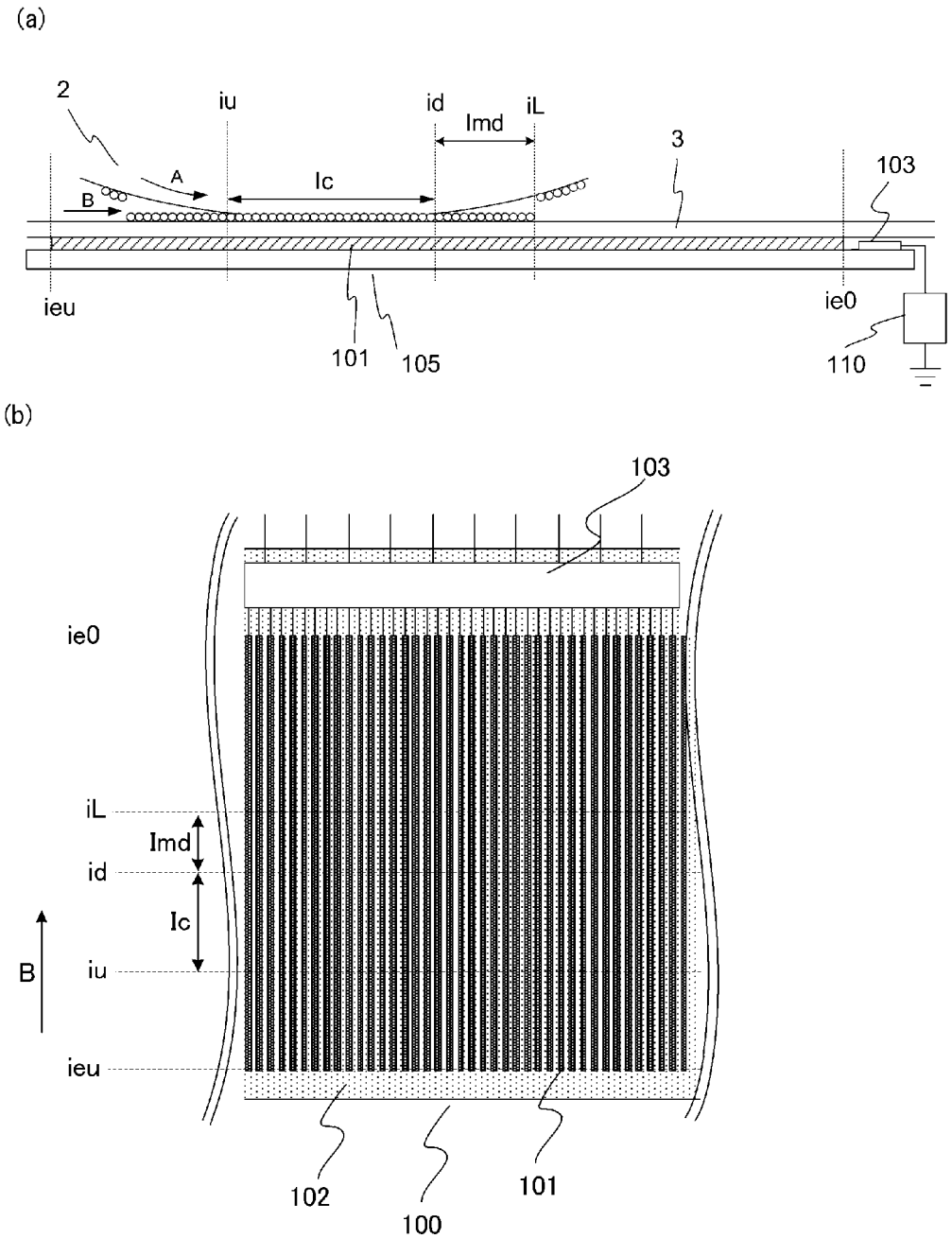

Parts (a) and (b) of FIG. 30 are enlarged schematic illustrations of an image forming portion where an image forming electrode is disposed in Embodiment 6.

Figure 31:
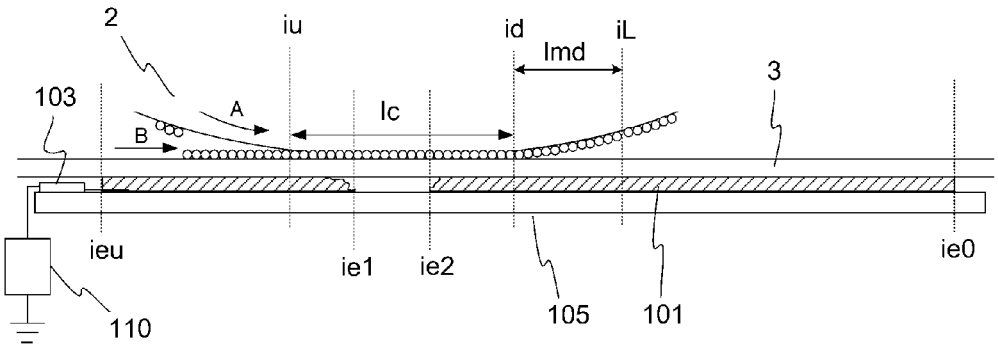
Figure 31:
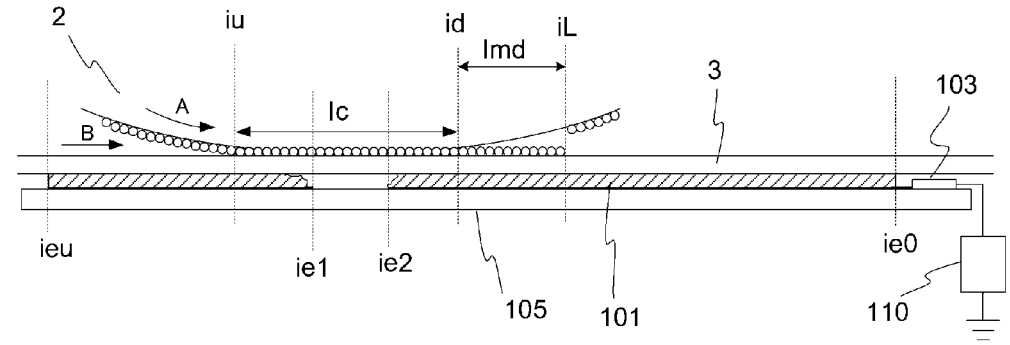

Parts (a) and (b) of FIG. 31 are enlarged schematic illustrations for illustrating the case where the image forming electrode is abraded and broken (disconnected) in a constitution different from that in Embodiment 6 and in the constitution in Embodiment 6, respectively.

Figure 32:
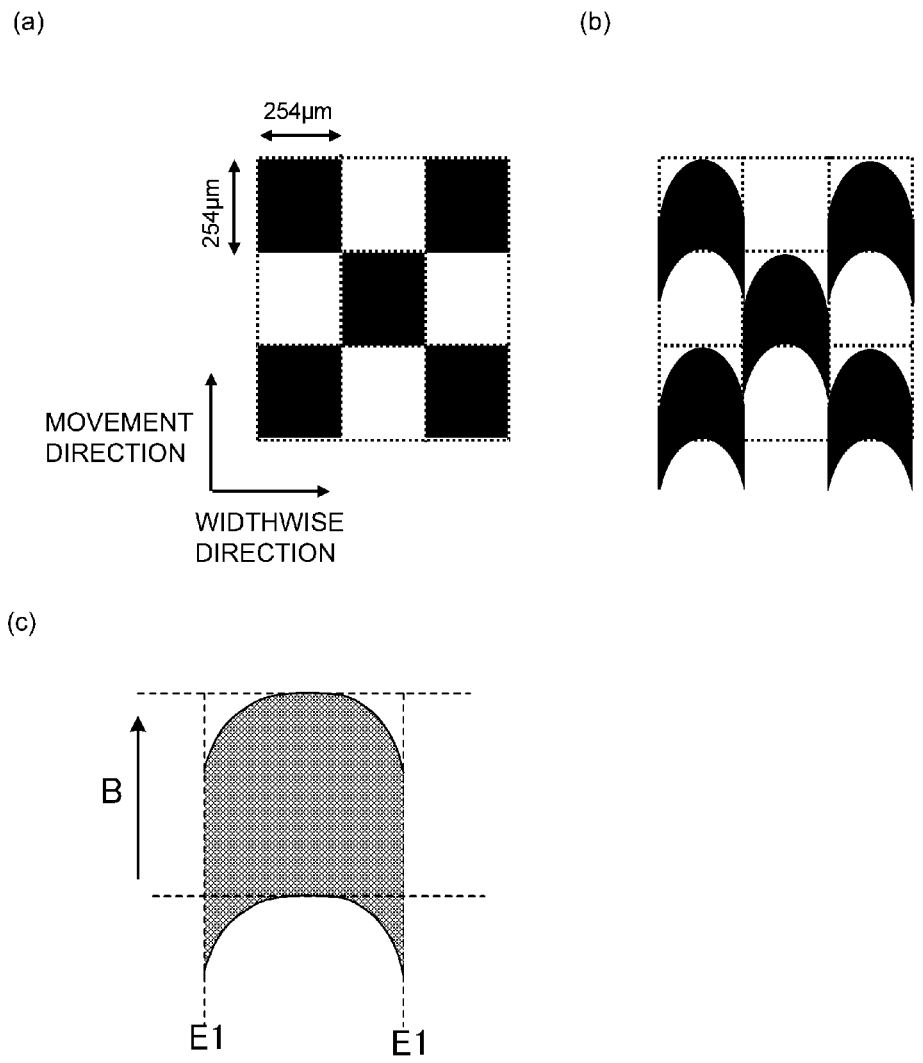

Parts (a) to (c) of FIG. 32 are schematic illustrations for illustrating a distortion image.

Figure 33:
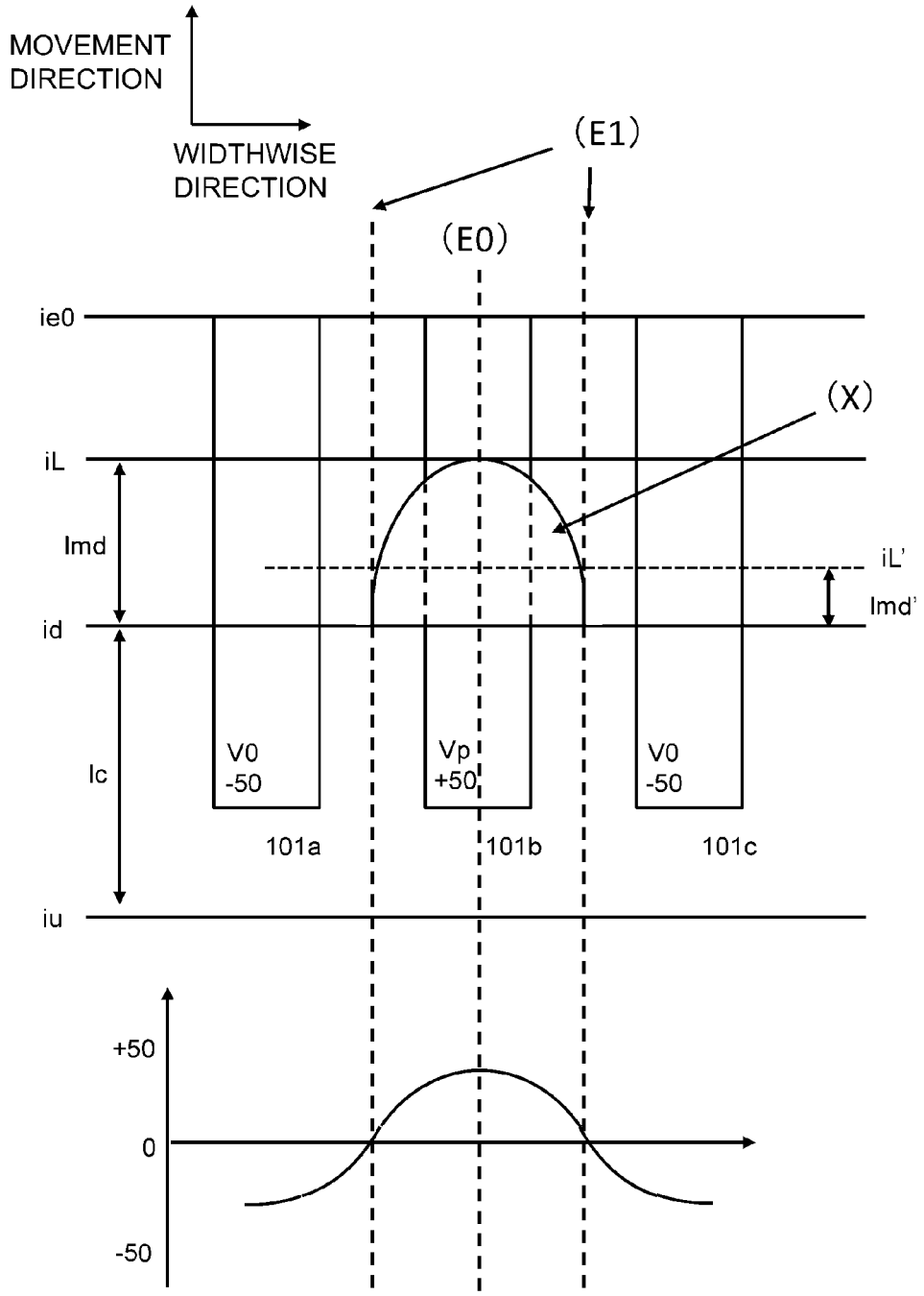
Figure 34:
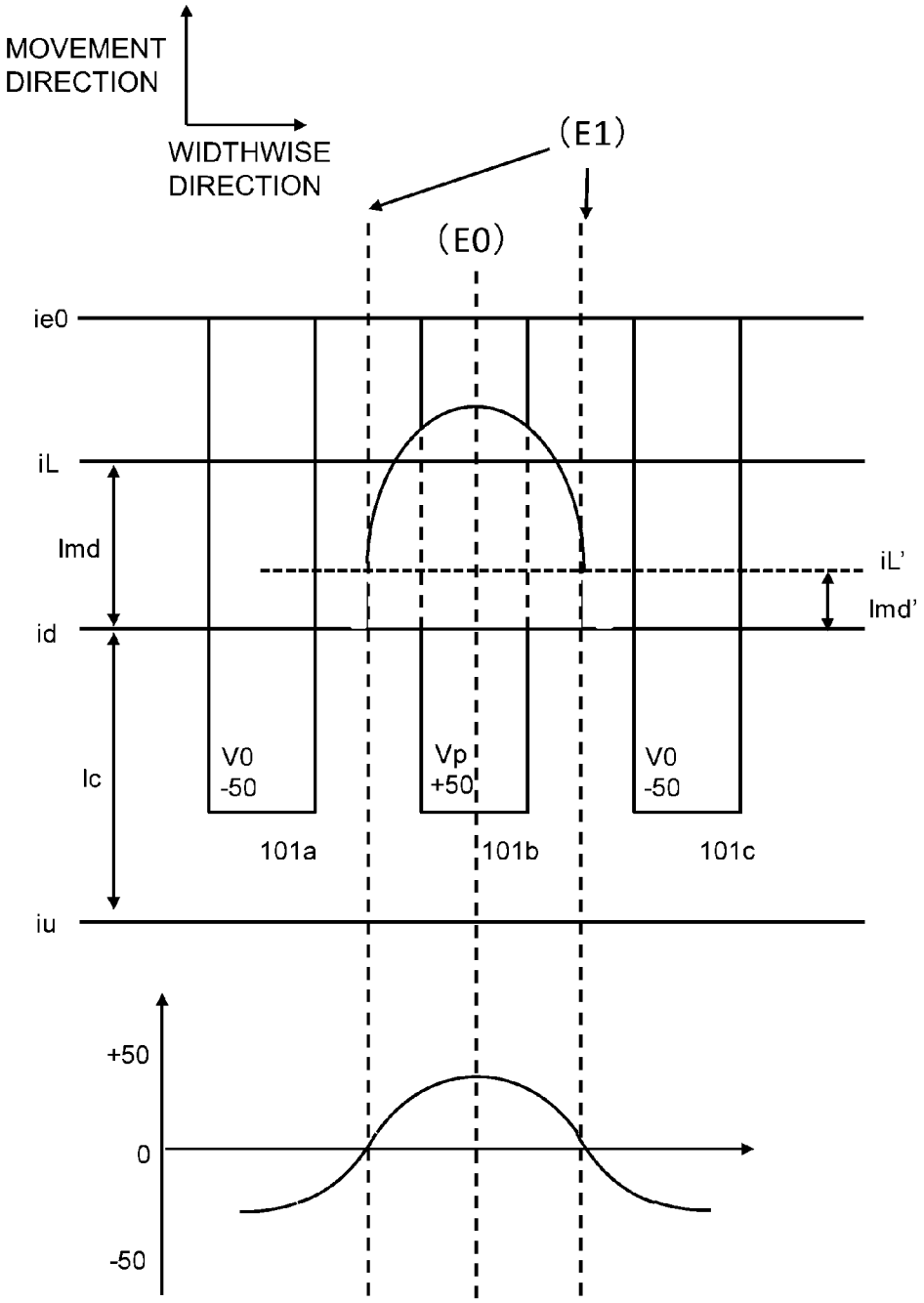
Figure 35:
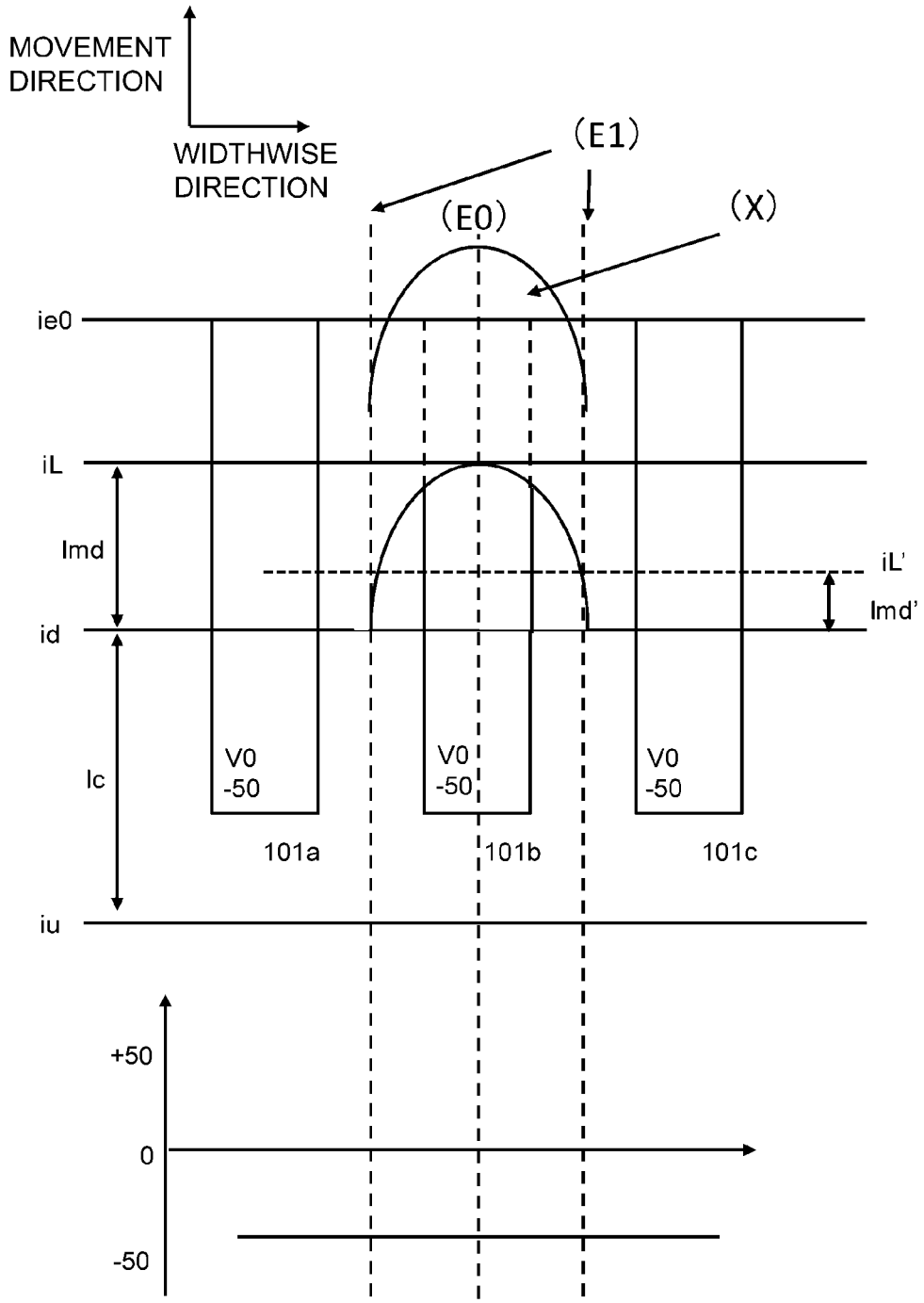

FIGS. 33, 34 and 35 are enlarged schematic illustrations each showing an image forming portion during an occurrence of the distortion image.

Figure 36:
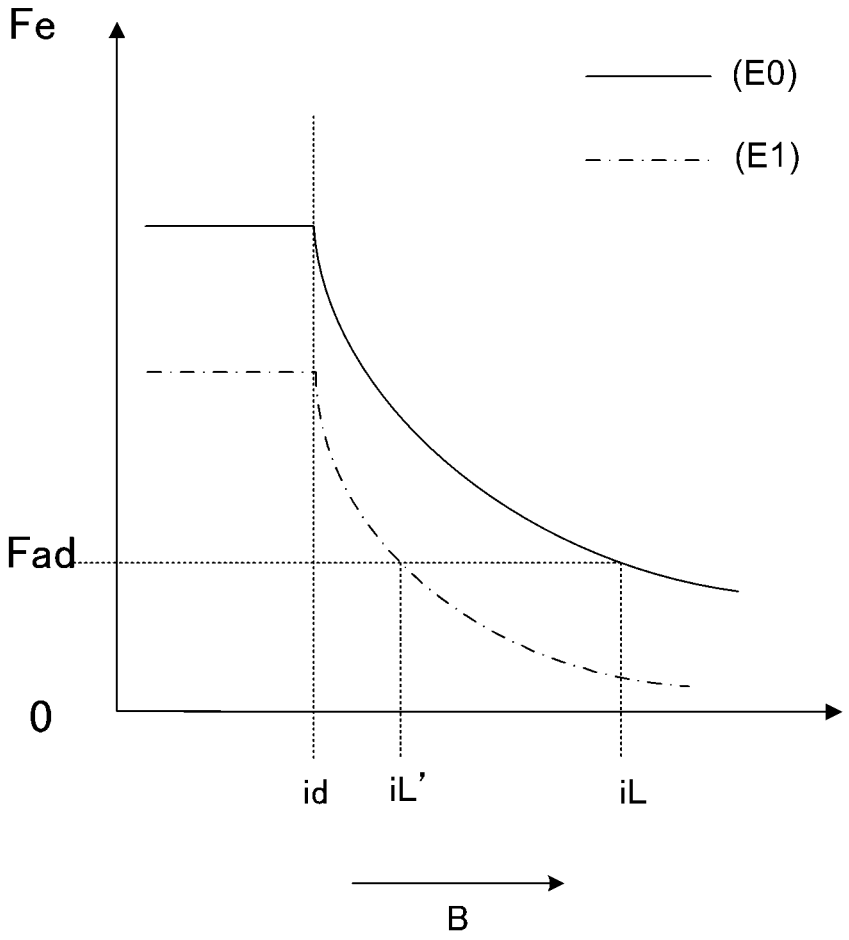

FIG. 36 is a graph showing a relationship between an image carrying member movement direction position and an electric field acting on the toner.

Figure 37:
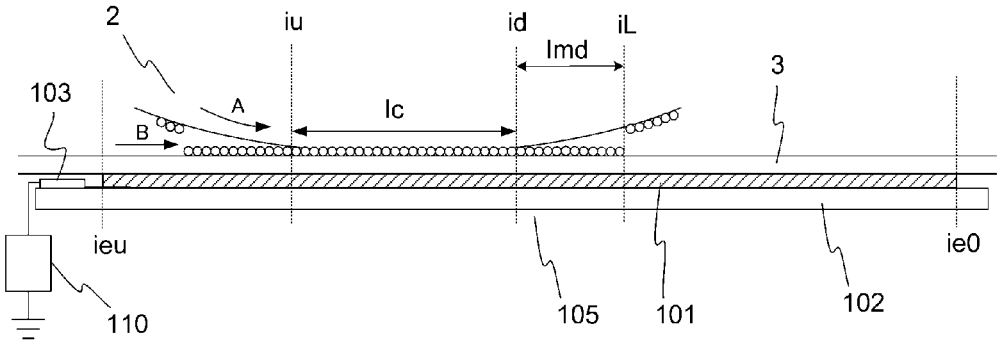
Figure 37:
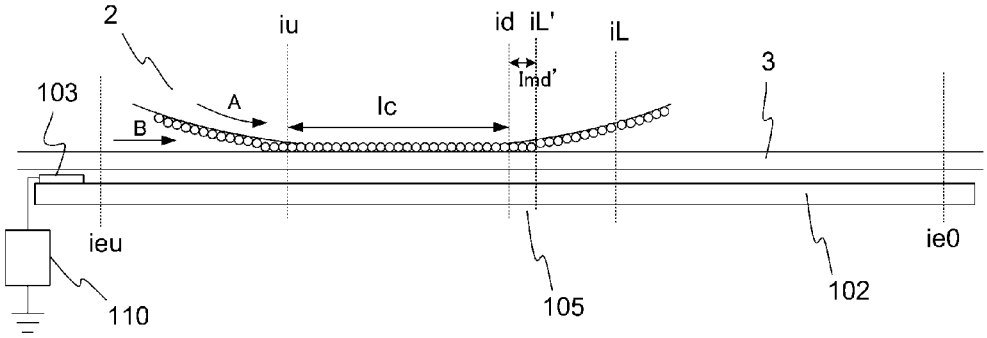
Figure 38:
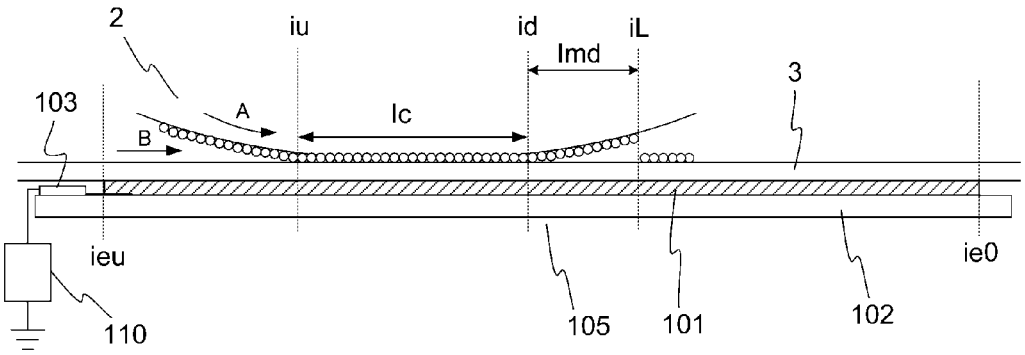
Figure 38:
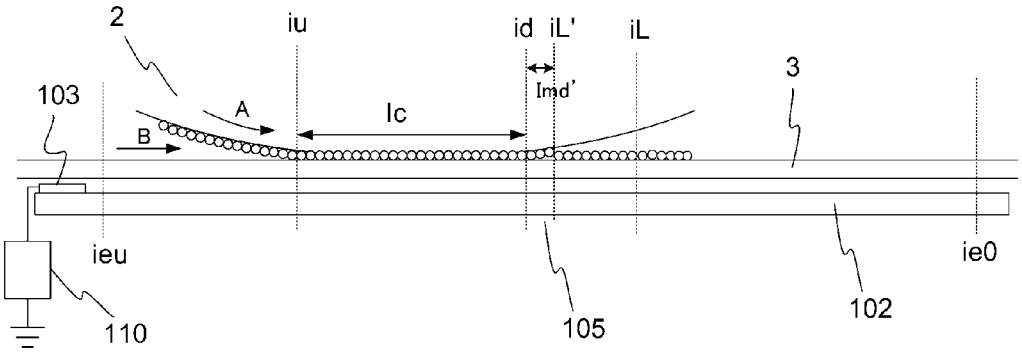

Parts (a) and (b) of FIG. 37 and (a) and (b) of FIG. 38 are enlarged schematic illustrations each showing the image forming portion where the image forming electrode is disposed in Embodiment 4.

Figure 39:
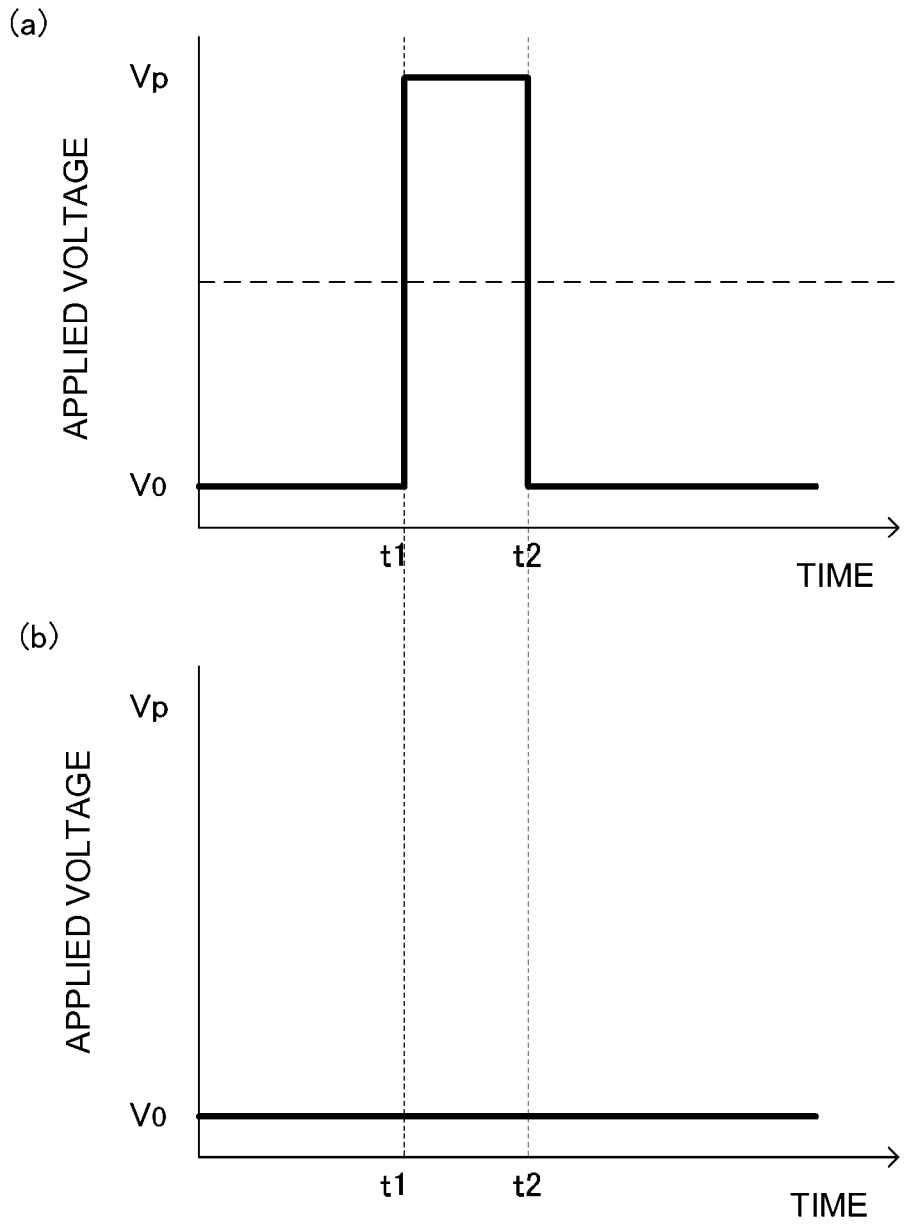

Parts (a) and (b) of FIG. 39 are graphs each showing a timing chart of a voltage applied to an image forming electrode in Embodiment 7.

Figure 40:
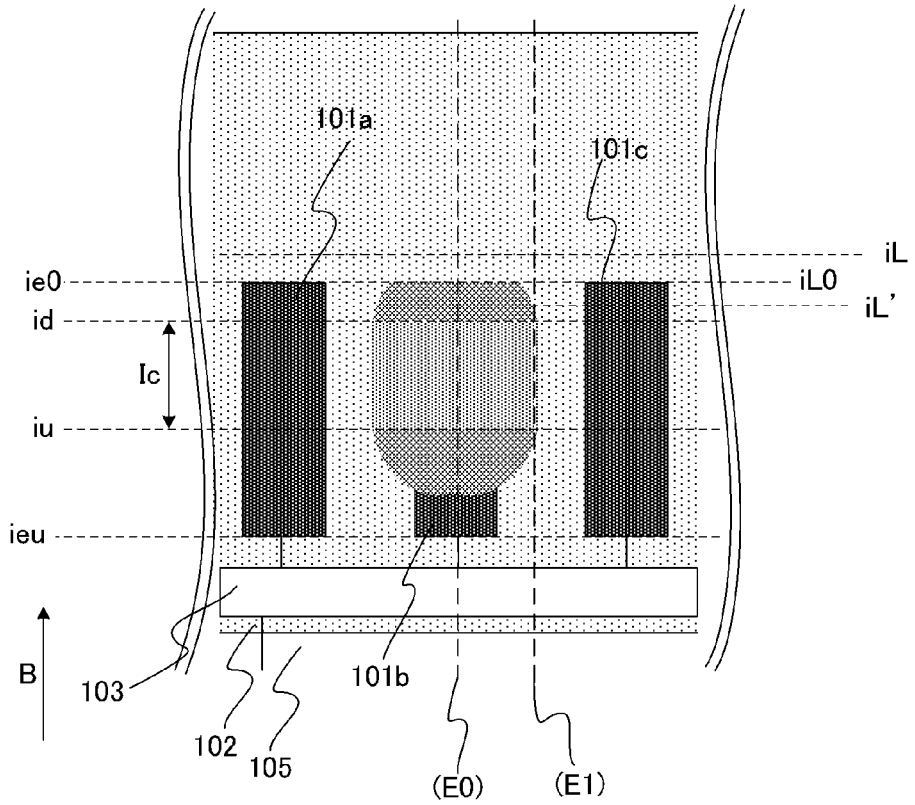
Figure 40:
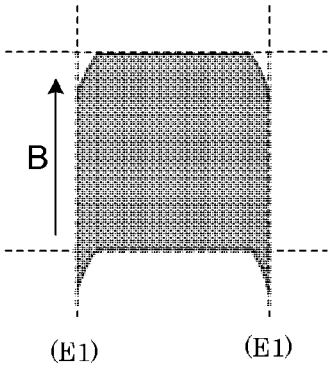

Parts (a) and (b) of FIG. 40 are enlarged schematic illustrations showing an image forming portion in Embodiment 7.

Figure 41:
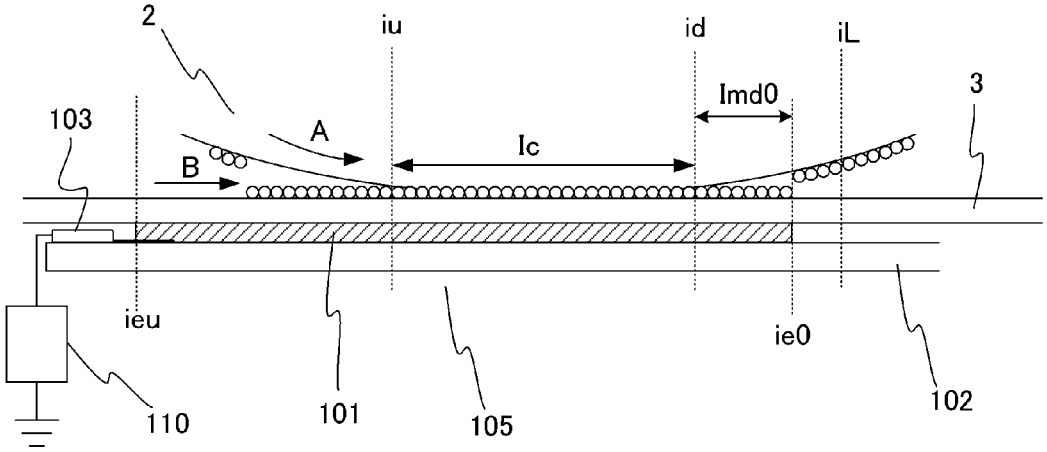
Figure 41:
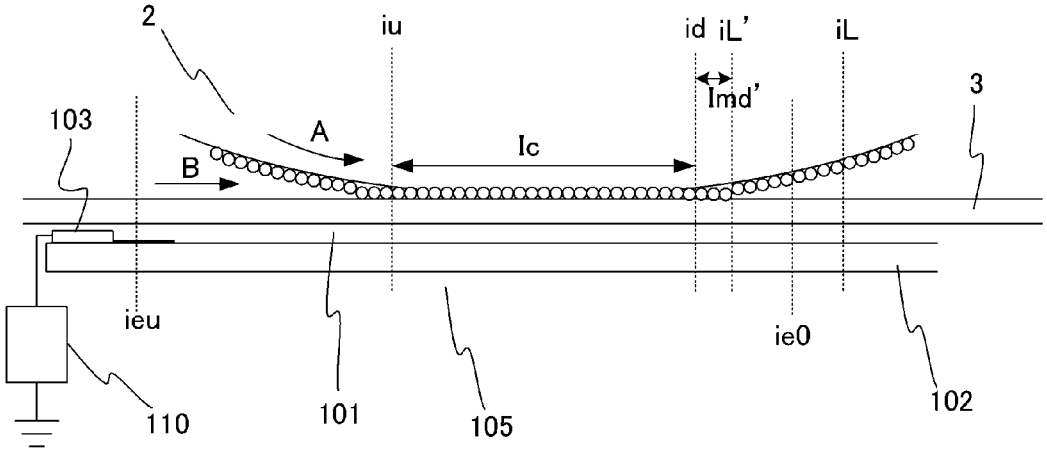
Figure 42:
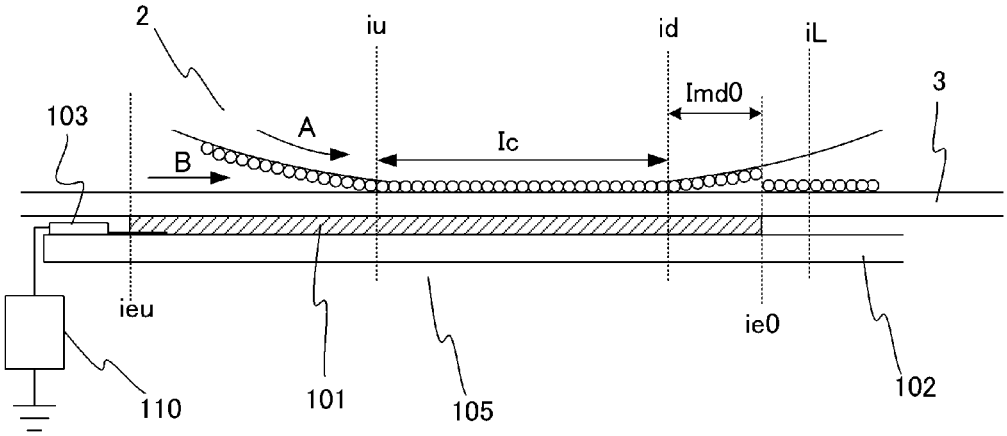
Figure 42:
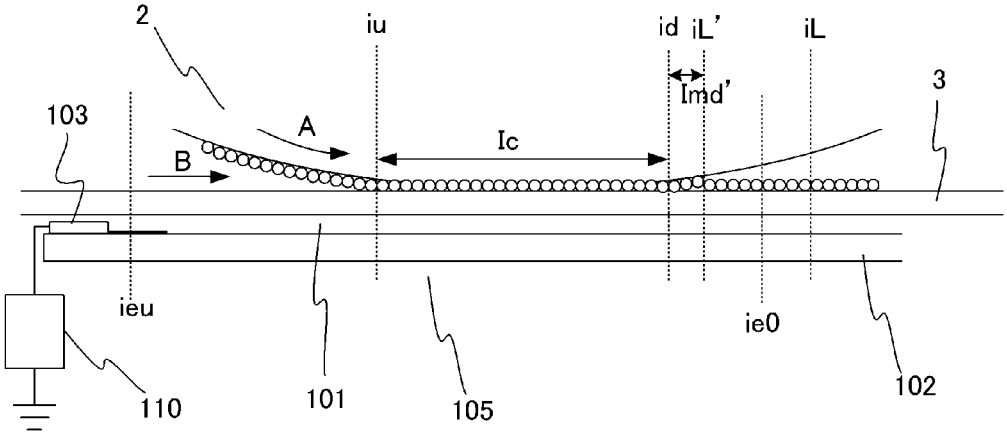

Parts (a) and (b) of FIG. 41 and (a) and (b) of FIG. 42 are enlarged schematic illustrations each showing an image forming portion where an image forming electrode is disposed in Embodiment 7.

Figure 43:
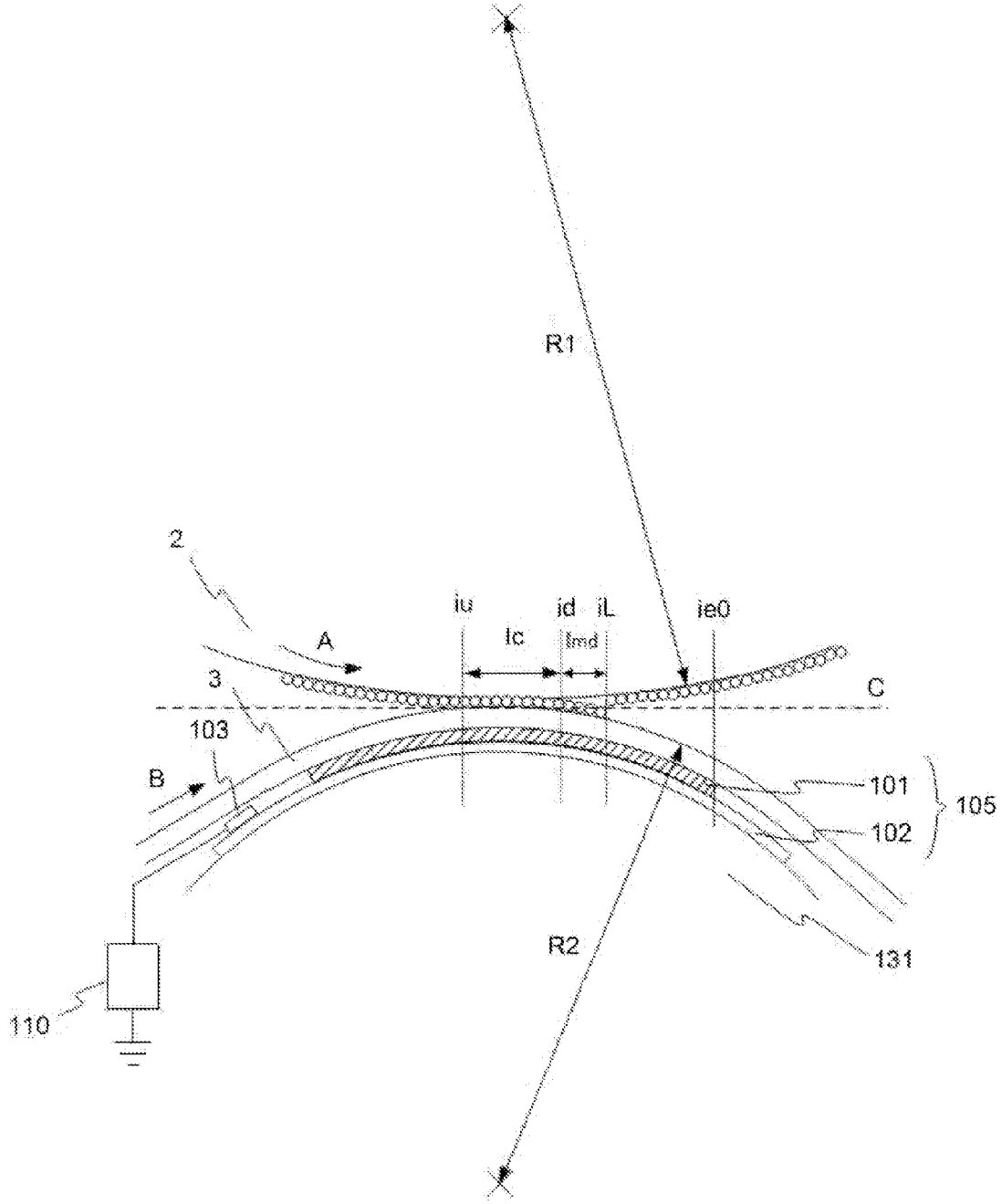

FIG. 43 is an enlarged schematic illustration showing an image forming portion where an image forming electrode is disposed in Embodiment 8.

Figure 44:
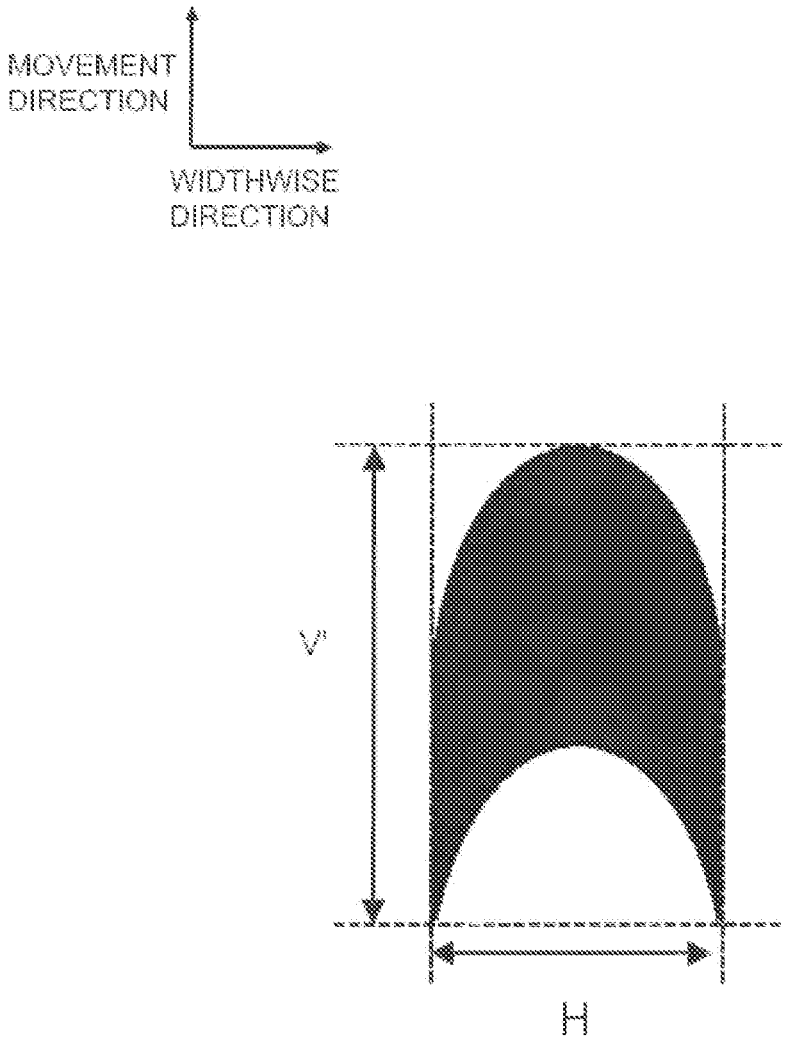

FIG. 44 is a schematic illustration for illustrate an aspect ratio of a distortion image.

Figure 45:
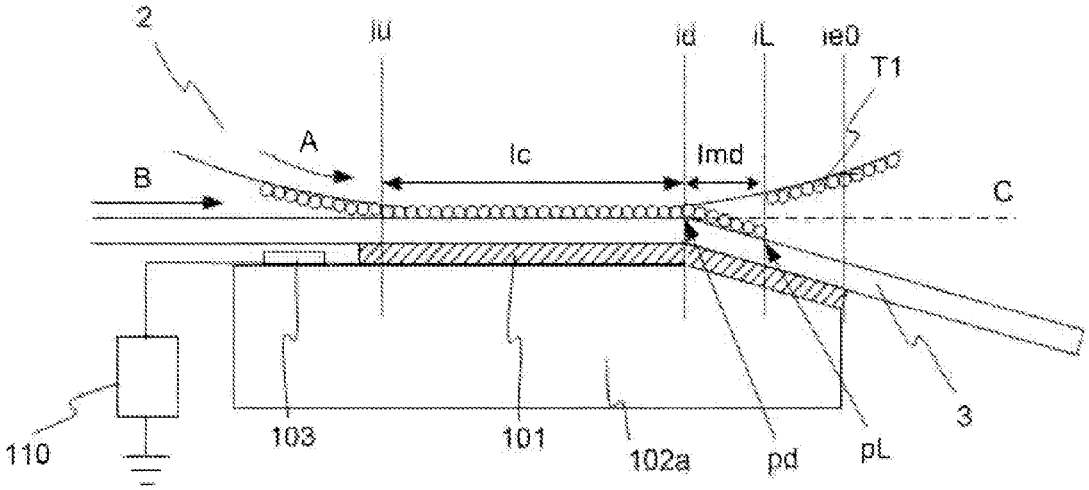

FIG. 45 is an enlarged schematic illustration showing the image forming portion where the image forming electrode is disposed in Embodiment 8.

BEST MODE FOR CARRYING OUT THE INVENTION

Embodiment 1

Embodiment 1 of the present invention will be described with reference to the drawings.

Figure 1:
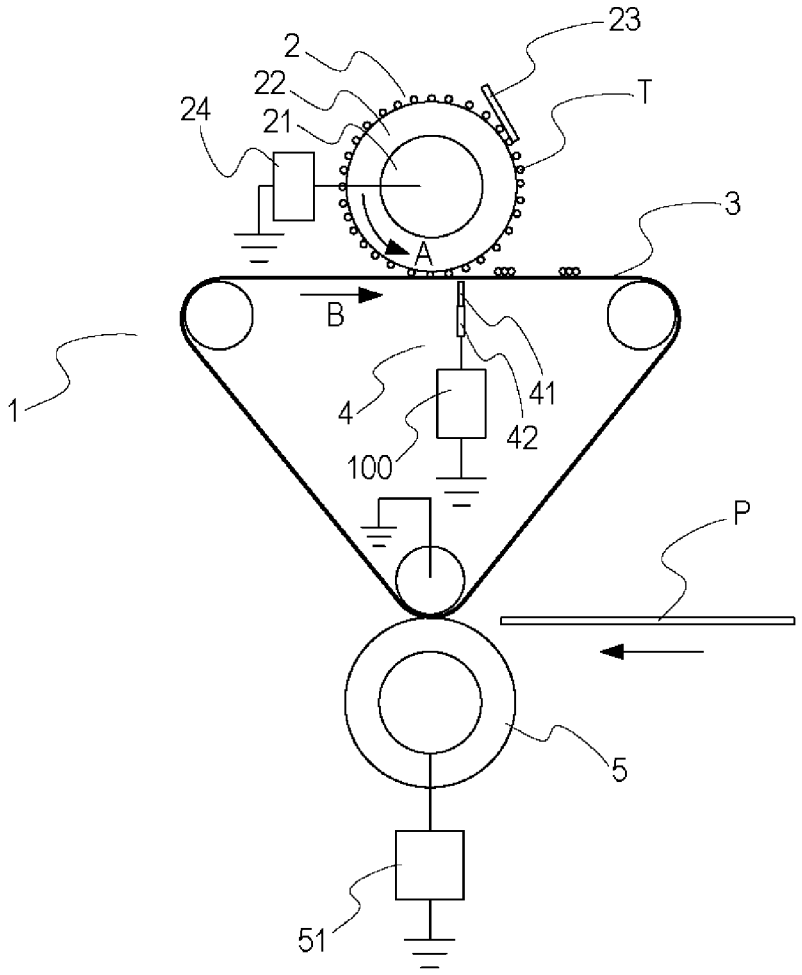
FIG. 1 is a schematic illustration of an image forming apparatus in Embodiment 1.

FIG. 1 is a schematic illustration of an image forming apparatus in this embodiment to which the present invention is applicable.

In FIG. 1, an image forming apparatus 1 includes a toner carrying roller (toner carrying member) 2 for carrying and conveying a toner at its outer peripheral surface, an image carrying member 3 on which an image of the toner T is to be formed, a needle-like electrode 4 which is an image forming electrode to which a voltage based on image information is applied to the image carrying member 3, and a transfer member 5 for transferring the toner image from the image carrying member 3 onto a recording material P such as paper.

The toner carrying roller 2 is rotationally driven in an arrow A direction, and carries the toner T on its outer peripheral surface and conveys the toner T to an image forming portion and also functions as an opposite electrode to the image forming electrode.

The toner T is supplied from an unshown toner container and is electrically charged to a predetermined charge amount by a blade 23 and is regulated in a predetermined thickness on the outer peripheral surface of the toner carrying roller 2.

The blade 23 is contacted to the toner carrying roller 2 by using spring elasticity of a thin metal plate constituting the blade 23. In this embodiment, a 0.1 mm-thick plate of SUS and phosphor bronze was used.

In this embodiment, the toner carrying roller 2 is 11.5 mm in outer diameter and is prepared by forming an electroconductive silicone rubber layer as an elastic layer 22 on a core metal of 6 mm in outer diameter as an electroconductive support 21. Further, on the surface of the electroconductive silicone rubber layer, a 10 μm-thick urethane resin layer is coated.

The toner T is a non-magnetic one component toner having an average particle size of 6 μm, a specific resistance of about $10^{16}$ Ω·cm and a negative charge polarity. Incidentally, the charge polarity of the toner on the toner carrying roller 2 is a normal charge polarity of the toner, in this embodiment, the negative charge polarity is the normal charge polarity.

Further, a toner carrying roller power source 24 is connected to the electroconductive support 21 of the toner carrying roller 2 and is constituted so as to apply a voltage to the toner carrying roller 2 for maintaining a potential of the toner carrying roller 2 or so as to ground the toner carrying roller 2.

The image carrying member 3 for forming the toner image by transferring the toner from the toner carrying roller 2 is an endless belt having an electroconductivity with a resistance adjusted in a predetermined range. The image carrying member 3 is rotationally moved in an arrow B direction at a predetermined process speed.

The image carrying member 3 is a single-layer polyimide film of 50 μm in thickness and $10^{8.5}$ Ω·cm in resistance value. Incidentally, a suitable resistance value of the image carrying member 3 is in the range of $10^{6}$-$10^{10}$ Ω·cm.

The needle-like electrode 4 which is the image forming electrode is provided in a plurality of needle-like electrode portions arranged along a direction (perpendicular to the drawing sheet) crossing a movement direction of the image carrying member 3. The needle-like electrode 4 includes electrode portions 41, which are needle-like electrodes, fixed and supported on a supporting member 42 at regular intervals.

Further, the electrode portions 41 are connected to an image forming electrode controller 100, and the image forming electrode controller 100 effects control so that a value of a voltage applied to the electrode portions 41 is changed on the basis of image information.

Each electrode portion 41 in this embodiment is phosphor bronze or tungsten electrode of 100 μm in wire diameter and having a hemisphere contact surface end and is provided at an interval of 200 μm on the supporting member 42 of an insulating resin material.

Image formation in this embodiment is effected by moving the toner T on the toner carrying roller 2 between the toner carrying roller 2 and the image carrying member 3 through the electric field of the voltage applied to the needle-like electrode 4.

The toner image on the image carrying member 3 is transferred with predetermined timing onto the recording material P such as paper by the transfer roller 5. The recording material P is conveyed to a transfer portion between the image carrying member 3 and the transfer roller 5. When the recording material P is located at the transfer portion, a transfer bias is applied to the transfer roller 5 by a transfer bias control means 51, so that the toner image is transferred from the image carrying member 3 onto a predetermined position of the recording material P.

Part (a) of FIG. 2 is an enlarged schematic illustration of the image forming portion where the needle-like electrode 4 is disposed in the image forming apparatus 1. In a toner movement area (toner movable area) Imd, the toner is moved between the toner carrying roller 2 and the image carrying member 3. In (a) of FIG. 2, in a toner contact area Ic, the toner T carried on the toner carrying roller 2 contacts the image carrying member 3. A toner contact upstream position is an upstreammost position iu of the toner contact area Ic with respect to an image carrying member movement direction B. A toner contact downstream position id is a downstreammost position of the toner contact area Ic with respect to the image carrying member movement direction B.

Part (b) of FIG. 2 is a schematic view to illustrate an image forming electrode contact area in which the electrode portions 41 contact the image carrying member 3. In the constitution of the image forming electrode in this embodiment, the needle-like electrode is used and therefore the image forming electrode contact area is a very narrow area. Therefore, a needle-like electrode position ie is a downstream position of an area in which the electrode portions 41 contact the image carrying member 3 with respect to the image carrying member movement direction B.

A spacing (gap) between the toner carrying roller 2 and the image carrying member 3 at the needle-like electrode position Ie is a toner carrying roller gap Ig.

In this embodiment, as shown in FIG. 2, the toner T on the toner carrying roller 2 contacts the image carrying member 3 to provide the toner contact area Ic.

Further, the needle-like electrode position Ie is located downstream of the toner contact downstream position Id of the toner contact area Ic with respect to the movement direction of the image carrying member 3.

Next, the voltage applied to the needle-like electrode 4 as the image forming electrode and the electric field between the toner carrying member 2 and the image carrying member 3 will be described.

In the constitution in this embodiment, when the voltage applied to the needle-like electrode 4 is increased, in the toner carrying member gap Ig at the needle-like electrode position Ie, an electric discharge phenomenon occurs.

As is well known, an electric discharge start voltage Vb in a gap Z in the electric discharge phenomenon can be approximate by the following equation (1) in a gap of 10 μm or more in the air in accordance with the Paschen's law as shown in (a) of FIG. 12.

$$Vb=312+6.2Z \quad (1)$$

(at page 291, "Electrophotography", R. M. Scheffert, Kyoritsu Shuppan Co., Ltd.)

In the constitution in the present invention, in the case where the electric discharge phenomenon occurs in the toner carrying member gap Ig, it is difficult to effect good image formation.

This reason will be described. The toner on the toner carrying roller 2 is negatively charged with a predetermined charge amount. However, when the electric discharge phenomenon occurs in the image carrying member gap Ig, the positive toner polarity-inverted from the negative toner is generated. The movement of the polarity-inverted positive toner cannot be controlled by the electric field of the needle-like electrode 4, so that it is difficult to form a good image.

For the reason described above, in the present invention, the image formation is effected by controlling the voltage applied to the needle-like electrode 4 so that a potential difference between the toner carrying roller 2 and the image carrying member 3 is not more than the electric discharge start voltage.

On the other hand, the electric field in the gap Z at the electric discharge start voltage is shown in (b) of FIG. 12. In the figure, a solid line represents the electric field at the electric discharge start voltage. Therefore, in an area above the solid line, the electric discharge phenomenon occurs and in an area below the solid line, the electric discharge phenomenon does not occur.

As shown in (b) of FIG. 12, a stronger electric field can act on the toner with a smaller gap in the area in which the electric discharge phenomenon does not occur.

From the above, in the constitution of the present invention in which the toner is moved by the electric field of the image forming electrode, with a narrower toner carrying member gap Ig at the needle-like electrode position Ie, it is possible to set a larger electric field acting on the toner without causing the electric discharge phenomenon.

On the other hand, in a constitution in which the toner carrying member gap Ig is large, it becomes difficult to set the large electric field acting on the toner without causing the electric discharge phenomenon. Thus, when the voltage which is not less than the electric discharge start voltage is applied for moving the toner, it becomes difficult to form the good image.

Therefore, in the present invention, in order to realize the narrow toner carrying member gap Ig, the constitution in which the toner contact area Ic is provided is employed. In the constitution in which the toner contact area Ic is provided, the toner carrying member gap Ig is gradually increased from the toner contact area Ic. For that reason, at the position ie of the needle-like electrode as the image forming electrode, the gap between the toner carrying member and the image carrying member can be constituted so as to be narrow, so that the strong electric field can be applied to the toner.

Further, in the above-described constitution in which the gap between the toner carrying member and the image carrying member is narrow, compared with the constitution in which the gap between the toner carrying member and the image carrying member is broad, it is possible to form the electric field for moving the toner at a low applied voltage.

Next, an image forming process with respect to the direction (widthwise direction of the image forming apparatus) crossing the image carrying member movement direction will be described.

Parts (a) and (b) of FIG. 3 are enlarged schematic model views each showing a toner state between the toner carrying roller 2 and the image carrying member 3 at the needle-like electrode position ie and each partly showing a plane perpendicular to the image carrying member movement direction B.

Part (a) of FIG. 3 shows the state of the toner between the toner carrying roller 2 and the image carrying member 3. Part (b) of FIG. 3 shows the electric field at the toner carrying member surface of the toner carrying roller 2 and the image carrying member 3.

In (a) and (b) of FIG. 3, in the widthwise direction of the image forming apparatus 1 (in the direction perpendicular to the drawing sheet surface in FIG. 1), the plurality of electrode portions 41 of the needle-like electrode 4 are arranged depending on a resolution of the image forming apparatus 1. Each of the electrode portions 41 is disposed in contact with the image carrying member 3.

The toner T (Ta to Te) is negatively charged. In this embodiment, as an example, a model in which the toner is formed in a single layer on the toner carrying roller 2 is described. The toners at the contact positions of electrode portions 41*a* to 41*e* are Ta to Te, respectively.

Next, the voltage applied to the electrode portions 41 will be described. To each of the electrode portions 41*a* to 41*e*, a voltage depending on the image information is applied from the image forming electrode controller 100. Further, the toner carrying roller 2 is kept at 0 V by a toner carrying roller power source 24.

An image forming voltage Vp is selectively applied to the electrode portions 41 in an image forming area, and a non-image forming voltage V0 is selectively applied to the electrode portions 41 in a non-image forming area.

The image forming voltage Vp is a voltage of an opposite polarity (positive in this embodiment) to the toner charge polarity with respect to the potential of the toner carrying roller 2. That is, a value obtained by subtracting the voltage applied to the toner carrying roller 2 from the image forming voltage Vp has the polarity opposite to the normal charge polarity of the developer.

On the other hand, the non-image forming voltage is a voltage of identical polarity (negative in this embodiment) to the toner charge polarity with respect to the potential of the toner carrying roller 2. That is, a value obtained by subtracting the voltage applied to the toner carrying roller 2 from the image forming voltage Vp has the same polarity as the normal charge polarity of the developer.

In (a) and (b) of FIG. 3, the toner state when the voltage of the positive polarity is applied to the electrode portions 41*b* and 41*d* and a voltage of the negative polarity is applied to the electrode portions 41*a*, 41*c* and 41*e*, and the toner carrying member surface electric field between the toner carrying roller 2 and the image carrying member 3 are shown.

In (b) of FIG. 3, a direction of each arrow represents a direction of the electric field, and a length of each arrow represents intensity of the electric field. A longer arrow length represents a larger electric field. The arrow direction represents that the electric field is directed from a positive-polarity potential to a negative-polarity potential. Therefore, the negatively charged toner receives an electrostatic force such that the toner is moved in the opposite direction to the electric field direction.

As shown in (b) of FIG. 3, the toners located at positions of the electrode portions 41*b* and 41*d* to which the image forming voltage Vp is applied receive the electrostatic force with respect to the image carrying member direction by the electric field directed in the toner carrying member 2 direction, thus being moved.

The toners located at positions of the electrode portions 41*a*, 41*c* and 41*e* to which the non-image forming voltage V0 is applied receive the electrostatic force with respect to the toner carrying member 2 direction by the electric field directed in the image carrying member 3 direction, thus being moved.

By the above-described electric fields by the electrode portions 41, the toners are moved as shown in (a) of FIG. 3.

Further, the toner located between the electrode portion 41*b* to which the image forming voltage Vp is applied and the electrode portion 41*a* to which the non-image forming voltage V0 is applied is selectively placed, depending on the direction and intensity of the electric field formed by the associated electrode, in a carried state by the toner carrying roller 2 or in a carried state by the image carrying member 3. This is true for the toners located between adjacent two other electrode portions.

As described above, with respect to the direction perpendicular to the image carrying member movement direction B, it is possible to effect the image formation.

In the present invention, the toner image formation is effected by setting the toner carrying roller potential at 0 V and by applying the voltages, of the polarities identical and opposite to the toner charge polarity, to the image forming electrode but the present invention is not limited thereto.

In the case of the constitution in which the voltage is applied to the toner carrying roller 2, with respect to the potential of the toner carrying roller 2, it is possible to form the image by selectively applying the positive and negative potentials to the electrode portions 41.

Next, with respect to the image carrying member movement direction, the image forming process will be described with reference to FIGS. 4 and 5. Parts (a) to (c) of FIG. 4 and (a) to (d) of FIG. 5 are schematic model views each showing a force acting on the toner at the image forming portion.

Part (a) of FIG. 4 is the model view in the toner contact area Ic, and (b) and (c) of FIG. 4 are the model views immediately after separation between the toner carrying roller 2 and the image carrying member 3 (immediately after the contact area downstream position id). Parts (a) to (d) of FIG. 5 are model views at the needle-like electrode position ie.

A non-electrostatic deposition force between the toner T and the toner carrying roller 2 is a toner carrying roller deposition force Fad, and a non-electrostatic deposition force between the toner T and the image carrying member 3 is an image carrying member deposition force Fai. The electrostatic force of the electric field between the image carrying member 3 and the toner carrying roller 2 is an electrostatic force Fe. The electric field between the image carrying member 3 and the toner carrying roller 2 is formed by the voltage applied to the image carrying member 3 and the toner carrying roller 2.

The force acting on the toner at each of the positions will be described.

<Toner in Toner Contact Area Ic>

As shown in (a) of FIG. 4, in the toner contact area Ic, the toner T is in a state in which the toner T contacts both of the toner carrying roller 2 and the image carrying member 3.

The toner carrying roller deposition force Fad is generated between the toner T and the toner carrying roller 2, and the image carrying member deposition force Fai is generated between the toner T and the image carrying member 3.

On the other hand, the toner is apart from the electrode portions 41 and therefore the electric field by the electrode portions 41 is weak, so that the electrostatic force Fe is sufficiently smaller than the toner carrying roller deposition force Fad and the image carrying member deposition force Fai. Accordingly, the following formula (2) is satisfied.

$$Fad >> Fe \text{ and } Fai >> Fe \quad (2)$$

Therefore, as shown in (a) of FIG. 4, the electrostatic force Fe does not substantially act on the toner T, so that the toner T is in a state in which the toner carrying roller deposition force Fad and the image carrying member deposition force Fai act on the toner T.

Then, the toner T passes through the toner contact area Ic with the movement of the image carrying member 3 and is placed in states of (b) and (c) of FIG. 4.

<Toner Immediately after Separation Between Toner Carrying Roller 2 and Image Carrying Member 3>

At the toner contact area downstream position id, immediately after separation between the toner carrying roller 2 and the image carrying member 3, there are both of the toner state in which the toner T is carried on the toner carrying roller 2 as shown in (b) of FIG. 4 and the toner state in which the toner T is carried on the image carrying member 3 as shown in (c) of FIG. 4.

When the toner carrying roller deposition force Fad is larger than the image carrying member deposition force Fai so as to satisfy a formula (3) below, the toner T is in the state in which the toner T is carried on the toner carrying roller 2 as shown in (b) of FIG. 4.

$$Fad > Fai \quad (3)$$

When the image carrying member deposition force Fai is larger than the toner carrying roller deposition force Fad so as to satisfy a formula (4) below, the toner T is in the state in which the toner T is carried on the image carrying member 3 as shown in (c) of FIG. 4.

$$Fai > Fad \quad (4)$$

The toner carrying state is determined by a magnitude correlation between the toner carrying roller deposition force Fad and the image carrying member deposition force Fai. Here, each of values of the toner carrying roller deposition force Fad and the image carrying member deposition force Fai vary depending on the positions of the toner carrying roller 2 and the image carrying member 3. At some positions, the formula (3) is satisfied and at other portions, the formula (4) is satisfied. For this reason, in this embodiment, as shown in (b) and (c) of FIG. 4, there are both of the toner carried on the toner carrying roller 2 and the toner carried on the image carrying member 3.

Further, similarly as in the case of the toner contact area Ic, when the toner carrying roller 2 and the image carrying member 3 are separated, the toners are spaced apart from the electrode portions 41 and thus the electric field by the electrode portions 41 is weak. For that reason, the electrostatic force Fe is sufficiently smaller than the toner carrying roller deposition force Fad and the image carrying member deposition force Fai.

Therefore, as shown in (b) and (c) of FIG. 4, the electrostatic force Fe does not substantially act on the toner T, so that the toner T is in the state in which the toner carrying roller deposition force Fad or the image carrying member deposition force Fai acts on the toner T.

Then, the toner T is moved to the needle-like electrode position ie with the movement of the image carrying member 3 to be placed in states as shown in (a) to (d) of FIG. 5.

<Toner at Needle-Like Electrode Position Ie>

Parts (a) and (b) of FIG. 5 are the model views when the image forming voltage Vp is applied to the electrode portions 41 at the needle-like electrode portion ie, and (c) and (d) of FIG. 5 are the model views when the non-image forming voltage V0 is applied to the electrode portions 41 at the needle-like electrode position ie.

The toner T is, when moved to the needle-like electrode portion ie, in both of the carried state by the toner carrying roller 2 and the carried state by the image carrying member 3, which are the states after the separation of the toner contact area as described above.

When the image forming voltage Vp is applied as shown in (a) and (b) of FIG. 5, the electrostatic force Fe toward the image carrying member act on the toner T by the electric field between the electrode portions 41 and the toner carrying roller 2.

In the state of (a) of FIG. 5, the electrostatic force Fe by the electric field satisfying the following formula (5) is caused to act on the toner T, so that the toner T is moved from the toner carrying roller 2 to the image carrying member 3.

$$Fe > Fad \quad (5).$$

Further, in the state of (b) of FIG. 5, the state in which the toner T is carried by the image carrying member 3 is maintained.

Therefore, by applying the image forming voltage Vp to the electrode portions 41, the toner image can be formed on the image carrying member 3.

When the non-image forming voltage V0 is applied as shown in (c) and (d) of FIG. 5, the electrostatic force Fe toward the toner carrying member act on the toner T by the electric field between the electrode portions 41 and the toner carrying roller 2.

In the state of (d) of FIG. 5, the electrostatic force Fe by the electric field satisfying the following formula (6) is caused to act on the toner T, so that the toner T is moved from the image carrying member 3 to the toner carrying roller 2.

$$Fe > Fai \quad (6).$$

Further, in the state of (c) of FIG. 5, the state in which the toner T is carried by the toner carrying roller 2 is maintained.

Therefore, by applying the non-image forming voltage V0 to the electrode portions 41, the toner image is not formed on the image carrying member 3.

By the image forming process as described above, when the toner carrying roller 2 and the image carrying member 3 are separated, both of the toner carried on the toner carrying roller 2 and the toner carried on the image carrying member 3 can be deposited on the image carrying member 3 at the image portion and can be prevented from being deposited on the image carrying member 3 at the non-image portion.

Next, the image forming process with respect to the direction crossing the image carrying member movement direction will be further described.

FIG. 6 is a timing chart of the voltage applied to the needle-like electrode 4 in the present invention. FIG. 6 shows an example in which the image forming voltage Vp is applied to the needle-like electrode 4 for a time t (sec) from the state in which the non-image forming voltage V0 at which the image formation is not effected is applied, and then the non-image forming voltage V0 is applied.

Parts (a) to (e) of FIG. 7 are schematic illustrations each showing the toner state between the toner carrying roller 2 and the image carrying member 3. Parts (a) to (e) of FIG. 7 show states, in which the voltage shown in FIG. 6 is applied, immediately before and after t1, immediately before and after t2 and at t3, respectively.

Part (a) of FIG. 7 shows the toner state immediately before t1 in FIG. 6. At this time, the non-image forming voltage V0 is applied to the electrode portions 41. For that reason, the toner T1 located at the needle-like electrode position ie is carried on the toner carrying roller 2 by the electrostatic force by the electric field between the image carrying member 3 and the toner carrying roller 2.

Part (b) of FIG. 7 shows the toner state immediately after t1 in FIG. 6. At this time, the image forming voltage Vp is applied to the electrode portions 41. For that reason, the toner T1 located at the needle-like electrode position ie is moved to and carried on the image carrying member 3 by the electrostatic force by the electric field between the image carrying member 3 and the toner carrying roller 2.

Next, (c) of FIG. 7 shows the toner state immediately before t2 in FIG. 6. During a period from the state of (b) of FIG. 7 to the state of (c) of FIG. 7, the image forming voltage Vp is applied to the electrode portions 41. For that reason, the toner T2 located at the needle-like electrode position ie and the toner T1 passing through the needle-like electrode position ie during the application of the image forming voltage Vp are carried on the image carrying member 3 by the electrostatic force by the electric field between the image carrying member 3 and the toner carrying roller 2.

Next, (d) of FIG. 7 shows the toner state immediately after t2 in FIG. 6. At this time, the non-image forming voltage V0 is applied to the electrode portions 41. For that reason, the toner T2 located at the needle-like electrode position ie is moved from the image carrying member 3 onto and carried on the toner carrying roller 2 by the electrostatic force by the electric field between the image carrying member 3 and the toner carrying roller 2. Further, the toners which include the T1 and are located downstream of the needle-like electrode position ie are kept in the carried state during passing of the needle-like electrode portion ie.

Part (e) of FIG. 7 shows the toner state at t2 in FIG. 6. During a period from the state of (d) of FIG. 7 to the state of (e) of FIG. 7, the non-image forming voltage V0 is applied to the electrode portions 41. For that reason, the toner T3 located at the needle-like electrode position ie is carried on the toner carrying roller 2 by the electrostatic force by the electric field between the image carrying member 3 and the toner carrying roller 2.

Further, the toners which include the toners T1 and T2 and are located downstream of the needle-like electrode portion ie are kept in the carried state at the time of passing through the needle-like electrode position ie. That is the toner carried on the image carrying member 3 during the passing thereof through the needle-like electrode position ie is carried on the image carrying member 3. Further, the toner carried on the toner carrying roller 2 during the passing thereof through the needle-like electrode portion ie is carried on the toner carrying roller 2.

Therefore, the toner T during the application of the image forming voltage Vp is in the state in which the toner T is carried on the image carrying member 3 but the image carrying member 3 is moved in the arrow B direction at a process speed V (mm/sec), so that it is possible to form an image with a width X=V×T (mm) on the image carrying member 3.

As described above, the image formation with respect to the direction perpendicular to the image carrying member movement direction B is effected.

Next, image comparison when the needle-like electrode position ei is changed will be described.

FIG. 8 is a schematic illustration showing the needle-like electrode positions ie in the image comparison.

The needle-like electrode positions ie in this embodiment are positions (6), (7) and (8) and other positions are those in a comparative embodiment.

The image formation is effected under the following condition.

Image carrying member movement speed: 50 mm/set
Image forming voltage Vp: +50 V
Non-image forming voltage V0: −50 V
Toner carrying roller potential: 0V
Toner amount on toner carrying roller: 0.3 mg/cm$^2$
Toner contact area Ic: 1.2 mm The image comparison was made by measuring toner amounts per unit area (mg/cm$^2$) when the image forming voltage Vp was applied to the electrode portions 41 at positions (1) to (10) in FIG. 8 and when the non-image forming voltage V0 was applied to the electrode portions 41 at the positions (1) to (10) in FIG. 8.

The toner amounts at the respective needle-like electrode portions are shown in Table 1 below. Part (a) of FIG. 9 is a graph showing the toner amount per unit area (M/S: mg/cm$^2$) under application of the image forming voltage Vp, and (b) of FIG. 9 is a graph showing the toner amount per unit area (M/S: mg/cm$^2$) under application of the non-image forming voltage V0. A distance of the needle-like electrode position from the toner contact area downstream end id is measured with respect to the image carrying member movement direction. In this case, a downstream direction is taken as positive (+) and an upstream direction is taken as negative (−).

TABLE 1

| POSITION | DISTANCE*1 (mm) | NLE* | M/S AT Vp*3 (mg/cm$^2$) | M/S AT VC*4 (mg/cm$^2$) |
|---|---|---|---|---|
| (1) | −1.6 | Ic-U | 0.151 | 0.151 |
| (2) | −1.3 | Ic-U | 0.150 | 0.151 |
| (3) | −1.1 | Ic | 0.152 | 0.151 |
| (4) | −0.6 | Ic | 0.151 | 0.152 |
| (5) | −0.1 | Ic | 0.155 | 0.150 |
| (6) | +0.1 | Ic-D | 0.284 | 0.013 |
| (7) | +0.2 | Ic-D | 0.283 | 0.013 |
| (8) | +0.3 | Ic-D | 0.281 | 0.015 |
| (9) | +0.4 | Ic-D | 0.162 | 0.142 |
| (10) | +0.6 | Ic-D | 0.162 | 0.142 |

*1"DISTANCE" represents the distance (mm) from the toner contact area downstream end id.
*2"NLE" represents the position of the needle-like electrode. "IC-U" represents the position upstream of the toner contact area Ic. "Ic" represents the position in Ic, "Ic-D" represents the position downstream of Ic.
*3"M/S AT Vp" represents the toner amount per unit area (mg/cm$^2$) at the image forming voltage Vp.
*4"M/S AT V0" represents the toner amount per unit area (mg/cm$^2$) at the non-image forming voltage V0.

Incidentally, a relationship between the position of the electrode portions 41 and the position in the toner contact area Ic and a relationship between the position in the toner contact area Ic and the position downstream (upstream) of the toner contact area Ic will be described. When the image forming portion is viewed from the direction crossing the image carrying member movement direction as shown in FIG. 8, a phantom line which passes through the toner contact area upstream position iu and is perpendicular to the image carrying member 3 and a phantom line which passes through the toner contact area downstream position id and is perpendicular to the image carrying member 3 are drawn.

Between these phantom lines, the case where the electrode portions 41 and the image carrying member 3 contact each other is referred to as the case where the electrode portions 41 are disposed in the toner contact area Ic.

Further, the case where the electrode portions 41 and the image carrying member 3 contact each other at the position downstream of the phantom line passing through the toner contact area downstream position id with respect to the image carrying member movement direction is referred to as the case where the electrode portions 41 are disposed downstream of the toner contact area Ic.

Further, the case where the electrode portions 41 and the image carrying member 3 contact each other at the position upstream of the phantom line passing through the toner contact area upstream position iu with respect to the image carrying member movement direction is referred to as the case where the electrode portions 41 are disposed upstream of the toner contact area Ic.

The above relationship between the electrode position and the toner contact area Ic in this embodiment is also applied to Embodiment 2 or later.

From the results of Table 1 and (a) and (b) of FIG. 9, it was found that the toner was carried on the image carrying member 3 only in the amounts which are about ½ of the toner amount (0.3 mg/cm$^2$) on the toner carrying roller 2 under application of the image forming voltage Vp in the constitutions (at positions (1) to (5)) in which the electrode portions 41 were disposed in the toner contact area Ic or upstream of the toner contact area Ic. That is, the toner on the toner carrying roller 2 could not be sufficiently moved, so that it was unable to ensure a sufficient image density.

Further, during application of the non-image forming voltage V0, about ½ of the toner on the toner carrying roller is placed in the state in which the toner is carried on the image carrying member, so that the toner on the image carrying member could not be sufficiently moved to the toner carrying roller. Therefore, it was unable to sufficiently reduce fog at the non-image portion.

In the constitution (at the positions (6) to (8)) of the present invention in which the electrode portions 41 are disposed downstream of the toner contact area downstream position id, the toner on the toner carrying roller could be sufficiently moved to the image carrying member during the application of the image forming voltage Vp. That is, the toner on the toner carrying roller could be sufficiently carried on the image carrying member, so that the image density could be sufficiently ensured.

Further, during the application of the non-image forming voltage V0, the toner on the image carrying member could be sufficiently moved to the toner carrying roller and the toner on the toner carrying roller was not carried on the image carrying member. Therefore, the fog at the non-image portion could be sufficiently reduced.

The above results will be described by using the model views of the force acting on the toner.

Part (a) of FIG. 10 is the model views showing the forces acting on the toner at the needle-like electrode position ie in the constitution at the positions (3), (4) and (5) shown in FIG. 8 (in the constitution in which the needle-like electrode position ie is located in the toner contact area Ic. Part (b) of FIG. 10 is the model view showing the forces acting on the toner at the toner contact area downstream position id in the constitution at the positions (3), (4), and (5) shown in FIG. 8.

As shown in (a) of FIG. 10, at the image forming electrode ie, the toner receives the electrostatic force toward the image carrying member by the image forming voltage applied to the electrode portions 41.

However, as shown in (b) of FIG. 10, at the toner contact area downstream position id, the distance from the electrode portions 41 is increased and thus the electric field by the image forming voltage Vp applied to the electrode portions 41 is weakened, so that a relationship as represented by a formula (7) below is satisfied. Therefore, the electrostatic force for carrying the toner on the image carrying member cannot be provided.

$$Fad >> Fe \text{ and } Fai >> Fe \quad (7)$$

Further, also during the application of the non-image forming voltage V0, the electric field is similarly weakened, so that the electrostatic force for carrying the toner on the toner carrying roller cannot be provided.

In the constitution at the positions (3), (4) and (5) shown in FIG. 8, the toner carrying state after the toner passes through the toner contact area Ic is as follows. Whether the toner is carried on the image carrying member or on the toner carrying member is determined by the relationship between the toner carrying roller deposition force Fad and the image carrying member deposition force Fai at the toner contact area downstream position id which is the position in which the toner carrying member and the image carrying member are separated from each other.

Therefore, in the constitution in which the needle-like electrode position ie is located in the toner contact area Ic as described above, it is difficult to apply the electrostatic force, to the toner by the needle-like electrode, which is larger than the toner carrying roller deposition force Fad and the image carrying member deposition force Fai. Accordingly, it is difficult to form the image by the toner movement. Further, this is also true for the constitution (at the positions (1) and (2) shown in FIG. 8) in which the needle-like electrode is disposed upstream of the toner contact area Ic.

In the constitution at the positions (9) and (10) shown in FIG. 8, the gap between the toner carrying roller and the image carrying member is increased and therefore, it is difficult to apply the electrostatic force, to the toner by the needle-like electrode, which is larger than the toner carrying roller deposition force Fad and the image carrying member deposition force Fai. For that reason, even when the voltage is applied to the needle-like electrode, the toner is not moved between the toner carrying roller and the image carrying member, so that the image formation cannot be effected.

Here, the area in which the toner is moved between the toner carrying roller and the image carrying member by changing the voltage applied to the image forming electrode is the toner carrying member (toner movable area). When the image forming electrode is disposed at the positions (9) and (10), there is no toner movement area and therefore the toner is in a state in which the image formation cannot be effected.

As described above, in the constitution (at the positions (6) to (8) shown in FIG. 8) in Embodiment 1 according to the present invention, the toner located at the needle-like electrode position ie in which the voltage of the opposite polarity to the toner charge polarity is in the carried state by the image carrying member 3, thus being subjected to the image formation. Further, the toner located at the needle-like electrode position ie in which the voltage of the identical polarity to the toner charge polarity is in the carried state by the toner carrying roller 2, thus being not subjected to the image formation.

Therefore, the image density at the image portion is ensured, so that it is possible to form the toner image with reduced fog at the non-image portion. This is because the toner movement area is present downstream of the toner contact area Ic with respect to the image carrying member movement direction. By employing such a constitution, the toner image forming portion by the voltage applied to the electrode portions 41 is located downstream of the toner contact area Ic with respect to the image carrying member movement direction. For that reason, when the toner carrying roller 2 and the image carrying member 3 are separated at the toner contact area downstream position id, a good image can be formed irrespective of whether the toner is carried on the toner carrying roller 2 or on the image carrying member 3. Incidentally, in the case where the needle-like electrode is used as in this embodiment, the toner movement area is a contact position between the needle-like electrode and the image carrying member.

In the constitution in this embodiment, the needle-like electrode 4 is disposed at a proper position in which the electric discharge does not occur between the toner carrying roller 2 and the image carrying member 3, and the image forming voltage and the non-image forming voltage which are not more than the electric discharge start voltage are used.

Further, the present invention is not limited to the constitution in this embodiment but when a constitution in which a relationship, between the gap and the voltage, which causes no electric discharge and is shown in (a) of FIG. 12 is employed, the image formation can be effected by setting the position and image forming voltage of the electrode portions 41.

Incidentally, a measuring method of the toner contact area Ic between the toner carrying roller and the image carrying member, and the toner contact area downstream position id will be described with reference to (a) and (b) of FIG. 11.

As shown in (a) of FIG. 11, in a state of rest of both of the toner carrying member 2 and the image carrying member 3, the image forming voltage Vp is applied to the needle-like electrode ("STEP 1"). The voltage application to the electrode portions 41 is turned off to provide a potential difference of 0V between the toner carrying roller 2 and the image carrying member 3 and thereafter the toner carrying roller 2 and the image carrying member 3 are separated ("STEP 2").

Part (b) of FIG. 11 is a schematic view showing the toner deposition state on the image carrying member after the separation.

From the area in which the toner is deposited on the image carrying member, the toner contact area Ic, the toner contact area downstream position id and the needle-like electrode position ie can be measured. In the constitution in which the needle-like electrode is disposed at a position outside the toner contact area Ic, as shown in (b) of FIG. 11, there are two areas consisting of the toner contact area Ic and the image forming area by the needle-like electrode. Further, the position downstream of the toner contact area Ic with respect to the image carrying member movement direction B is the toner contact area downstream position id. The position downstream of the image forming area by the needle-like electrode with respect to the toner carrying member movement direction B is the needle-like electrode downstream position ie.

On the other hand, in the case where the needle-like electrode is disposed at the position in the toner contact area Ic, the toner contact area Ic and the image forming area by the needle-like electrode overlap with each other.

In this embodiment, by changing the value of the voltage applied to the image forming electrode, it is possible to effect the image formation with respect to both of the directions parallel and perpendicular to the image carrying member movement direction, so that the toner image can be formed on the image carrying member on the basis of image information.

Further, the toner carried on the image carrying member is moved at the position downstream of the toner contact area with respect to the image carrying member movement direction, so that a toner image disturbing phenomenon occurring in the toner contact area can be suppressed.

Therefore, at the image portion, the amount of the toner moved from the toner carrying roller to the image carrying member by the image forming electrode can be increased, so that the image density at the image portion can be increased. In addition, at the non-image portion, by increasing the amount of the toner moved from the image carrying member to the toner carrying roller by the image forming electrode, the amount of the toner deposited on the image carrying member can be reduced.

Embodiment 2

Next, Embodiment 2 to which the present invention is applicable will be described. Constituent members or portions identical to those in Embodiment 1 are represented by the same reference numerals or symbols and will be omitted from description.

Embodiment 2 of the present invention will be described with reference to the drawings.

FIG. 13 is a schematic illustration of an image forming apparatus in this embodiment to which the present invention is applicable.

In FIG. 13, an image forming apparatus 10 includes a toner carrying roller (toner carrying member) 2 for carrying and conveying a toner at its outer peripheral surface, an image carrying member 3 on which an image of the toner T is to be formed, a planar electrode 105 which is an image forming electrode portion for permitting formation of a toner image on the image carrying member 3 based on image information by applying a voltage thereto, and a transfer member 5 for transferring the toner image from the image carrying member 3 onto a recording material P such as paper.

A difference from Embodiment 1 is that the electrode for forming the toner image on the image carrying member is not the needle-like electrode but is the planar electrode 105. The toner T, the toner carrying roller 2, the image carrying member 3 and the transfer roller (member) 5 have the same constitutions as those in Embodiment 1 and will be omitted from description.

Parts (a) and (b) of FIG. 15 are schematic illustrations showing a portion of the planar electrode 105 used as the image forming electrode in this embodiment, wherein (a) is a schematic illustration of an image carrying member contact surface of the planar electrode 105 and (b) is a schematic sectional view taken along a direction (perpendicular to the drawing sheet surface of FIG. 13) crossing the image carrying member movement direction.

As shown in (a) of FIG. 15, the planar electrode 105 is constituted by an insulating electrode base material 102, a plurality of electrode portions 101 formed on the image carrying member contact surface of the electrode base material 102, and an electrode driving portion 103 connected to the electrode portions 101.

The electrode portions 101 are constituted by a plurality of electrodes divided (separated) along a direction (perpendicular to the drawing sheet direction of FIG. 13) crossing the image carrying member movement direction. Each electrode portion has a width W with respect to the image carrying member movement direction and is formed in a straight line shape extending in the image carrying member movement direction. The electrode portions 101 are electrodes for forming the toner image on the image carrying member.

As shown in (b) of FIG. 15, the electrode portions 101 are formed on the entire image forming area of the electrode base material (substrate) with an electrode width L for each electrode at an electrode interval S between adjacent electrodes with respect to the direction crossing the image carrying member movement direction.

In this embodiment, a flexible print board was used as the planar electrode 105. The electrode base material 102 is formed of polyimide in a thickness of 25 μm and thereon the electrode portions 101 are formed with copper electrodes in a thickness of 10 μm. The electrode portions 101 have the electrode width L of 40 μm for each electrode and the electrode interval S of 40 μm with respect to the direction crossing the image carrying member movement direction.

Further, the planar electrode 105 is fixedly disposed on an electrode stay 130 in contact with the inner surface of the image carrying member 3 with predetermined pressure.

Further, the electrode portions 101 are connected to an image forming electrode voltage controller 110 via the electrode driving portion 103, and the controller 110 contacts and applies a voltage based on image information to the respective electrode portions 101 with predetermined timing, thus effecting the image formation.

Part (c) of FIG. 15 is a block diagram showing a constitution of the electrode portions in this embodiment.

The image information is inputted into an interface (I/F) 120 and data of the image information is received by a data receiving portion 121 and is sent to the electrode driving portion 103. The electrode driving portion 103 is constituted by a shift register 106 for converting the transferred image data, a latch 107 for holding an output state of the shift register 106, and a gate 108 for switching an output applied from an electrode power (voltage) source 111 to each of the electrodes of the planar electrode portion.

The electrode power source 111 is connected to the respective electrode portions (101*a*, 101*b*, 101*c*, . . . ) of the electrode portions 101 via the gate 108 to supply the image forming voltage Vp and the non-image forming voltage V0 to the electrode portions 101.

A controller 112 contacts the data receiving portion 121, the shift register 106, the latch 107 and the gate 108 and contacts the voltage applied to each electrode of the electrode portions depending on the image information inputted from the interface (I/F) 120, thus effecting the image formation. The image forming electrode voltage controller 110 includes the electrode power source 111 and the controller 112.

FIG. 14 is an enlarged schematic illustration of the image forming portion where the planar electrode 105 as the image forming electrode in the image forming apparatus 10 is disposed. In the toner contact area Ic, the planar electrode 105 has a substantially flat surface as shown in FIG. 14.

In FIG. 14, in the toner contact area Ic, the toner T on the toner carrying roller 2 contacts the image carrying member 3. The position iu is the upstream position of the toner contact area Ic with respect to the image carrying member movement direction, and the position id is the downstream position of the toner contact area Ic with respect to the image carrying member movement direction.

The position ie0 is an electrode contact downstream position which is the downstreammost position, of an area in which the image carrying member 3 and the electrode portions 101 of the planar electrode 105 contact each other, with respect to the image carrying member movement direction.

In a toner movement area (toner movable area) Imd, the toner is moved between the toner carrying roller 2 and the image carrying member 3. In this embodiment, the downstreammost position of the electrode portions 101 with respect to the image carrying member movement direction is a downstreammost position of Imd, and the position in which the toner on the toner carrying roller 2 and the image carrying member 3 are started to be separated is an upstreammost position of Imd.

In this embodiment, as shown in FIG. 14, the toner T on the toner carrying roller 2 contacts the image carrying member 3 to provide the toner contact area Ic.

Further, the electrode contact downstream position ie0 of the electrode portions 101 is located downstream of the toner contact area Ic with respect to the movement direction of the image carrying member 3. The operation in this embodiment is performed by moving the toner between the toner carrying roller 2 and the image carrying member 3 by the electric field between the toner carrying roller 2 and the image carrying member 3. The toner movement is effected in the toner movement area Imd.

When the gap between the toner carrying roller 2 and the image carrying member 3 at the position of the planar electrode 105 is a toner carrying member gap Tg, the electric field acting on the toner can be made larger with a smaller toner carrying member gap Ig.

In the present invention, by employing the constitution in which the toner contact area Ic is provided, the toner carrying member gap Ig is gradually increased from the toner contact area Ic, so that a narrow gap between the electrode portions 101 and the toner carrying roller 2 can be created at the electrode contact downstream position ie0.

By the above constitution, the electric field between the toner carrying roller 2 and the electrode portions 101 can be strengthened, so that the toner can be moved at a low image forming voltage.

In this embodiment, in the toner movement area Imd, the image forming voltage and the non-image forming voltage are set at values at which no electric discharge occurs in the gap between the toner carrying roller 2 and the image carrying member 3.

Next, an image forming process with respect to the direction crossing the image carrying member movement direction will be described.

Part (a) of FIG. 16 is an enlarged schematic model view showing a toner state between the toner carrying roller 2 and the image carrying member 3 in the toner movement area Imd of the planar electrode 105 and partly showing a plane perpendicular to the image carrying member movement direction B.

Part (a) of FIG. 16 shows the state in which the image forming voltage is applied to the electrode portions 101*b* and 101*d* and the non-image forming voltage is applied to the electrode portions 101*a*, 101*c* and 101*e*. Part (b) of FIG. 16 shows the electric field at the toner carrying member surface, the toner carrying roller 2, and the image carrying member 3.

In (a) and (b) of FIG. 16, in the direction perpendicular to the image carrying member movement direction B (in the direction perpendicular to the drawing sheet surface in FIG. 13), the plurality of electrode portions 101*a* and 101*e* of the planar electrode 105 are arranged depending on a resolution of the image forming apparatus 10. Each of the electrode portions 101*a* to 101*e* is disposed in contact with the image carrying member 3.

The toner T (Ta to Te) is negatively charged. The toners at the contact positions of electrode portions 101*a* to 101*d* are Ta to Te, respectively.

In (b) of FIG. 16, the electric field intensity is represented by a direction and length of each arrow.

Next, the voltage applied to the electrode portions 101 will be described. The toner carrying roller 2 is kept at +50 V by the toner carrying roller power source 24. To each of the electrode portions 101*a* to 101*e*, a voltage depending on the image information is applied from the image forming electrode voltage controller 110.

The image forming voltage Vp of +100 V is selectively applied to the electrode portions 41 in an image forming area, and the non-image forming voltage V0 of 0 V is selectively applied to the electrode portions 101 in a non-image forming area.

The image forming voltage Vp is a voltage, applied to the electrode portions 101, of an opposite polarity to the toner charge polarity with respect to the potential of the toner carrying roller 2.

The non-image forming voltage is a voltage, applied to the electrode portions 101, of identical polarity to the toner charge polarity with respect to the potential of the toner carrying roller 2.

As shown in (b) of FIG. 16, the toners located at positions of the electrode portions 101*b* and 101*d* to which the image forming voltage Vp is applied receive the electrostatic force with respect to the image carrying member direction by the electric field directed in the toner carrying member 2 direction.

The toners located at positions of the electrode portions 101*a*, 101*c* and 101*e* to which the non-image forming voltage V0 is applied receive the electrostatic force with respect to the toner carrying member 2 direction by the electric field directed in the image carrying member 3 direction, By the above-described electric fields by the planar electrode 105, the toners are moved as shown in (a) of FIG. 16.

Further, the toner located between the electrode portion 101*b* to which the image forming voltage Vp is applied and the electrode portion 101*a* to which the non-image forming voltage V0 is applied is selectively placed, depending on the electric field formed by the associated electrode, in a carried state by the toner carrying roller 2 or in a carried state by the image carrying member 3. This is true for the toners located between adjacent two other electrode portions.

As described above, with respect to the direction perpendicular to the image carrying member movement direction B, it is possible to effect the image formation.

Next, with respect to the image carrying member movement direction, the image forming process will be described with reference to FIG. 17. Parts (a) to (d) of FIG. 17 are schematic model views each showing a force acting on the toner at the image forming portion.

Parts (a) and (b) of FIG. 17 are the model views in the toner movement area Imd, and (c) and (d) of FIG. 17 are the model views at the position downstream of the toner movement area Imd with respect to the image carrying member movement direction.

The force acting on the toner T will be described. A non-electrostatic deposition force between the toner T and the toner carrying roller 2 is a toner carrying roller deposition force Fad, and a non-electrostatic deposition force between the toner T and the image carrying member 3 is an image carrying member deposition force Fai. The electrostatic force acting on the Loner T by the electric field between the image carrying member 3 and the toner carrying roller 2 is an electrostatic force Fe.

<Toner in Toner Movement Area Imd>

Part (a) of FIG. 17 is the model view when the image forming voltage Vp is applied to the electrode portion 101, and (c) and (d) of FIG. 5 are the model views when the non-image forming voltage V0 is applied to the electrode portions 101.

The toner T is in both of the carried state by the toner carrying roller 2 and the carried state by the image carrying member 3, depending on the previous voltage state applied to the electrode portions 101.

When the image forming voltage Vp is applied to the electrode portions 101 as shown in (a) of FIG. 17, the electrostatic force Fe toward the image carrying member act on the toner T by the electric field between the image carrying member 3 and the toner carrying roller 2.

In the state of (a) of FIG. 17, the electric field satisfying the following formula (8) is caused to act on the toner T, so that the toner T is moved from the toner carrying roller 2 to the image carrying member 3.

$$Fe>Fad \quad (8).$$

Therefore, by applying the image forming voltage Vp to the electrode portions 101, the toner image can be formed on the image carrying member 3.

When the non-image forming voltage V0 is applied to the electrode portions 101 as shown in (d) of FIG. 17, the electrostatic force Fe toward the toner carrying roller 2 act on the toner T by the electric field between the image carrying member 3 and the toner carrying roller 2.

In the state of (b) of FIG. 17, the electric field satisfying the following formula (9) is caused to act on the toner T, so that the toner T is moved from the image carrying member 3 to the toner carrying roller 2.

$$Fe>Fai \quad (9).$$

Therefore, by applying the non-image forming voltage V0 to the electrode portions 101, the toner image is not formed on the image carrying member 3.

<Toner at Position Downstream of Toner Movement Area Imd with Respect to Image Carrying Member Movement Direction>

Part (c) of FIG. 17 is the model view when the image forming voltage Vp is applied to the electrode portions 101 at the position downstream of the toner movement area Imd with respect to the image carrying member movement direction, and (d) of FIG. 17 is the model view when the non-image forming voltage V0 is applied to the electrode portions 101 at the position downstream of the toner movement area Imd with respect to the image carrying member movement direction.

In either case, the gap between the electrode portions 101 and the toner carrying roller 2 is increased and therefore the electrostatic force Fe by the electric field is weak, so that the toner cannot be moved. Accordingly, the following formula (10) is satisfied.

$$Fe<Fad \text{ and } Fe<Fai \quad (10)$$

Therefore, the toner located downstream of the toner movement area Imd with respect to the image carrying member movement downstream is kept in the toner carrying state at the electrode contact downstream position ie0.

As described above, the toner is moved in the toner movement area Imd between the toner carrying roller 2 and the image carrying member 3, so that the toner image formation and the non-toner image formation can be selectively effected by the voltage when the toner is located at the electrode contact downstream position ie0.

Next, the image formation by the voltage applied to the planar electrode 105 will be described more specifically. In this embodiment, the case where the voltage is applied to the electrode portions 101 with timing as shown in FIG. 6 will be described as an example. Parts (a) to (e) of FIG. 18 are schematic illustrations each showing the toner state between the toner carrying roller 2 and the image carrying member 3. Parts (a) to (e) of FIG. 18 show states, in which the voltage shown in FIG. 6 is applied, immediately before and after t1, immediately before and after t2 and at t3, respectively.

Part (a) of FIG. 18 shows the toner state immediately before t1 in FIG. 6. At this time, the non-image forming voltage V0 is applied to the electrode portions 101. For that reason, the toner is carried on the toner carrying roller 2 by the electrostatic force by the electric field between the electrode portions 101 and the toner carrying roller 2.

The toner T1 located at the electrode contact downstream position ie0 is also similarly carried on the toner carrying roller 2.

Part (b) of FIG. 18 shows the toner state immediately after t1 in FIG. 6. At this time, the image forming voltage Vp is applied to the electrode portions 101. For that reason, the toner located in the toner contact area Imd is moved to and carried on the image carrying member 3 by the electrostatic force by the electric field between the planar electrode 105 and the toner carrying roller 2.

Next, (c) of FIG. 18 shows the toner state immediately before t2 in FIG. 6.

During a period from the state of (b) of FIG. 18 to the state of (c) of FIG. 18, the image forming voltage Vp is applied to the electrode portions 101. For that reason, the toner located in the toner movement area Imd is moved to and continuously carried on the image carrying member 3 by the electrostatic force by the electric field between the planar electrode 105 and the toner carrying roller 2.

The toner T2 located at the electrode contact downstream position Ie0 is also similarly carried on the image carrying member 3.

Next, (d) of FIG. 18 shows the toner state immediately after t2 in FIG. 6. At this time, the non-image forming voltage V0 is applied to the electrode portions 101. For that reason, the toner located in the toner movement area Imd is moved onto and carried on the toner carrying roller 2 by the electrostatic force by the electric field between the image carrying member 3 and the toner carrying roller 2. The toner T2 located at the electrode contact downstream position ie0 is also similarly carried on the toner carrying roller 2. Further, the toners which include the T1 and are located downstream of the electrode contact downstream position ie0 are kept in the carried state during passing of the electrode contact downstream portion ie0.

Part (e) of FIG. 18 shows the toner state at t2 in FIG. 6. During a period from the state of (d) of FIG. 18 to the state of (e) of FIG. 18, the non-image forming voltage V0 is applied to the electrode portions 101. For that reason, the toner located in the toner movement area Imd is moved to and carried on the toner carrying roller 2 by the electrostatic force by the electric field between the planar electrode 105 and the toner carrying roller 2.

The toner T3 located at the electrode contact downstream position ie0 is also similarly carried on the toner carrying roller 2.

Further, the toners which include the toners T1 and T2 and are located downstream of the electrode contact downstream position ie0 are kept in the carried state at the time of passing through the electrode contact downstream position ie0.

Therefore, the toner T during the application of the image forming voltage Vp is in the state in which the toner T is carried on the image carrying member 3 but the image carrying member 3 is moved in the arrow B direction at a process speed V (mm/sec), so that it is possible to form an image with a width X=V×T (mm) on the image carrying member 3.

As described above, the image formation with respect to the direction perpendicular to the image carrying member movement direction B is effected.

Next, image comparison when the position of the planar electrode 105 is changed will be described.

FIG. 19 is a schematic illustration showing the electrode contact downstream positions ie0 of the planar electrode 105 in the image comparison.

The electrode contact downstream positions ie0 in this embodiment are positions (5), (6) and (7) and other positions are those in a comparative embodiment.

The image formation is effected under the following conditions.

Image carrying member movement speed: 100 mm/set

Toner carrying roller potential: +50 V

Image forming voltage Vp; +100 V

Non-image forming voltage V0: 0 V

Toner amount on toner carrying roller: 0.3 mg/cm$^2$

The image comparison was made by measuring toner amounts per unit area (mg/cm$^2$) at the image forming portion downstream position ie0 when the image forming voltage Vp was applied to the electrode portions 101 at positions (1) to (7) in FIG. 19 and when the non-image forming voltage V0 was applied to the electrode portions 101 at the positions (1) to (7) in FIG. 19.

The toner amounts at the respective electrode contact downstream portions ie0 are shown in Table 2 below. Part (a) of FIG. 20 is a graph showing the toner amount per unit area (M/S: mg/cm$^2$) under application of the image forming voltage Vp, and (b) of FIG. 20 is a graph showing the toner amount per unit area (M/S: mg/cm$^2$) under application of the non-image forming voltage V0.

TABLE 2

| POSITION | DISTANCE*1 (mm) | NLE* | M/S AT Vp*3 (mg/cm$^2$) | M/S AT V0*4 (mg/cm$^2$) |
|---|---|---|---|---|
| (1) | −1.3 | Ic-U | 0.151 | 0.152 |
| (2) | −1.1 | Ic | 0.152 | 0.150 |
| (3) | −0.6 | Ic | 0.152 | 0.151 |
| (4) | −0.1 | Ic | 0.151 | 0.152 |
| (5) | +0.10 | Ic-D | 0.289 | 0.011 |
| (6) | +0.15 | Ic-D | 0.291 | 0.009 |
| (7) | +0.20 | Ic-D | 0.290 | 0.009 |

*1"DISTANCE" represents the distance (mm) from the toner contact area downstream end id.

*2"NLE" represents the position of the needle-like electrode. "IC-U" represents the position upstream of the toner contact area Ic. "Ic" represents the position in Ic. "Ic-D" represents the position downstream of Ic.

*3"M/S AT Vp" represents the toner amount per unit area (mg/cm$^2$) at the image forming voltage Vp.

*4"M/S AT V0" represents the toner amount per unit area (mg/cm$^2$) at the non-image forming voltage V0.

From the results of Table 2 and (a) and (b) of FIG. 20, it was found that the toner was carried on the image carrying member 3 only in the amounts which are about ½ of the toner amount (0.3 mg/cm$^2$) on the toner carrying roller 2 under application of the image forming voltage Vp in the constitutions (at positions (1) to (4)) in which the electrode contact downstream positions ie0 of the planar electrode 105 were disposed in the toner contact area Ic or upstream of the toner contact area Ic. That is, the toner on the toner carrying roller 2 could not be sufficiently moved, so that it was unable to ensure a sufficient image density.

Further, during application of the non-image forming voltage V0, about ½ of the toner on the toner carrying roller is placed in the state in which the toner is carried on the image carrying member, so that the toner on the image carrying member could not be sufficiently moved to the toner carrying roller. Therefore, it was unable to sufficiently reduce fog at the non-image portion.

In the constitution (at the positions (5) to (7)) of the present invention in which the electrode contact downstream positions ie0 are disposed downstream of the toner contact area downstream position id, the toner on the toner carrying roller could be sufficiently moved to the image carrying member during the application of the image forming voltage Vp. That is, the toner on the toner carrying roller could be sufficiently carried on the image carrying member, so that the image density could be sufficiently ensured.

Further, during the application of the non-image forming voltage V0, the toner on the image carrying member could be sufficiently moved to the toner carrying roller and the toner on the toner carrying roller was not carried on the image carrying member. Therefore, the fog at the non-image portion could be sufficiently reduced.

The above results will be described more specifically. In the constitutions (at the positions (2) to (4) in FIG. 19) in which the electrode contact downstream position ie0 of the planar electrode 105 is located in the toner movement area Imd, the force acting on the toner will be described.

Part (a) of FIG. 10 is the model views showing the forces acting on the toner at the electric discharge contact downstream position ie0 in the constitution in which the planar electrode 105 is disposed in the toner contact area Ic. Part (b) of FIG. 10 is the model view showing the forces acting on the toner at the toner contact area downstream position id.

As shown in (a) of FIG. 10, at the electrode contact downstream position ie0, the toner receives the electrostatic force toward the image carrying member by the image forming voltage applied to the electrode portions 101.

However, as shown in (b) of FIG. 10, at the toner contact area downstream position id, the distance from the electrode portions 101 is increased and thus the electric field by the image forming voltage Vp applied to the electrode portions 101 is weakened, so that the electrostatic force for carrying the toner on the image carrying member cannot be provided.

Further, the electric field by the non-image forming voltage V0 is also weakened, so that the electrostatic force for carrying the toner on the toner carrying roller cannot be provided.

*Fad>>Fe* and *Fai>>Fe*

Therefore, in the above constitution, it is difficult to provide, to the toner, the electrostatic force larger than the toner carrying roller deposition force Fad and the image carrying member deposition force Fai.

Next, the constitution in which the electrode downstream position ie0 is located downstream of the toner contact area downstream position id will be described.

In the constitutions (at the positions (5) to (7) shown in FIG. 19) in which the electrode contact downstream positions ie0 are located downstream of the toner contact area Ic, whether the toner is carried on the image carrying member or the toner carrying member is determined by the electrode contact downstream position ie0.

Parts (a) and (b) of FIG. 5 are the model views in the toner movement area Imd when the image forming voltage Vp is applied to the planar electrode 105, and (c) and (d) of FIG. 5 are the model views in the toner movement area Imd when the non-image forming voltage V0 is applied to the planar electrode 105.

When the image forming voltage Vp is applied as shown in (a) and (b) of FIG. 5, the electrostatic force Fe toward the image carrying member act on the toner T by the electric field between the electrode portions 101 and the toner carrying roller 2.

In the state of (a) of FIG. 5, the electric field satisfying the following formula is caused to act on the toner T, so that the toner T is moved from the toner carrying roller 2 to the image carrying member 3.

*Fe>Fad*

Further, in the state of (b) of FIG. 5, the state in which the toner T is carried by the image carrying member 3 is maintained.

When the non-image forming voltage V0 is applied as shown in (c) and (d) of FIG. 5, the electrostatic force Fe toward the toner carrying member act on the toner T by the electric field between the electrode portions 101 and the toner carrying roller 2.

In the state of (d) of FIG. 5, the electric field satisfying the following formula is caused to act on the toner T, so that the toner T is moved from the image carrying member 3 to the toner carrying roller 2.

*Fe>Fai*

Further, in the state of (c) of FIG. 5, the state in which the toner T is carried by the toner carrying roller 2 is maintained.

Therefore, in the above constitutions, it is possible to provide the electrostatic force, to the toner, larger than the toner carrying roller deposition force Fad and the image carrying member deposition force Fai.

As described above, when the toner carrying roller and the image carrying member are separated, both of the toner carried on the toner carrying roller and the toner carried on the image carrying member can be subjected to the image formation and the non-image formation.

As described above, irrespective of the state in which the toner is carried on the toner carrying roller and the state in which the toner is carried on the image carrying member, the toner located at the electrode portions 101 in which the voltage of the opposite polarity to the toner charge polarity is in the carried state by the image carrying member 3, thus being subjected to the image formation. Further, the toner located at the electrode portions 101 in which the voltage of the identical polarity to the toner charge polarity is in the carried state by the toner carrying roller 2, thus being not subjected to the image formation.

Therefore, by the constitution in which the electrode contact downstream position ie0 is located downstream of the toner contact area downstream end id with respect to the image carrying member movement downstream, the toner movement area Imd can be located downstream of the toner contact area downstream end id with respect to the image carrying member movement direction.

By this constitution, the image density at the image portion is ensured, so that it is possible to form the toner image with reduced fog at the non-image portion.

Incidentally, a measuring method of the toner contact area Ic between the toner carrying roller and the image carrying member, the toner movement area Imd and the electrode contact downstream position ie0 will be described with reference to (a) to (c) of FIG. 21.

As shown in (a) of FIG. 11, in a state of rest of both of the toner carrying member 2 and the image carrying member 3, the image forming voltage Vp is applied to the electrode portions 101 of the planar electrode 105. Then, as shown in (a) of FIG. 21, a potential difference of 0V between the toner carrying roller 2 and the electrode portions 101 is provided and thereafter the toner carrying roller 2 and the image carrying member 3 are separated.

Part (b) of FIG. 21 is a schematic view showing the toner deposition state on the image carrying member after the separation of the image carrying member.

From the area in which the toner is deposited on the image carrying member, the toner contact area Ic, the toner contact area downstream position id, the toner movement area Imd and the electrode contact downstream position ie0 can be measured.

In the case where the electrode contact downstream position (downstream end contact position) is located outside the toner contact area Ic, on the image carrying member, both of the toner contact area Ic and the toner movement area Imd are present.

In the toner contact area Ic, the toner is deposited on both of the toner carrying roller and the image carrying member. On the other hand, the amount of the carried toner is larger on the image carrying member in the toner movement area Imd and is smaller on the toner carrying roller. From the difference in toner amount, the toner contact area downstream end position id can be determined. Further, the electrode contact downstream position ie0 is the downstreammost position of the toner movement area Imd with respect to the image carrying member movement direction B.

On the other hand, in the case where the electrode downstream position ie0 is located in the toner contact area Ic, there is no toner movement area Imd.

By using the planar electrode 105 as in Embodiment 2, it is possible to prevent positional deviation of the electrode, so that the image carrying member and the respective electrode portions can be stably contacted at the respective positions. Therefore, it is possible to reduce a degree of deviation of pixels with respect to the image carrying member movement direction B and the direction (perpendicular to the drawing sheet direction of FIG. 13) perpendicular to the image carrying member movement downstream B.

Embodiment 3

Next, Embodiment 3 to which the present invention is applicable will be described. Constituent members or portions identical to those in Embodiments 1 and 2 are represented by the same reference numerals or symbols and will be omitted from description.

The constitution of the image forming apparatus to which the present invention is applicable and the constitution of the planar electrode used as the image forming electrode are the same as those in Embodiment 2 and therefore will be omitted from description. A difference from Embodiment 2 is that the electrode portions 101 extend to a position downstream of the position of the electrode portions 101 in Embodiment 2 with respect to the movement direction of the image carrying member 3.

FIG. 22 is an enlarged schematic illustration of the image forming portion where the planar electrode 105 as the image forming electrode in the image forming apparatus 10 is disposed. In the toner contact area Ic, the planar electrode 105 has a substantially flat surface as shown in FIG. 22.

In this embodiment, as shown in FIG. 22, the toner T on the toner carrying roller 2 contacts the image carrying member 3 to provide the toner contact area Ic.

The planar electrode 105 is disposed opposite from the toner carrying roller 2 with respect to the image carrying member 3, and the electrode portions 101 of the planar electrode 105 are disposed in contact with the image carrying member 3.

The electrode contact downstream position ie0 which is the contact position of the electrode portions 101 to the image carrying member 3 at a downstream side with respect to the image carrying member movement direction is located downstream of the toner contact area Ic with respect to the image carrying member movement direction B.

The position iL shown in FIG. 22 is a toner movement limit position in which the toner can be moved from the toner carrying roller 2 to the image carrying member 3 when the image forming voltage (bias) Vp is applied to the electrode portions 101.

In this embodiment, the electrode contact downstream position ie0 of the planar electrode 105 is located downstream of the toner movement limit position iL with respect to the image carrying member movement direction.

The forces acting on the toner will be described. The forces Fe, Fad and Fai described below are the same as those described in Embodiment 2. Similarly as in Embodiment 2, as the toner state, there are two states consisting of the toner carried state by the toner carrying roller 2 and the toner carried state by the image carrying member 3.

<Toner in Loner Movement Area Imd>

In the toner movement area Imd, the following relationship is satisfied.

$$Fe>Fad \text{ and } Fe>Fai$$

Both of the toner carried on the toner carrying roller 2 and the toner carried on the image carrying member 3 can be moved by the force of the electric field.

<Toner from Toner Movement Limit Position iL to Electrode Contact Downstream Position Ie0>

In this area, the following relationship is satisfied.

$$Fe<Fad \text{ and } Fe<Fai$$

Both of the toner carried on the toner carrying roller 2 and the toner carried on the image carrying member 3 cannot be moved since the gap between the toner carrying roller 2 and the electrode portions 101 is increased and thus the electrostatic force is weak.

Therefore, the toner located downstream of the toner movement area Imd is kept in the toner carrying state at the toner movement limit position iL in which the toner is movable.

With respect to the toner at the toner movement limit position iL, the electrostatic forces Fe by the image forming voltage Vp and the non-image forming voltage V0 are substantially equal to the non-electrostatic deposition forces Fad and Fai as shown below.

$$Fe=Fad$$

$$Fe=Fai$$

As described above, in this embodiment, the toner is moved in the toner movement area Imd between the toner carrying roller 2 and the image carrying member 3, so that the toner image formation and the non-toner image formation can be selectively effected by the voltage control of the electrode portions 101 when the toner is located at the toner movement limit position iL.

Next, the image forming process will be described. The image forming process with respect to the direction crossing the image carrying member movement direction is the same as that in Embodiment 2 and thus will be omitted from description.

The image forming process with respect to the image carrying member movement direction will be described.

In this embodiment, the case where the voltage is applied to the electrode portions 101 with timing as shown in FIG. 6 will be described as an example. Parts (a) to (e) of FIG. 23 are schematic illustrations each showing the toner state between the toner carrying roller 2 and the image carrying member 3. Parts (a) to (e) of FIG. 23 show states, in which the voltage shown in FIG. 6 is applied, immediately before and after t1, immediately before and after t2 and at t3, respectively.

Part (a) of FIG. 23 shows the toner state immediately before t1 in FIG. 6. At this time, the non-image forming voltage V0 is applied to the electrode portions 101. For that reason, the toner is carried on the toner carrying roller 2 by the electrostatic force by the electric field between the electrode portions 101 and the toner carrying roller 2.

The toner T1 located at the toner movement limit position iL is also similarly carried on the toner carrying roller 2.

Part (b) of FIG. 23 shows the toner state immediately after t1 in FIG. 6. At this time, the image forming voltage Vp is applied to the electrode portions 101. For that reason, the toner located in the toner contact area Imd is moved to and carried on the image carrying member 3 by the electrostatic force by the electric field between the planar electrode 105 and the toner carrying roller 2. The toner located at the toner movement limit position iL is also similarly carried no the image carrying member 3. The toner located downstream of the toner movement limit position iL is kept in the toner carried state by the toner carrying roller 2.

Next, (c) of FIG. 23 shows the toner state immediately before t2 in FIG. 6. During a period from the state of (b) of FIG. 23 to the state of (c) of FIG. 23, the image forming voltage Vp is applied to the electrode portions 101. For that reason, the toner located in the toner movement area Imd is moved to and continuous carried on the image carrying member 3 by the electrostatic force by the electric field between the planar electrode 105 and the toner carrying roller 2.

The toner T2 located at the toner movement limit position iL is also similarly carried on the image carrying member 3. The toners including the toner T1 located downstream of the toner movement limit position iL is kept in the state of the toner carried during the passing through the toner movement limit position iL.

Next, (d) of FIG. 23 shows the toner state immediately after t2 in FIG. 6. At this time, the non-image forming voltage V0 is applied to the electrode portions 101. For that reason, the toner located in the toner movement area Imd is moved onto and carried on the toner carrying roller 2 by the electrostatic force by the electric field between the image carrying member 3 and the toner carrying roller 2. The toner T2 located at the toner movement limit position iL is also similarly carried on the toner carrying roller 2. Further, the toners which include the T1 and are located downstream of the toner movement limit position iL are kept in the carried state during passing of the toner movement limit position iL.

Part (e) of FIG. 23 shows the toner state at t2 in FIG. 6. During a period from the state of (d) of FIG. 23 to the state of (e) of FIG. 23, the non-image forming voltage V0 is applied to the electrode portions 101. For that reason, the toner located in the toner movement area Imd is moved to and carried on the toner carrying roller 2 by the electrostatic force by the electric field between the planar electrode 105 and the toner carrying roller 2.

The toner T3 located at the toner movement limit position iL is also similarly carried on the toner carrying roller 2.

Further, the toners which include the toners T1 and T2 and are located downstream of the toner movement limit position iL are kept in the carried state at the time of passing through the toner movement limit position iL.

Therefore, the toner T during the application of the image forming voltage Vp is in the state in which the toner T is carried on the image carrying member 3 but the image carrying member 3 is moved in the arrow B direction at a process speed V (mm/sec), so that it is possible to form an image with a width X=V×T (mm) on the image carrying member 3.

As described above, the image formation with respect to the direction perpendicular to the image carrying member movement direction B is effected.

Next, image comparison when the position of the planar electrode 105 is changed will be described.

FIG. 24 is a schematic illustration showing the electrode contact downstream positions ie0 of the planar electrode 105 in the image comparison.

The electrode contact downstream positions ie0 in this embodiment are positions (7) to (12) and other positions ((1) to (4)) are those in a comparative embodiment. In FIG. 24, the position (12) is omitted from illustration but is located downstream of the position (11) with respect to the arrow B direction.

The image formation is effected under the following conditions.

Image carrying member movement speed: 100 mm/set
Toner carrying roller potential: +50 V
Image forming voltage Vp: +100 V
Non-image forming voltage V0: 0 V
Toner amount on toner carrying roller: 0.3 mg/cm$^2$ The image comparison was made by measuring toner amounts per unit area (mg/cm$^2$) at the image forming portion downstream position ie0 when the image forming voltage Vp was applied to the electrode portions 101 at positions (1) to (4) and (7) to (12) in FIG. 24 and when the non-image forming voltage V0 was applied to the electrode portions 101 at the positions (1) to (4) and (7) to (12) in FIG. 24.

The toner amounts at the respective electrode contact downstream portions ie0 of the electrode portions 101 are shown in Table 3 below. Part (a) of FIG. 25 is a graph showing the toner amount per unit area (M/S: mg/cm$^2$) under application of the image forming voltage Vp, and (b) of FIG. 25 is a graph showing the toner amount per unit area (M/S: mg/cm$^2$) under application of the non-image forming voltage V0.

TABLE 3

| POSITION | DISTANCE*1 (mm) | NLE* | M/S AT Vp*3 (mg/cm$^2$) | M/S AT V0*4 (mg/cm$^2$) |
|---|---|---|---|---|
| (1) | −1.3 | Ic-U | 0.151 | 0.152 |
| (2) | −1.1 | Ic | 0.152 | 0.150 |
| (3) | −0.6 | Ic | 0.152 | 0.151 |
| (4) | −0.1 | Ic | 0.151 | 0.152 |
| (7) | +0.2 | Ic-D | 0.290 | 0.009 |
| (8) | +0.5 | Ic-D | 0.290 | 0.008 |
| (9) | +1.0 | Ic-D | 0.291 | 0.009 |
| (10) | +1.5 | Ic-D | 0.292 | 0.010 |
| (11) | +2.0 | Ic-D | 0.290 | 0.008 |
| (12) | +3.0 | Ic-D | 0.291 | 0.009 |

*1"DISTANCE" represents the distance (mm) from the toner contact area downstream end id.
*2"NLE" represents the position of the needle-like electrode, "IC-U" represents the position upstream of the toner contact area Ic, "Ic" represents the position in Ic. "Ic-D" represents the position downstream of Ic.
*3"M/S AT Vp" represents the toner amount per unit area (mg/cm$^2$) at the image forming voltage Vp.
*4"M/S AT V0" represents the toner amount per unit area (mg/cm$^2$) at the non-image forming voltage V0.

From the results of Table 3 and (a) and (b) of FIG. 25, as in the constitution (at the positions (7) to (12)) of the present invention in which the electrode contact downstream positions ie0 are disposed downstream of the toner contact area downstream position id, the toner on the toner carrying roller could be sufficiently moved to the image carrying member during the application of the image forming voltage Vp. Further, the image density could be sufficiently ensured.

Further, during the application of the non-image forming voltage V0, the toner on the image carrying member could be sufficiently moved to the toner carrying roller, so that the fog at the non-image portion could be sufficiently reduced.

The above results will be described more specifically.

Next, the constitution in which the electrode downstream position ie0 is located downstream of the toner contact area downstream position id will be described.

In the constitutions (at the positions (7) to (12) shown in FIG. 24) in which the electrode contact downstream positions ie0 are located downstream of the toner contact area Ic, whether the toner is carried on the image carrying member or the toner carrying member is determined by the toner movement limit position iL.

As described above, irrespective of the state in which the toner is carried on the toner carrying roller and the state in which the toner is carried on the image carrying member, the toner located at the electrode portions 101 in which the voltage of the opposite polarity to the toner charge polarity is in Ic the carried state by the image carrying member 3, thus being subjected to the image formation. Further, the toner located at the electrode portions 101 in which the voltage of the identical polarity to the toner charge polarity is in the carried state by the toner carrying roller 2, thus being not subjected to the image formation.

Therefore, by the constitution in which the electrode contact downstream position ie0 is located downstream of the toner contact area downstream end id 2C with respect to the image carrying member movement downstream, the toner movement area Imd can be located downstream of the toner contact area downstream end id with respect to the image carrying member movement direction.

By this constitution, the image density at the image portion is ensured, so that it is possible to form the toner image with reduced fog at the non-image portion.

In the constitution in Embodiment 3, the image formation with respect to the direction crossing the image carrying member movement direction is determined by the toner movement limit position iL.

Therefore, even in a state in which the image carrying member movement direction downstream positions of the respective electrode portions provided along the direction crossing the image carrying member movement direction are different due to production non-uniformity, the image formation is determined by the toner movement limit position iL in which the toner is movable. For that reason, the image position with respect to the direction perpendicular to the image carrying member movement direction is not deviated between the respective electrodes.

Therefore, it is possible to form the image with accuracy with respect to the direction perpendicular to the image carrying member movement direction.

Incidentally, the measuring method of the toner contact area Ic between the toner carrying roller and the image carrying member, the toner movement area Imd and the electrode contact downstream position ie0 is the same as that described in Embodiment 2.

Part (c) of FIG. 21 is a schematic view showing the toner deposition state on the image carrying member after the separation of the image carrying member.

From the area in which the toner is deposited on the image carrying member, the toner contact area Ic, the toner contact ara downstream position id, the toner movement area Imd and the toner movement limit position iL can be measured.

In the toner contact area Ic, the toner is deposited on both of the toner carrying roller and the image carrying member, and the toner amount is large on the image carrying member in the toner movement area Imd. From the difference in toner amount, the toner contact area downstream end position id can be determined. Further, the toner movement limit position iL is the downstreammost position of the toner movement area Imd with respect to the image carrying member movement direction B.

By using the planar electrode 105 as in Embodiment 3, it is possible to prevent positional deviation of the electrode, so that the image carrying member and the respective electrode portions can be stably contacted at the respective positions. Therefore, it is possible to reduce a degree of deviation of pixels with respect to the image carrying member movement direction B and the direction (perpendicular to the drawing sheet direction of FIG. 13) crossing the image carrying member movement downstream B.

Further, the electrode contact position of the planar electrode is set to extend to the position downstream of the toner contact area Imd with respect to the image carrying member movement downstream. In this embodiment, the image formation with respect to the direction crossing the image carrying member movement direction is determined by the toner movement limit position iL, so that the influence on the image can be reduced even when the positional accuracy of the planar electrode with respect to the image carrying member movement direction B is low.

Embodiment 4

Next, Embodiment 4 to which the present invention is applicable will be described. Constituent members or portions identical to those in Embodiments 1, 2 and 3 are represented by the same reference numerals or symbols and will be omitted from description.

The constitution of the image forming apparatus to which the present invention is applicable and the constitution of the planar electrode 105 used as the image forming electrode are the same as those in Embodiment 2 and therefore will be omitted from description.

FIG. 26 is an enlarged schematic illustration of the image forming portion where the planar electrode 105 as the image forming electrode in the image forming apparatus 10 is disposed. In the toner contact area Ic, the planar electrode 105 has a substantially flat surface as shown in FIG. 26.

In this embodiment, as shown in FIG. 26, the toner T on the toner carrying roller 2 contacts the image carrying member 3 to provide the toner contact area Ic.

The planar electrode 105 is disposed opposite from the toner carrying roller 2 with respect to the image carrying member 3, and the electrode portions 101 of the planar electrode 105 are disposed in contact with the image carrying member 3.

The electrode contact downstream position ie0 which is the contact position of the electrode portions 101 to the image carrying member 3 at a downstream side with respect to the image carrying member movement direction is located downstream of the toner contact area Ic with respect to the image carrying member movement direction B.

The position iL shown in FIG. 26 is a toner movement limit position in which the toner can be moved from the toner carrying roller 2 to the image carrying member 3 when the image forming voltage (bids) Vp is applied to the electrode portions 101.

In this embodiment, the electrode contact downstream position ie0 of the planar electrode 105 is located downstream of the toner movement limit position iL with respect to the image carrying member movement direction.

Further, an electrode contact upstream downstream position ieu is located upstream of the toner contact area Ic with respect to the image carrying member movement direction.

As described above in the constitution in this embodiment, also in such a constitution that the electrode contact upstream position ieu is located upstream of the toner contact area Ic with respect to the image carrying member movement direction, the image formation is effected in the toner movement area Imd. Further, during the application of the image forming voltage Vp, the toner on the toner carrying roller could be sufficiently moved to the image carrying member, so that it was possible to sufficiently ensure the image density.

Further, during the application of the non-image forming voltage V0, the toner on the image carrying member could be sufficiently moved to the toner carrying roller, so that the fog at the non-image portion could be sufficiently reduced.

By using the planar electrode 105 as in Embodiment 4, it is possible to prevent positional deviation of the electrode, so that the image carrying member and the respective electrode portions can be stably contacted at the respective positions. Therefore, it is possible to reduce a degree of deviation of pixels with respect to the image carrying member movement direction B and the direction (perpendicular to the drawing sheet direction of FIG. 13) crossing the image carrying member movement downstream B.

Further, in this embodiment, the electrode contact position of the planar electrode is set to extend to the position downstream of the toner contact area Imd with respect to the image carrying member movement downstream. In this embodiment, the image formation with respect to the direction crossing the image carrying member movement direction is determined by the toner movement limit position iL, so that the influence on the image can be reduced even when the positional accuracy of the planar electrode with respect to the image carrying member movement direction B.

Further, the image can be formed irrespective of the upstream position of the planar electrode with respect to the image carrying member movement direction, so that it becomes possible to effect the image formation even when the positional accuracy between the planar electrode and the toner carrying member is low.

Embodiment 5

Next, Embodiment 5 to which the present invention is applicable will be described. Constituent members or portions identical to those in Embodiments 1, 2, 3 and 4 are represented by the same reference numerals or symbols and will be omitted from description.

The constitution of the image forming apparatus to which the present invention is applicable and the constitution of the planar electrode used as the image forming electrode are the same as those in Embodiment 2 and therefore will be omitted from description.

FIG. 27 is an enlarged schematic illustration of the image forming portion where the planar electrode 105 as the image forming electrode in the image forming apparatus 10 is disposed. In the toner contact area Ic, the planar electrode 105 has a substantially flat surface as shown in FIG. 27.

In this embodiment, as shown in FIG. 27, the toner T on the toner carrying roller 2 contacts the image carrying member 3 to provide the toner contact area Ic.

The planar electrode 105 is disposed opposite from the toner carrying roller 2 with respect to the image carrying member 3, and the electrode portions 101 of the planar electrode 105 are disposed opposed to the image carrying member 3 with an electrode gap Eg.

The electrode gap Eg in this embodiment is 20 μm and is kept by a thickness of an unshown electrode-image carrying member spacing member disposed at a longitudinal end portion of the planar electrode 105. As the electrode-image carrying member spacing member, an insulating resin sheet was used.

The electrode downstream position ie0 at a downstream side with respect to the image carrying member movement direction is located downstream of the toner contact area Ic with respect to the image carrying member movement direction B.

The position iL shown in FIG. 27 is a toner movement limit position in which the toner can be moved from the toner carrying roller 2 to the image carrying member 3 when the image forming voltage (bias) Vp is applied to the electrode portions 101.

In this embodiment, the electrode downstream position ie0 of the planar electrode 105 is located downstream of the toner movement limit position iL with respect to the image carrying member movement direction.

Further, an electrode upstream position ieu of the planar electrode 105 is located upstream of the toner contact area Ic with respect to the image carrying member movement direction.

The image forming process with respect to the image carrying member movement direction will be described.

In this embodiment, the case where the voltage is applied to the electrode portions 101 with timing as shown in FIG. 6 will be described as an example. Parts (a) to (e) of FIG. 28 are schematic illustrations each showing the toner state between the toner carrying roller 2 and the image carrying member 3. Parts (a) to (e) of FIG. 28 show states, in which the voltage shown in FIG. 6 is applied, immediately before and after t1, immediately before and after t2 and at t3, respectively.

Part (a) of FIG. 28 shows the toner state immediately before t1 in FIG. 6. At this time, the non-image forming voltage V0 is applied to the electrode portions 101. For that reason, the toner is carried on the toner carrying roller 2 by the electrostatic force by the electric field between the electrode portions 101 and the toner carrying roller 2.

The toner T1 located at the toner movement limit position iL is also similarly carried on the toner carrying roller 2.

Part (b) of FIG. 28 shows the toner state immediately after t1 in FIG. 6. At this time, the image forming voltage Vp is applied to the electrode portions 101. For that reason, the toner located in the toner contact area Imd is moved to and carried on the image carrying member 3 by the electrostatic force by the electric field between the planar electrode 105 and the toner carrying roller 2. The toner located at the toner movement limit position iL is also similarly carried on the image carrying member 3. The toner located downstream of the toner movement limit position iL is kept in the toner carried state by the toner carrying roller 2.

Next, (c) of FIG. 28 shows the toner state immediately before t2 in FIG. 6. During a period from the state of (b) of FIG. 28 to the state of (c) of FIG. 28, the image forming voltage Vp is applied to the electrode portions 101. For that reason, the toner located in the toner movement area Imd is moved to and continuously carried on the image carrying member 3 by the electrostatic force by the electric field between the planar electrode 105 and the toner carrying roller 2.

The toner T2 located at the toner movement limit position iL is also similarly carried on the image carrying member 3. The toners including the toner T1 located downstream of the toner movement limit position iL is kept in the state of the toner carried during the passing through the toner movement limit position iL.

Next, (d) of FIG. 28 shows the toner state immediately after t2 in FIG. 6. At this time, the non-image forming voltage V0 is applied to the electrode portions 101. For that reason, the toner located in the toner movement area Imd is moved onto and carried on the toner carrying roller 2 by the electrostatic force by the electric field between the image carrying member 3 and the toner carrying roller 2. The toner T2 located at the toner movement limit position iL is also similarly carried on the toner carrying roller 2. Further, the toners which include the T1 and are located downstream of the toner movement limit position iL are kept in the carried state during passing of the toner movement limit position iL.

Part (e) of FIG. 28 shows the toner state at t2 in FIG. 6. During a period from the state of (d) of FIG. 28 to the state of (e) of FIG. 28, the non-image forming voltage V0 is applied to the electrode portions 101. For that reason, the toner located in the toner movement area Imd is moved to and carried on the toner carrying roller 2 by the electrostatic force by the electric field between the planar electrode 105 and the toner carrying roller 2.

The toner T3 located at the toner movement limit position iL is also similarly carried on the toner carrying roller 2.

Further, the toners which include the toners T1 and T2 and are located downstream of the toner movement limit position iL are kept in the carried state at the time of passing through the toner movement limit position iL.

Therefore, the toner T during the application of the image forming voltage Vp is in the state in which the toner T is carried on the image carrying member 3 but the image carrying member 3 is moved in the arrow B direction at a process speed V (mm/sec), so that it is possible to form an image with a width X=V×T (mm) on the image carrying member 3.

As described above, the image formation with respect to the direction perpendicular to the image carrying member movement direction B is effected. Specifically, in this embodiment, the image formation is effected in the toner movement area Imd. Further, the toner on the toner carrying roller could be sufficiently moved to the image carrying member during the application of the image forming voltage Vp, so that the image density could be sufficiently ensured.

Further, during the application of the non-image forming voltage V0, The toner on the image carrying member could be sufficiently moved to the toner carrying roller, so that the fog at the non-image portion could be sufficiently reduced.

Further, in this embodiment, the electrode position of the planar electrode is set to extend to the position downstream of the toner contact area Imd with respect to the image carrying member movement downstream. In this embodiment, the image formation with respect to the direction crossing the image carrying member movement direction is determined by the toner movement limit position iL, so that the influence on the image can be reduced even when the positional accuracy of the planar electrode with respect to the image carrying member movement direction B is low.

Further, the image can be formed irrespective of the upstream position of the planar electrode with respect to the image carrying member movement direction, so that it becomes possible to effect the image formation even when the positional accuracy between the planar electrode and the toner carrying member is low.

Further, it is possible to prevent abrasion (wearing) of the electrode portions due to sliding movement between the electrode portions and the image carrying member.

As in this embodiment, in the constitution in which the electrode portions 101 of the planar electrode 105 and the image carrying member 103 are disposed and spaced with the electrode gap Eg, compared with the constitution in which the electrode portions 101 and the image carrying member 3 are disposed in contact with each other as in Embodiment 1 to Embodiment 4, a distance of the electrode portions 101 from each of the toner on the toner carrying roller 2 and the toner on the image carrying member 103 is increased. Therefore, in the constitution in Embodiment 5, compared with the electrode contact constitution, there is a need to increase the voltage applied to the electrode. As a result, the voltage applied to the electrode can be decreased in the electrode contact constitution as in Embodiments 1 to 4 compared with this embodiment.

Embodiment 6

Next, Embodiment 6 to which the present invention is applicable will be described. Constituent members or portions identical to those in Embodiments 1 to 5 are represented by the same reference numerals or symbols and will be omitted from description.

The constitution of the image forming apparatus to which the present invention is applicable and the constitution of the planar electrode 105 used as the image forming electrode are the same as those in Embodiment 2 and therefore will be omitted from description. A difference from Embodiment 2 is that an electrode power source 111 of the electrode power source controller 110 is connected to the electrode portions 101 via an electrode driving portion 103 at a position downstream of the downstream position id of the toner contact area Ic with respect to the image carrying member movement direction B.

Part (a) of FIG. 30 is an enlarged schematic illustration of the image forming portion where the planar electrode 105 as the image forming electrode in the image forming apparatus 10 is disposed. In the toner contact area Ic, the planar electrode 105 has a substantially flat surface as shown in (a) of FIG. 30.

In this embodiment, as shown in (a) of FIG. 30, the toner T on the toner carrying roller 2 contacts the image carrying member 3 to provide the toner contact area Ic.

The planar electrode 105 is disposed opposite from the toner carrying roller 2 with respect to the image carrying member 3, and the electrode portions 101 of the planar electrode 105 are disposed in contact with the image carrying member 3.

The electrode contact downstream position ie0 which is the contact position of the electrode portions 101 to the image carrying member 3 at a downstream side with respect to the image carrying member movement direction is located downstream of the toner contact area Ic with respect to the image carrying member movement direction B.

Part (b) of FIG. 30 is a schematic illustration of the image carrying member contact surface of the planar electrode 105. The position iL shown in (b) FIG. 30 is a toner movement limit position in which the toner can be moved from the toner carrying roller 2 to the image carrying member 3 when the image forming voltage (bias) Vp is applied to the electrode portions 101.

In this embodiment, the electrode contact downstream position ie0 of the planar electrode 105 is located downstream of the toner movement limit position iL with respect to the image carrying member movement direction.

Further, an electrode contact upstream downstream position ieu is located upstream of the toner contact area Ic with respect to the image carrying member movement direction.

As shown in (b) of FIG. 30, the electrode driving portion 103 is disposed downstream of the electrode portions 101 with respect to the image carrying member movement direction B. In this embodiment, the electrode driving portion 103 is connected to the electrode portions 101 at the position downstream of the toner contact area Ic and thus supplies the image forming voltage Vp and the non-image forming voltage V0 to the electrode portions 101.

As described above in the constitution in this embodiment, also in such a constitution that the electrode driving portion 103 is connected to the electrode portions 101 at the position downstream of the toner contact area Ic, the image formation was effected in the toner movement area Imd. Further, during the application of the image forming voltage Vp, the toner on the toner carrying roller could be sufficiently moved to the image carrying member, so that it was possible to sufficiently ensure the image density.

Further, during the application of the non-image forming voltage V0, the toner on the image carrying member could be sufficiently moved to the toner carrying roller, so that the fog at the non-image portion could be sufficiently reduced.

By using the planar electrode 105 as in Embodiment 6, it is possible to prevent positional deviation of the electrode, so that the image carrying member and the respective electrode portions can be stably contacted at the respective positions. Therefore, it is possible to reduce a degree of deviation of pixels with respect to the image carrying member movement direction B and the direction (perpendicular to the drawing sheet direction of FIG. 13) crossing the image carrying member movement downstream B.

Further, in this embodiment, the electrode contact position of the planar electrode is set to extend to the position downstream of the toner contact area Imd with respect to the image carrying member movement downstream. In this embodiment, the image formation with respect to the direction crossing the image carrying member movement direction is determined by the toner movement limit position iL, so that the influence on the image can be reduced even when the positional accuracy of the planar electrode with respect to the image carrying member movement direction B.

Further, the image can be formed irrespective of the upstream position of the planar electrode with respect to the image carrying member movement direction, so that it becomes possible to effect the image formation even when the positional accuracy between the planar electrode and the toner carrying member is low.

A superiority of the constitution in this embodiment will be described. In this embodiment, in order to create the toner contact area Ic, the toner carrying roller 2 is urged toward the planar electrode 105 via the toner T and the image carrying member 3. Further, the image carrying member 3 is rotationally moved in the arrow B direction at a predetermined process speed. For this reason, the planar electrode 105 slides with the image carrying member 3 while receiving an urging force from the toner carrying roller 2 in the toner contact area Ic. For that reason, the planar electrode 105 can be abraded and broken in the toner contact area Ic. Comparison in this case will be described with reference to (a) and (b) of FIG. 31. In (a) of FIG. 31, the electrode power source 111 of the electrode power source controller 110 is connected to the electrode portions 101 via the electrode driving portion 103 at the electrode contact upstream position ieu, and (a) of FIG. 13 is an enlarged schematic illustration of the image forming portion in the case where the electrode is worn and broken in the toner contact area Ic. A state in which the electrode portions 101 are worn and broken in an area between an electrode breaking upstream position ie1 and an electrode breaking downstream ie2 is shown.

As shown in (a) of FIG. 31, in the case where the electrode driving portion 103 is connected to the electrode portions 101 at the electrode contact upstream position ieu and the electrode portions 101 cause electrical disconnection, the image forming voltage Vp and the non-image forming voltage V0 cannot be supplied to the electrode portions 101 located downstream of the disconnection portion from the electrode breaking downstream position ie2 with respect to the image carrying member movement direction B. Therefore, the image forming voltage Vp and the non-image forming voltage V0 are not supplied to the electrode portions 101 in the toner movement area Imd, so that the image formation cannot be effected.

Part (b) of FIG. 31 is an enlarged schematic illustration of the image forming portion in the case where the electrode portions 101 are worn and broken in the toner contact area Ic in this embodiment. Similarly as in (a) of FIG. 31, a state in which the electrode portions 101 are worn and broken in an area between an electrode breaking upstream position ie1 and an electrode breaking downstream ie2 is shown.

As shown in (b) of FIG. 31, in this embodiment, in the case where the electrode portions 101 are worn and broken, the image forming voltage Vp and the non-image forming voltage V0 can be supplied to the electrode portions 101 from the downstream position id of the toner contact area Ic. For that reason, to the electrode portions 101 extending from the electrode breaking downstream position ie2 to the downstream end thereof with respect to the image carrying member movement direction, it is possible to supply the image forming voltage Vp and the non-image forming voltage V0. Therefore, the voltage can be supplied to the electrode portions 101 in the toner movement area Imd, so that the image formation can be continuously effected.

As in this embodiment, the electrode portions 101 are electrically connected to the electrode power source 111 (voltage source) at the position downstream of the toner contact area Ic with respect to the image carrying member movement direction B, so that the above-described effect can be obtained. Incidentally, the electrical connection between the electrode power source 111 and the electrode portions 101 is not limited to direct electrical connection.

Embodiment 7

Next, Embodiment 7 to which the present invention is applicable will be described. Constituent members or portions identical to those in Embodiments 1 to 6 are represented by the same reference numerals or symbols and will be omitted from description.

The constitution of the image forming apparatus to which the present invention is applicable and the constitution of the planar electrode 105 used as the image forming electrode are the same as those in Embodiment 2 and therefore will be omitted from description.

When the image formation is effected by the image forming apparatus in which the planar electrode is flat as in Embodiments 3 and 4, there arises a problem that an image which is distorted, with respect to original image data, toward an image carrying member movement direction upstream side at its boundary portions with respect to an image carrying member widthwise direction is outputted.

Parts (a) to (c) of FIG. 32 are schematic views for illustrating the problem. Part (a) of FIG. 32 shows image data in a checkered pattern with 3-dot width. Part (b) of FIG. 32 shows a distorted image in the case where the image data shown in (a) of FIG. 32 is actually used for the image formation. Hereinafter, such a distorted image is referred to as a "distortion image" Part (c) of FIG. 32 shows one-pixel image of a plurality of the distortion images shown in (b) of FIG. 32. In (c) of FIG. 32, E1 represents an image portion boundary line with respect to a downstream (image carrying member widthwise direction) perpendicular to the image carrying member movement direction B.

The image distortion is such a phenomenon that when the image forming voltage Vp and the non-image forming voltage V0 are applied between the adjacent electrodes, the image is distorted, with respect to an ideal image, toward the image carrying member movement direction B upstream side with a distance closer to the image portion boundary line E1 as shown in (c) of FIG. 32. This phenomenon occurs due to the electric field, at a space portion located between an electrode portion supplied with the image forming voltage Vp and an electrode portion supplied with the non-image forming voltage V0, smaller than the electric field on the electrode portion supplied with the image forming voltage Vp.

This phenomenon will be specifically described with reference to FIGS. 33, 34 and 35 by using the case where an image with one-dot width is formed on the image carrying member as an example.

An upper part of FIG. 33 is a schematic view of the toner contact area Ic formed between the toner carrying roller 2 and the image carrying member 3 and the toner movement area Imd located upstream of the toner contact area Ic as seen from the toner carrying roller 2 side, and the image carrying member 3 is illustrated as a transparent portion. At the upper part of FIG. 33, the positions iu, id, iL and ie0 are the toner contact area upstream position, the toner contact area downstream position, the toner movement limit position and the electrode contact downstream position to the image carrying member, respectively, as described with reference to FIG. 22.

Here, the toner movement limit position iL is a limit position in which the toner can be moved from the toner carrying roller 2 to the image carrying member 3 when the image forming voltage (bias) Vp is applied in the constitution in which the electrode portions 101 is sufficiently long with respect to the image carrying member movement direction.

Further, the electrode portions 101*a*, 101*b* and 101*c* of the planar electrode 105 are disposed at a plurality of positions with width and interval correspondingly to a resolution of the image forming apparatus with respect to the image carrying member widthwise direction. In FIG. 33, the electrode portions other than the electrode portions 101*a*, 101*b* and 101*c* are omitted from illustration. In an area indicated by (X) in FIG. 33, the toner is moved from the toner carrying roller 2 to the image carrying member 3.

At a lower part of FIG. 33, a potential distribution on the image carrying member with respect to the image carrying member movement direction in an area in which the electrode portions 101*a*, 101*b* and 101*c* contact the image carrying member 3 is shown. The potential distribution shows a peak at the central electrode portion 101*b* to which the image forming voltage Vp is applied and is gradually lowered from the peak to zero at the adjacent electrode portions 101*a* and 101*c* to which the non-image forming voltage V0 is applied. This potential distribution is constant on the image carrying member to which the electrode portions are contacted.

However, the toner carrying roller has curvature and therefore the distance between the toner carrying roller and the image carrying member is increased at the position closer to the downstream position. As a result, the magnitude of the electric field is gradually decreased from the toner contact area downstream position id to a further downstream position.

Therefore, the electric field at the boundary between the toner moved to the image carrying member and the toner which is not moved to the image carrying member has a dot width corresponding to one dot in the neighborhood of the toner contact area downstream position id but substantially has the electrode width in the neighborhood of the downstream movement limit position iL. Incidentally, herein, the dot width corresponding to one pixel refers to a distance between the center lines of adjacent two electrode portions. That is, the toner movement range becomes narrower at the position closer to the downstream end and as a result, the toner is moved to the image carrying member in the area (X) as defined in FIG. 33.

The toner movement limit position iL with respect to the image carrying member movement direction is the downstream end of the toner movement area Imd on the central electrode portion 102*b* (E0) as described with reference to FIG. 22. On the other hand, at the center position, of the space between the adjacent electrode portions, indicated by the broken line (E1), a movement limit position iL' is located upstream of the position iL since the electric field is small at the downstream side, so that the toner movement area is decreased to an area Imd'.

In the above, the moment when the image forming voltage Vp is applied to only the central electrode portion 102*b* is described. When the image forming voltage Vp is continuously applied as it is, the toner movement after the movement is effected in the area Imd', so that the one-dot width image formed on the image carrying member is not narrowed (FIG. 34).

Further, as the moment when the state in which the image forming voltage Vp is applied to the central electrode portion is shifted to the state in which the non-image forming voltage is applied, the direction of the electric field is reversed, so that only the toner on the image carrying member in the area (X) is returned to the toner carrying member (FIG. 35). As a result, the distortion image such that the image boundary portions are distorted toward the upstream side with respect to the image carrying member movement direction as shown in (b) of FIG. 32 is formed.

Incidentally, in FIGS. 33 to 35, the case where the one-dot width image is formed on the image carrying member is described as the example but images with a width more than the one-dot width similarly provide the distortion image.

In order to reduce the distortion image, a decrease of a difference between the toner movement area Imd on the electrode in which the image forming voltage Vp is applied as shown in FIG. 31 and the toner movement area Imd' in the space between the adjacent electrode portions, i.e., |Imd–Imd'| by a narrowing the toner movement area Imd is effective.

Next, with respect to the distortion image, the constitution in this embodiment will be described in comparison with the constitution in Embodiment 4.

FIG. 36 is a graph showing a relationship between the image carrying member movement direction B (abscissa) and the electrostatic force Fe acting on the toner T (ordinate). In FIG. 36, a solid line (E0) represents a curve of the toner T at cross sections thereof shown in FIGS. 33 to 35, and a chain line (E1) represents a curve of the toner T at cross sections thereof shown in FIGS. 33 to 35.

With a closer distance between the toner T on the toner carrying roller 2 and the image carrying member 3, the toner T strongly receives the electrostatic force Fe by the electric field generated by the voltage applied to the image forming electrode. As shown in FIG. 36, the electrostatic force Fe acting on the toner T becomes small since the distance between the toner carrying roller and the image carrying member is increased from the toner contact area downstream position id toward the downstream direction with respect to the toner carrying member movement direction B.

Further, the electric field acting on the toner at different positions with respect to the image carrying member width direction will be studied. Here, the positions with respect to the image carrying member movement direction are the same. The electric field is strongest on the electrode portions 101 and is gradually weakened at the position closer to the broken line (E1) between the electrode portion 101*b* and the electrode portion 101*a* (101*c*). Therefore, as shown in FIG. 36, the electrostatic force Fe acting on the toner T on the curve indicated by the broken line (E1) is smaller than that on the curve indicated by the solid line (E0).

At the toner movement limit position, the electrostatic force Fe acting on the toner is substantially equal to the non-electrostatic deposition force Fad (or Fai). For that reason, as shown in FIG. 36, the toner movement limit position at each cross-sectional position is determined, so that the movement limit position iL' on the curve of the broken line (E1) is located upstream of the movement limit position iL on the curve of the solid line (E0).

FIGS. 37 and 38 are enlarged schematic illustrations each showing the image forming portion in compared Embodiment 4, and FIG. 39 includes timing charts of the voltage applied to the electrode portions.

Part (a) of FIG. 39 is the timing chart of the voltage applied to the electrode portion 101*b*, and (b) of FIG. 39 is the timing chart of the voltage applied to the electrode portions 101*a* and 101*c*.

Parts (a) and (b) of FIG. 37 show the toner formation state on the image carrying member immediately after t1.

Parts (a) and (b) of FIG. 37 show the toner formation state on the image carrying member immediately after t2.

In each of FIGS. 37 and 38, (a) is a sectional view taken along the broken line (E0) in FIG. 33, and (b) is a sectional view taken along the broken line (E1) in FIG. 33. As shown in FIG. 37, at the timing t1 when the application of the image forming voltage Vp is started, due to the difference in toner movement limit position between the cross-sectional positions of (E0) and (E1), the area of the toner moved from the toner carrying roller 2 to the image carrying member 3 is different.

$$iL > iL'$$

$$Imd > Imd'$$

Therefore, the image leading end portion is distorted with respect to the image carrying member movement direction.

Further, as shown in FIG. 38, at the timing t2 when the application of the image forming voltage Vp is ended, due to the difference in toner movement limit position between the cross-sectional positions of (E0) and (E1), the area of the toner moved from the image carrying member 3 to the toner carrying roller 2 is different.

$$iL > iL'$$

$$Imd > Imd'$$

Therefore, the image trailing end portion is distorted with respect to the image carrying member movement direction.

The image formation in Embodiment 7 will be described.

Parts (a) and (b) of FIG. 40 are schematic illustrations showing the image forming area in the constitution in Embodiment 7. Part (a) of FIG. 40 is a schematic view of the image forming area as seen from the toner carrying roller 2 side similarly as in the upper part of FIG. 33 and the image carrying member 3 is illustrated as a transparent portion. Part (b) of FIG. 40 shows the one-pixel image formed on the image carrying member 3 in this embodiment. In the state of (a) of FIG. 40, the image forming voltage Vp is applied to the electrode portion 101*b*, and the non-image forming voltage V0 is applied to the electrode portions 101*a* and 101*c*.

In the constitution in this embodiment, the electrode contact downstream position ie0 is located upstream of the toner movement limit position iL in the constitution in compared Embodiment 4.

Therefore, the toner movement area Imd0 in which the toner on the electrode portion 101*b* is moved is located between the image carrying member movement direction downstream end Id of the toner contact area Ic and the contact downstream position ie0 of the electrode portions 101.

iL0 represents the toner movement limit position at the position (E0) on the electrode portion 101*b*, and iL' represents the Loner movement limit position at the position (E1) between the electrode portions 101*b* and 101*c*.

The toner contact limit position iL0 in the constitution in this embodiment is the limit position in which the toner can be moved from the toner carrying roller 2 to the image carrying member 3 when the image forming voltage (bias) Vp is applied, but is determined by the electrode contact downstream position ie0.

As shown in FIG. 40, at the position (E0) on the electrode portion 101*b*, the toner located until the toner movement limit position iL0 with respect to the image carrying member movement direction can be moved to the image carrying member. On the other hand, at the position (E1) between the electrode portions 101*b* and 101*c*, only the toner located until the toner movement limit position iL' can be moved to the image carrying member.

FIGS. 41 and 42 are enlarged schematic illustrations each showing the image forming portion in Embodiment 7, and FIG. 39 includes timing charts of the voltage applied to the electrode portions.

Parts (a) and (b) of FIG. 41 show the toner formation state on the image carrying member immediately after t1.

Parts (a) and (b) of FIG. 42 show the toner formation state on the image carrying member immediately after t2.

In each of FIGS. 41 and 42, (a) is a sectional view taken along the broken line (E0) in FIG. 33, and (b) is a sectional view taken along the broken line (E1) in FIG. 33. As shown in FIG. 41, at the timing t1 when the application of the image forming voltage Vp is started, due to the difference in toner movement limit position between the cross-sectional positions of (E0) and (E1), the area of the toner moved from the toner carrying roller 2 to the image carrying member 3 is different.

$$iL0 > iL'$$

$$Imd0 > Imd'$$

Therefore, the image leading end portion is distorted with respect to the image carrying member movement direction.

Further, as shown in FIG. 38, at the timing t2 when the application of the image forming voltage Vp is ended, due to the difference in toner movement limit position between the cross-sectional positions Ic of (E0) and (E1), the area of the toner moved from the image carrying member 3 to the toner carrying roller 2 is different.

$$iL>iL'$$

$$Imd>Imd'$$

Therefore, the image trailing end portion is distorted with respect to the image carrying member movement direction.

However, the difference |Imd0−Imd'| between the toner movement area Imd0 and the toner movement area Imd' in the space between the electrode portions is smaller than that constituted in compared Embodiment 4, so that the distortion image is suppressed.

$$|Imd0-Imd'|>|Imd-Imd'|$$

Further, as shown in FIG. 42, at the timing t2 when the application of the image forming voltage Vp is ended, due to the difference in toner movement limit position between the cross-sectional positions of (E0) and (E1), the area of the toner moved from the image carrying member 3 to the toner carrying roller 2 is different.

$$iL>iL'$$

$$Imd>Imd'$$

Therefore, the image trailing end portion is distorted with respect to the image carrying member movement direction.

However, the difference |Imd0−Imd'| between the toner movement area Imd0 and the toner movement area Imd' in the space between the electrode portions is smaller than that in the constituted in compared Embodiment 4, so that the distortion image is suppressed.

$$|Imd0-Imd'|>|Imd-Imd'|$$

As described above, in the constitution in Embodiment 7, the area in which the toner movement limit position is moved toward the upstream side with respect to the image carrying member movement direction is decreased and thus the image deformation area is reduced, so that the distortion image is suppressed.

Further, in the constitution in this embodiment, the image formation is effected in the toner movement area Imd and during the application of the image forming voltage Vp, the toner on the toner carrying roller could be sufficiently moved to the image carrying member, so that it was possible to sufficiently ensure the image density.

Further, during the application of the non-image forming voltage V0, the toner on the image carrying member could be sufficiently moved to the toner carrying roller, so that the fog at the non-image portion could be sufficiently reduced.

By using the planar electrode 105 as in Embodiment 7, it is possible to prevent positional deviation of the electrode, so that the image carrying member and the respective electrode portions can be stably contacted at the respective positions. Therefore, it is possible to reduce a degree of deviation of pixels with respect to the image carrying member movement direction B and the direction crossing the image carrying member movement downstream B.

Further, the image can be formed irrespective of the upstream position of the planar electrode with respect to the image carrying member movement direction, so that it becomes possible to effect the image formation even when the positional accuracy between the planar electrode and the toner carrying member is low.

Embodiment 8

Next, Embodiment 8 to which the present invention is applicable will be described. Constituent members or portions identical to those in Embodiments 1 to 7 are represented by the same reference numerals or symbols and will be omitted from description.

As a method of alleviating the above-described distortion image, in Embodiment 7, the example in which the electrode contact downstream position ie0 with respect to the image carrying member movement direction is located in the toner movement area Imd is described. However, in order to dispose the electrode portions in the small toner movement area with accuracy, e.g., part processing accuracy is required to be improved and the device structure is required to be complicated, thus resulting in an increased cost.

Therefore, in order to improve the distortion image by a more inexpensive method, this embodiment is characterized in that the image carrying member is disposed so that in a cross section perpendicular to the image carrying member widthwise direction, the surface constituting the toner movement area on the image carrying member and the surface constituting the toner movement area on the toner carrying roller are present opposed to each other with respect to a rectilinear line connecting the upstream end and downstream end of the toner contact area.

FIG. 43 is an enlarged schematic illustration of the image forming portion in this embodiment.

In FIG. 43, the toner carrying roller 2 is an elastic roller having a radius of curvature R1 of o5.75 mm at its surface and is rotationally driven in an arrow A direction in a state in which the toner is carried on its surface. The image carrying member 3 having a radius of curvature R2 is moved in an arrow B direction at a predetermined speed.

The planar electrode 105 (flexible printed board) fixed and supported by an electrode stay 131 is constituted by the plurality of electrode portions 101 contacting the image carrying member 3. Further, to the electrode portions 101, the electrode driving portion 103 and the electrode voltage controller 110 are connected.

The electrode stay 103 is a stainless cylinder of 2.4 mm in radius and on the surface thereof, the electrode base material 102 of the planar electrode 105 is adhesively fixed to provide a predetermined radius of curvature (2.45 mm) to the electrode portions 101. Further, by fixing the electrode stay 103 with high accuracy, the electrode portions 101 are configured and located at the position in which they oppose the toner carrying roller 2 via the image carrying member 3.

Further, the image carrying member 3 is constituted so that a predetermined tension is applied by an unshown stretching roller. The image carrying member 3 follows the curvature of the electrode portions 101, so that the image carrying member surface has a desired radius of curvature (2.5 mm in this embodiment).

A tangential line of a nip between the toner carrying roller 2 and the image carrying member 3 is C and thereon, the toner contact area Ic, the toner contact area upstream position iu, the toner contact area downstream position id and the electrode contact downstream position ie0 and defined with respect to the image carrying member movement downstream. The nip tangential line C is, in other words, the rectilinear line connecting the upstream end and downstream end of the toner contact area Ic. Further, downstream of the toner contact area Ic, the toner movement area Imd is located. The toner movement limit position iL in which the toner can be moved from the toner carrying roller 2 to the image carrying member 3 when the image forming voltage Vp is applied determines the length of the toner movement area Imd.

As described above, by decreasing the radius of curvature of the image carrying member 3, the gap between the toner carrying roller 2 and the image carrying member 3 is gradually increased at the position closer to the downstream side with respect to the image carrying member movement direction and therefore the electrostatic force acting on the toner T is abruptly lowered compared with the curves shown in FIG. 36. As a result, the length of the toner movement area Imd is shorter than that in the case where the image carrying member 3 is flat, so that the difference |Imd−Imd'| between the toner movement area Imd and the toner movement area Imd' in the space between the electrode portions can be decreased.

Specifically, with respect to the toner movement area Imd and the distortion image, a comparison between this embodiment and Embodiment 4 in which the electrode shape is flat was made.

The image formation is effected under the following condition.

Image carrying member movement speed: 80 mm/set

Image forming voltage Vp: +50 V

Non-image forming voltage V0: −50 V

Toner carrying roller potential: 0V

In FIG. 4 below, a comparison result of the toner contact area Ic, the toner movement area Imd and an aspect ratio of the dot image which is an index indicating a degree of distortion of the distortion image is shown. The measuring method of the toner contact area Ic and the toner movement area Imd is as described above with reference to (c) of FIG. 21 and thus will be omitted from description.

Further, the aspect ratio of the dot image was obtained in the following manner.

First, the checkered pattern image of 3 dots×3 dots is outputted on the image carrying member and then the image forming apparatus is stopped.

Next, a picture of the image on the image carrying member is taken to obtain the checkered pattern image of 3 dots×3 dots similar to that shown in FIG. 32. The lengths of one-dot image with respect to the image carrying member movement direction V' and the image carrying member widthwise direction H (FIG. 44) are measured and its ratio (V'/L) is calculated as the aspect ratio. Therefore, when the aspect ratio of the dot image is closer to 1, the degree of the distortion is smaller.

TABLE 4

| | EMB. 7 | EMB. 4 |
|---|---|---|
| Radius of curvature (mm) | 2.5 | Infinite |
| Ic (mm) | 0.7 | 1.1 |
| Imd (mm) | 0.12 | 0.3 |
| Aspect ratio | 1.1 | 2 |

In this embodiment in which the radius of curvature of the image carrying member is small, it is understood that the toner movement area Imd is small and simultaneously the dot image aspect ratio is closer to 1. In this embodiment, the toner movement area Imd can be narrowed by a relatively simple constitution such that the curvature is provided to the image carrying member and therefore the distortion image can be alleviated even when the electrode portion somewhat varies with respect to the image carrying member movement direction, so that an increase in cost can be prevented.

As described above, an effect of alleviating the distortion image is higher with a smaller radius of curvature of the image carrying member but the radius of curvature in this embodiment may preferably be 1 mm to 5 mm.

This is because the toner movement area Imd is increased and thus the distortion image alleviating effect cannot be achieved when the radius of curvature of the image carrying member is larger than 5 mm and because it is difficult to bring the electrode portions into contact with the image carrying member when the radius of curvature of the image carrying member is smaller than 1 mm. However, in order to realize a uniform contact state of the electrode portions, the pressure between the toner carrying roller and the electrode portions may be increased or the electrode stay may be formed of a high-rigidity material, so that the contact state is improved and therefore the value of the radius of curvature is not limited to the above values.

In the above constitution, the shapes of the planar electrode and the image carrying member are provided with the curvature with respect to the image carrying member movement direction but as shown in FIG. 45, the distortion image can be alleviated by employing a constitution in which the electrode portions 101 are formed on the insulating electrode base material 102 provided with a slope at a downstream side in advance and thus the distance between the image carrying member and the toner carrying member is increased at the downstream side of the toner contact area Ic.

By employing such a constitution, compared with the constitution as in Embodiment 7 in which the contact position of the flat electrode with respect to the image carrying member movement direction is defined, there is the advantage such that the electrode positional accuracy with respect to the image carrying member movement direction can be alleviated. This is because the toner carrying roller is the elastic member and therefore the toner movement limit position iL is located at the slope portion of the image carrying member even when a bending point (pd in FIG. 45) between the flat portion and slope portion of the electrode portions on the image carrying member is somewhat shifted to the upstream side with respect to the image carrying member movement direction.

In any cases, in the cross section perpendicular to the image carrying member widthwise direction, it becomes possible to alleviate the distortion image when the image carrying member is disposed so that the toner movement area surface of the image carrying member and the toner movement area surface of the toner carrying roller are present opposed to each other with respect to the rectilinear line connecting the upstream end and downstream end of the toner contact area.

INDUSTRIAL APPLICABILITY

According to the present invention, it is possible to provide an image forming apparatus capable of ensuring the image density at the image portion and capable of reducing the fog at the non-image portion.

While the invention has been described with reference to the structures disclosed herein, it is not confined to the details set forth and this application is intended to cover such modifications or changes as may come within the purpose of the improvements or the scope of the following claims.

The invention claimed is:

1. An image forming apparatus comprising:

a toner carrying roller for carrying a toner;

an image carrying member, contacting the toner on said toner carrying roller, on which a toner image is to be formed with the toner; and an electrode portion provided at an opposing position in which said electrode portion opposes said toner carrying roller via said image carrying member interposed therebetween;

wherein the toner image is formed on said image carrying member by changing a value of a voltage, on the basis of image information, applied to said electrode portion, wherein the toner carried on said toner carrying roller and said image carrying member contact each other in a toner contact area, wherein the toner is moved between said toner carrying roller and said image carrying member in a toner movement area by changing the value of the voltage applied to said electrode portion, and wherein the toner movement area is present downstream of the toner contact area with respect to a movement direction of said image carrying member.

2. An apparatus according to claim 1, wherein at least the toner movement area is present in the toner contact area.

3. An apparatus according to claim 1, wherein a downstream end portion of said electrode portion with respect to the movement direction of said image carrying member is located downstream of the toner movement area with respect to the movement direction of said image carrying member.

4. An apparatus according to claim 1, wherein said electrode portion is a needle like electrode portion.

5. An apparatus according to claim 1, wherein said electrode portion is a planar electrode portion having a width with respect to the movement direction of said image carrying member.

6. An apparatus according to claim 1, wherein the voltage applied to said electrode portion during image formation is at a level free from an occurrence of electric discharge between said toner carrying roller and said image carrying member.

7. An apparatus according to claim 1, wherein said electrode portion and said image carrying member are provided in contact with each other.

8. An apparatus according to claim 1, wherein said electrode portion is electrically connected to a power source for applying the voltage thereto at a position downstream of the toner contact area with respect to the movement direction of said image carrying member.

9. An apparatus according to claim 1, wherein a downstream end portion of said electrode portion is located upstream of a toner movement limit position with respect to the movement direction of said image carrying member.

10. An apparatus according to claim 1, wherein at a cross section perpendicular to a widthwise direction of said image carrying member, a surface of said image carrying member in the toner movement area and a surface of said toner carrying roller in the toner movement area are present at opposite sides with respect to a rectilinear line connecting an upstream end and a downstream end of the toner contact area.

11. An image forming apparatus comprising:

a toner carrying roller for carrying a toner;

an image carrying member, contacting the toner on said toner carrying roller, on which a toner image is to be formed with the toner; and an electrode portion provided at an opposing position in which said electrode portion opposes said toner carrying roller via said image carrying member interposed therebetween;

wherein the toner image is formed on said image carrying member by changing a value of a voltage, on the basis of image information, applied to said electrode portion, wherein the toner carried on said toner carrying roller and said image carrying member contact each other in a toner contact area, and wherein a downstream end portion of said electrode portion is located downstream of the toner contact area with respect to a movement direction of said image carrying member.

* * * * *